US005907316A

United States Patent [19]

Mikoshiba et al.

[11] Patent Number: 5,907,316

[45] Date of Patent: May 25, 1999

[54] METHOD OF AND APPARATUS FOR DISPLAYING HALFTONE IMAGES

[75] Inventors: Shigeo Mikoshiba; Takahiro Yamaguchi, both of Tokyo; Kohsaku Toda, Kyoto; Tsutae Shinoda, Kawasaki; Kyoji Kariya, Kawasaki; Toshio Ueda, Kawasaki; Katsuhiro Ishida, Kawasaki, all of Japan

[73] Assignee: Fujitsu Limited, Kawasaki, Japan

[21] Appl. No.: 08/693,598

[22] Filed: Aug. 5, 1996

[30] Foreign Application Priority Data

Jul. 29, 1996 [JP] Japan ..... 8-198916

[51] Int. Cl.[6] ..... G09G 5/10

[52] U.S. Cl. ..... 345/147; 345/63; 345/432; 345/474; 382/274

[58] Field of Search ..... 345/147–149, 345/63, 432, 474, 475; 382/274

[56] References Cited

U.S. PATENT DOCUMENTS

| | | | |
|---|---|---|---|
| 4,901,149 | 2/1990 | Fernando et al. | 358/141 |
| 5,068,723 | 11/1991 | Dixit et al. | 358/133 |
| 5,198,896 | 3/1993 | Kondo et al. | 358/105 |
| 5,394,520 | 2/1995 | Hall | 395/135 |
| 5,467,133 | 11/1995 | Lee | 348/402 |
| 5,475,430 | 12/1995 | Hamada et al. | 348/394 |
| 5,508,747 | 4/1996 | Lee | 348/441 |
| 5,541,618 | 7/1996 | Shinoda | 345/60 |
| 5,648,796 | 7/1997 | Boursier et al. | 345/149 |
| 5,714,974 | 2/1998 | Liu | 345/149 |
| 5,724,054 | 3/1998 | Shinoda | 345/60 |

FOREIGN PATENT DOCUMENTS

| | | |
|---|---|---|
| 0 444 962 | 9/1991 | European Pat. Off. . |
| 0 720 139 | 7/1996 | European Pat. Off. . |

OTHER PUBLICATIONS

Tetsuo et al., "Half–Tone Image Displaying Method," *Patent Abstracts of Japan*, vol. 17, No. 498 (P–1609), Sep. 8, 1993 & JP–A–05–127613 (Nippon Hoso Kyokai), May 25, 1993 * Abstract.

Motoo, "Video Display Method for Display Panel," *Patent Abstracts of Japan*, vol. 96, No. 9, Sep. 30, 1996 & JP–A–08–123355 (Fujitsu General Ltd.), May 17, 1996 * Abstract.

*Patent Abstracts of Japan*, vol. 96, No. 6, Jun. 28, 1996 & JP 08–054853 A (Fujitsu General Ltd), Feb. 27, 1996.

*Patent Abstracts of Japan*, vol. 96, No. 9, Sep. 30, 1996 & JP 08–123355 A (Fujitsu General Ltd), May 17, 1996.

*Patent Abstracts of Japan*, vol. 17, No. 498 (P–1609), Sep. 8, 1993 & JP 05–127613 A (Nippon Hoso Kyokai), May 25, 1993.

Mikoshiba et al., "34.5: Appearance of False Pixels and Degradation of Picture Quality in Matrix Displays Having Extended Light–Emission Periods," *SID 92 Digest*, ISSN0097–0966X/92/0000–659, 1992, pp. 659–662.

Saegusa et al., "Development of 40–inch AC Plasma Display Panel," *ITE'96: 1996 ITE Annual Convention*, 1996, 2 pages and partial English language translation.

*Primary Examiner*—Dennis-Doon Chow
*Assistant Examiner*—Vincent E. Kovalick
*Attorney, Agent, or Firm*—Staas & Halsey

[57] ABSTRACT

A method displays a halftone image on a display unit by using a frame division technique that divides each frame of the halftone image into subframes each having a specific sustain discharge period to provide a specific intensity level. The method differs the position of the halftone image on the display unit from subframe to subframe in each frame. The method is capable of displaying dynamic halftone images without intensity level disturbance, smears, or false color contours.

41 Claims, 60 Drawing Sheets

DISPLAY DATA FOR FRAME n

DISPLAY DATA FOR FRAME n+1

Fig.17

[SUBFRAMES AND INTENSITY LEVELS]

| SUBFRAME | SF5 | SF4 | SF3 | SF2 | SF1 | SF0 |
|---|---|---|---|---|---|---|
| INTENSITY LEVEL | 32 | 16 | 8 | 4 | 2 | 1 |

Fig.24

| INTENSITY LEVEL | 1dot / t | 2dot / t | 4dot / t |
|---|---|---|---|
| 16 | $X_1$ | $X_2$ | $X_3$ |
| 24 | $Y_1$ | $Y_2$ | $Y_3$ |
| 32 | $Z_1$ | $Z_2$ | $Z_3$ |
| 40 | $U_1$ | - - - - - - | |
| ⋮ | ⋮ | - - - - - - | |

Fig. 63

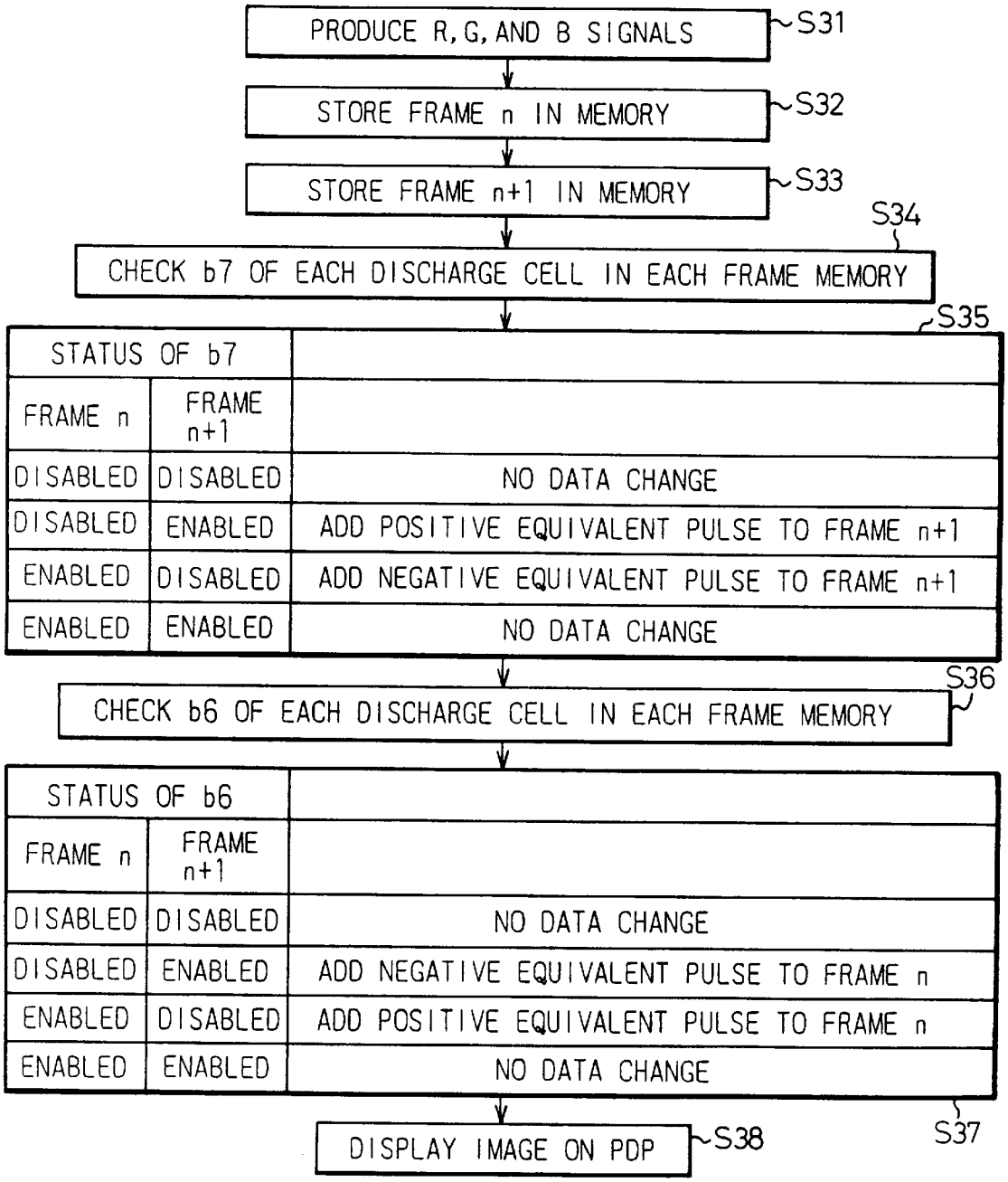

| STATUS OF b7 | | |
|---|---|---|
| FRAME n | FRAME n+1 | |
| DISABLED | DISABLED | NO DATA CHANGE |
| DISABLED | ENABLED | ADD POSITIVE EQUIVALENT PULSE TO FRAME n+1 |
| ENABLED | DISABLED | ADD NEGATIVE EQUIVALENT PULSE TO FRAME n+1 |
| ENABLED | ENABLED | NO DATA CHANGE |

| STATUS OF b6 | | |
|---|---|---|
| FRAME n | FRAME n+1 | |
| DISABLED | DISABLED | NO DATA CHANGE |
| DISABLED | ENABLED | ADD NEGATIVE EQUIVALENT PULSE TO FRAME n |
| ENABLED | DISABLED | ADD POSITIVE EQUIVALENT PULSE TO FRAME n |
| ENABLED | ENABLED | NO DATA CHANGE |

Fig. 64

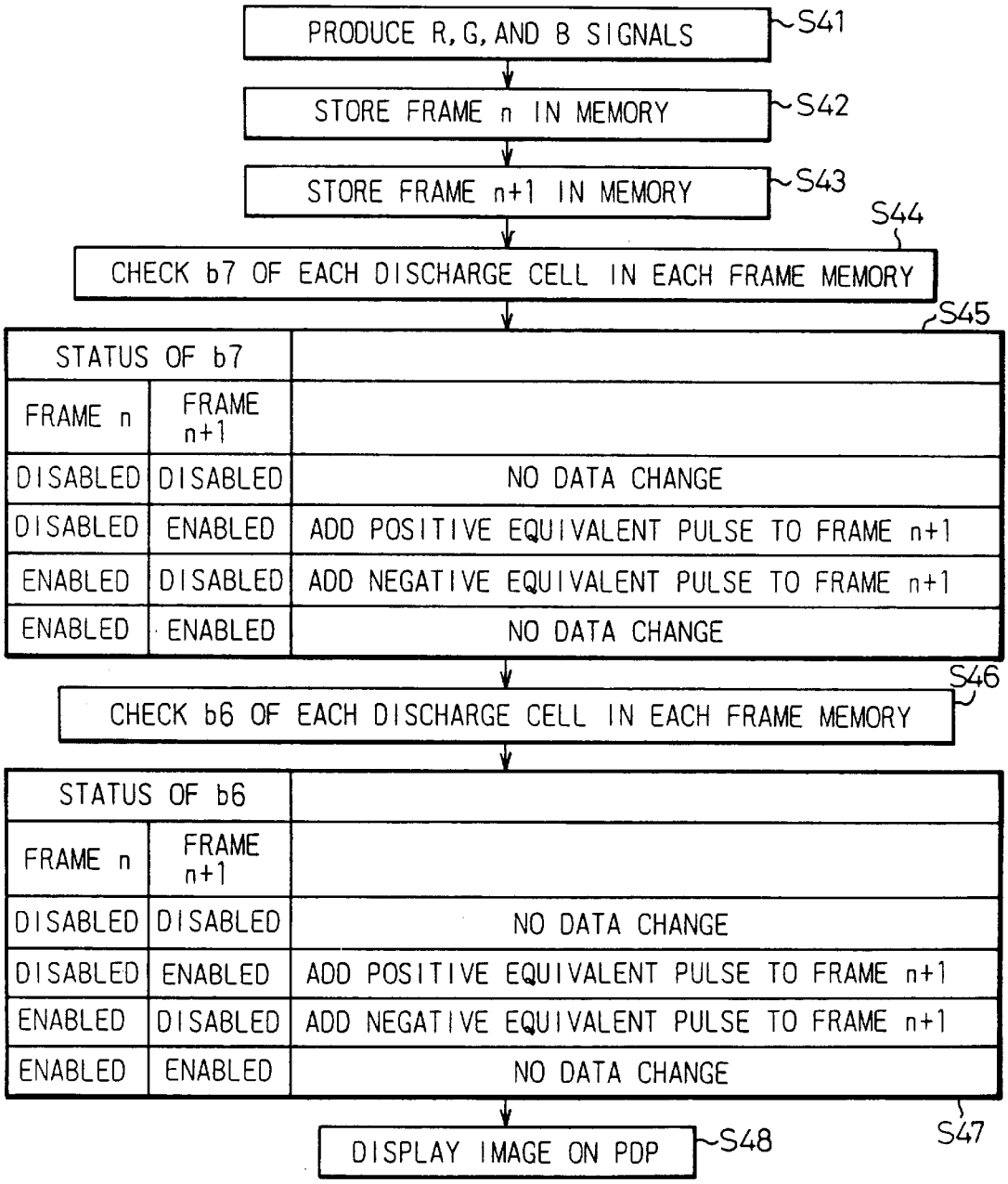

| STATUS OF b7 | | |
|---|---|---|
| FRAME n | FRAME n+1 | |
| DISABLED | DISABLED | NO DATA CHANGE |
| DISABLED | ENABLED | ADD POSITIVE EQUIVALENT PULSE TO FRAME n+1 |
| ENABLED | DISABLED | ADD NEGATIVE EQUIVALENT PULSE TO FRAME n+1 |
| ENABLED | ENABLED | NO DATA CHANGE |

| STATUS OF b6 | | |
|---|---|---|
| FRAME n | FRAME n+1 | |
| DISABLED | DISABLED | NO DATA CHANGE |
| DISABLED | ENABLED | ADD POSITIVE EQUIVALENT PULSE TO FRAME n+1 |
| ENABLED | DISABLED | ADD NEGATIVE EQUIVALENT PULSE TO FRAME n+1 |
| ENABLED | ENABLED | NO DATA CHANGE |

METHOD OF AND APPARATUS FOR DISPLAYING HALFTONE IMAGES

BACKGROUND OF THE INVENTION

1. Field of the Invention

The present invention relates to a method of and an apparatus for displaying dynamic halftone images on, for example, a gas discharge panel according to a frame division technique without intensity level disturbance or false color contours.

2. Description of the Related Art

To meet a demand for large thin display units, there have been proposed plasma display panels, gas discharge panels, DMDs (digital micromirror devices), EL (electric luminescence) display panels, fluorescent display panels, liquid crystal display panels, etc.

Among them, the gas discharge panels are considered to be most advantageous for direct-view large HDTV display units because they are simple to form a large unit, emit light by themselves, provide high display quality, and achieve high response speed. The gas discharge panels display static halftone images without problem. They, however, frequently cause disturbance and deteriorate display quality when displaying dynamic halftone images. It is required, therefore, to provide a method of displaying dynamic halftone images without disturbance.

The details of the prior arts and their problems will be explained later with reference to drawings.

SUMMARY OF THE INVENTION

An object of the present invention is to display dynamic halftone images without intensity level disturbance, smears, or false color contours.

According to the present invention, there is provided a method of displaying a halftone image on a display unit by using a frame division technique that divides each frame of the halftone image into subframes each having a specific sustain discharge period to provide a specific intensity level, comprising the step of differing a displayed position of the halftone image on the display unit from subframe to subframe in each frame.

The displayed position in each subframe may be successively advanced between a first position determined by display data provided for a first frame and a second position determined by display data provided for a second frame next to the first frame. The displayed position in each subframe may be determined according to a motion vector set between the first position and the second position. The displayed position in each subframe may be determined according to control data determined by a function that is set according to characteristic values of the subframes constituting the frame and the position of the halftone image in a specific subframe.

The method may further comprise the steps of displaying the halftone image at the first position in one of the subframes having a highest intensity level; finding a delay time between the highest intensity subframe and each of the other subframes; dividing each of the delay times by a frame period; multiplying each of the quotients by the motion vector, to provide each subframe vector; calculating positions according to the subframe vectors; and displaying the halftone image at the calculated positions in the corresponding subframes.

The method may further comprise the steps of selecting one of the subframes as a vector origin; displaying the halftone image in the selected subframe; finding a delay time between the selected subframe and each of the other subframes; dividing each of the delay times by a frame period; multiplying each of the quotients by the motion vector, to provide each subframe vector; calculating positions according to the subframe vectors; and displaying the halftone image at the calculated positions in the corresponding subframes.

An origin of the motion vector may be determined at a start position of a sustain discharge period of the subframes, and the delay time of each subframe may be determined at a start position of a sustain discharge period of a corresponding subframe. An origin of the motion vector may be determined at a center position of a sustain discharge period of the subframes, and the delay time of each subframe may be determined at a center position of a sustain discharge period of a corresponding subframe.

When the number of subframes to be turned ON in the frame is smaller than a predetermined number, the method may further comprise the steps of forming at least one subframe groups; selecting one of the subframe groups as a vector origin; displaying the halftone image in the selected subframe group; finding a delay time between the intensity level center of the selected subframe group and the intensity level center of each of the other subframe groups; dividing each of the delay times by a frame period; multiplying each of the quotients by the motion vector, to provide each subframe group vector; calculating positions according to the subframe group vectors; and displaying the halftone image at the calculated positions in the corresponding subframe groups.

According to the present invention, there is also provided a method of displaying a halftone image on a display unit by using a frame division technique that divides each frame of the halftone image into subframes each having a specific sustain discharge period to provide a specific intensity level, comprising the step of turning OFF at least one of subframes that are coupled together when displaying the halftone image with different intensity levels, thereby suppressing a bright part to be produced by the coupled specific subframes.

The number of subframes to be additionally turned OFF or ON may be determined according to a scroll speed of the halftone image or the intensity levels. The subframes adjacent to the specific subframes may be turned OFF or ON, when the scroll speed of the halftone image is high.

Further, according to the present invention, there is provided a method of displaying a halftone image on a display unit by using a frame division technique that divides each frame of the halftone image into subframes each having a specific sustain discharge period to provide a specific intensity level, comprising the step of turning ON at least one of subframes that are OFF when displaying the halftone image with different intensity levels, thereby suppressing a dark part that are produced by the specific subframes.

The number of subframes to be additionally turned OFF or ON may be determined according to a scroll speed of the halftone image or the intensity levels. The subframes adjacent to the specific subframes may be turned OFF or ON, when the scroll speed of the halftone image is high.

In addition, according to the present invention, there is also provided an apparatus for displaying a halftone image on a display unit by using a frame division technique that divides each frame of the halftone image into subframes each having a specific sustain discharge period to provide a specific intensity level, comprising a motion vector detection unit for detecting a motion vector that indicates a moving direction of the halftone image, by comparing display data for a first frame of the halftone image with display data for a second frame next to the first frame; and a differing unit for differing the display position of the halftone image from subframe to subframe in the first frame according to the motion vector.

The apparatus may further comprise a dividing unit for dividing each delay time, which is found between the first subframe and each of the other subframes in the given frame, by a frame period and providing each correction value; and a frame interpolator for multiplying the display data for the given frame by each of the correction values, to generate display data for each of the subframes of the given frame, so that the halftone image is displayed according to the display data of the subframes.

According to the present invention, there is provided a method of displaying a halftone image on a display unit by using a frame division technique that divides each frame of the halftone image into subframes each having a specific sustain discharge period to provide a specific intensity level, comprising the steps of comparing an intensity level of a given pixel between consecutive frames when the intensity level of the pixel changes between the consecutive frames; and enabling or disabling at least one intensity level adjusting subframe in the subframes of the frame of the pixel in accordance with the result of the comparing step.

The step of enabling or disabling the intensity level adjusting subframe may comprise the step of enabling an intensity level adjusting subframe in the subframes of one of consecutive frames that cause a change in intensity level between them, to substantially satisfy the following expressions: $S1 \leqq S2+\Delta S \leqq S3$ or $S1 \geqq S2+\Delta S \geqq S3$ where S1 is an average of B(t), which is a temporal change in a stimulus on a human eye, before the change of intensity level, S2 is an average of B(t) during the change of intensity level, S3 is an average of B(t) after the change of intensity level, and ΔS is an average of a temporal change in a stimulus on a human eye due to the intensity level adjusting subframe.

The step of enabling or disabling the intensity level adjusting subframe may comprise the step of enabling an intensity level adjusting subframe to substantially satisfy the following expressions: $0 \leqq \Delta S \leqq 2(S1-S2)$ or $0 \leqq \Delta S \leqq 2(S3-S2)$ where S1 is an average of B(t), which is a temporal change in a stimulus on a human eye, before the change of intensity level, S2 is an average of B(t) during the change of intensity level, S3 is an average of B(t) after the change of intensity level, and ΔS is an average of a temporal change in a stimulus on a human eye due to the intensity level adjusting subframe.

The step of enabling or disabling the intensity level adjusting subframe may comprise the step of disabling an intensity level adjusting subframe in the subframes of one of consecutive frames that cause a change in intensity level between them, to substantially satisfy the following expressions: $S1 \leqq S2-\Delta S \leqq S3$ or $S1 \geqq S2-\Delta S \geqq S3$ where S1 is an average of B(t), which is a temporal change in a stimulus on a human eye, before the change of intensity level, S2 is an average of B(t) during the change of intensity level, S3 is an average of B(t) after the change of intensity level, and ΔS is an average of a temporal change in a stimulus on a human eye due to the intensity level adjusting subframe.

The step of enabling or disabling the intensity level adjusting subframe may comprise the step of enabling an intensity level adjusting subframe to substantially satisfy the following expressions: $0 \leqq \Delta S \leqq 2(S2-S1)$ or $0 \leqq \Delta S \leqq 2(S2-S3)$ where S1 is an average of B(t), which is a temporal change in a stimulus on a human eye, before the change of intensity level, S2 is an average of B(t) during the change of intensity level, S3 is an average of B(t) after the change of intensity level, and ΔS is an average of a temporal change in a stimulus on a human eye due to the intensity level adjusting subframe.

The intensity level adjusting subframe may be enabled or disabled at or around the center of original subframes that are enabled to provide different intensity levels between consecutive frames. The subframes may be arranged in order to enable or disable the intensity level adjusting subframe at or around the center of original subframes that are enabled to provide different intensity levels between consecutive frames. The subframes of each frame may be arranged such that one having the highest intensity level and one having the second highest intensity level are not adjacent to each other.

According to the present invention, there is also provided a method of displaying a halftone image on a display unit by using a frame division technique that divides each frame of the halftone image into subframes each having a specific sustain discharge period to provide a specific intensity level, comprising the steps of comparing display signals provided for consecutive frames with each other; and enabling or disabling a predetermined bit of the display signals according to a result of the comparison.

The step of enabling or disabling the predetermined bit of the display signals may comprise the step of enabling or disabling a predetermined bit of a display signal provided for a given pixel when the intensity level of the pixel is changed temporally, thereby enabling or disabling an intensity level adjusting subframe of the pixel. The step of enabling or disabling the predetermined bit of the display signals may comprise the step of enabling or disabling a predetermined bit of a display signal provided for a given pixel when the intensity level of the pixel is changed temporally, thereby enabling or disabling an intensity level adjusting subframe of the pixel and smoothing a change in the intensity level of the pixel between consecutive frames.

The step of enabling or disabling the predetermined bit of the display signals may comprise the steps of comparing display signals provided for consecutive frames with each other; and enabling or disabling a predetermined intensity level adjusting subframe in at least one of the frames when enabled bits of the display signals change between the frames. The step of enabling or disabling the predetermined bit of the display signals may comprise the step of enabling or disabling a predetermined intensity level adjusting subframe in one of consecutive frames "n" and "n+1" when the state of the most significant bit of each display signal provided for the frames changes between the frames. The step of enabling or disabling the predetermined bit of the display signals may comprise the step of enabling or disabling a predetermined intensity level adjusting subframe in one of consecutive frames "n" and "n+1" when the state of a highest bit of each display signal provided for the frames changes between the frames.

The subframes in each frame may be arranged in ascending order of the intensity levels thereof, and the step of enabling or disabling the predetermined bit of the display signals may comprise the step of enabling a predetermined intensity level adjusting bit of a display signal provided for a frame "n+1" when the highest intensity subframe of a frame "n" is disabled and when the highest intensity subframe of the frame "n+1" is enabled. The subframes in each frame may be arranged in ascending order of the intensity levels thereof, and the step of enabling or disabling the predetermined bit of the display signals may comprise the step of disabling a predetermined intensity level adjusting bit of a display signal provided for a frame "n+1" when the highest intensity subframe of a frame "n" is enabled and when the highest intensity subframe of the frame "n+1" is disabled.

The subframes in each frame may be arranged in descending order of the intensity levels thereof, and the step of enabling or disabling the predetermined bit of the display signals may comprise the step of disabling a predetermined intensity level adjusting bit of a display signal provided for a frame "n" when the highest intensity subframe of the frame "n" is disabled and when the highest intensity subframe of a frame "n+1" is enabled. The subframes in each frame may be arranged in ascending order of the intensity levels thereof, and the step of enabling or disabling the predetermined bit of the display signals may comprise the step of enabling a predetermined intensity level adjusting bit of a display signal provided for a frame "n" when the highest intensity subframe of the frame "n" is enabled and when the highest intensity subframe of a frame "n+1" is disabled.

The subframes in each frame may be arranged with one having the second highest intensity level at the top and one having the highest intensity level at the end, and the step of enabling or disabling the predetermined bit of the display signals may comprise the step of enabling a predetermined intensity level adjusting bit of a display signal provided for a frame "n+1" when the highest intensity subframe of a frame "n" is disabled and when the highest intensity subframe of the frame "n+1" is enabled. The subframes in each frame may be arranged with one having the second highest intensity level at the top and one having the highest intensity level at the end, and the step of enabling or disabling the predetermined bit of the display signals may comprise the step of disabling a predetermined intensity level adjusting bit of a display signal provided for a frame "n+1" when the highest intensity subframe of a frame "n" is enabled and when the highest intensity subframe of the frame "n+1" is disabled.

The subframes in each frame may be arranged with one having the highest intensity level at the top and one having the second highest intensity level at the end, and the step of enabling or disabling the predetermined bit of the display signals may comprise the step of disabling a predetermined intensity level adjusting bit of a display signal provided for a frame "n+1" when the highest intensity subframe of a frame "n" is disabled and when the highest intensity subframe of the frame "n+1" is enabled. The subframes in each frame may be arranged with one having the highest intensity level at the top and one having the second highest intensity level at the end, and the step of enabling or disabling the predetermined bit of the display signals may comprise the step of enabling a predetermined intensity level adjusting bit of a display signal provided for a frame "n+1" when the highest intensity subframe of a frame "n" is enabled and when the highest intensity subframe of the frame "n+1" is disabled.

Further, according to the present invention, there is also provided an apparatus for displaying a halftone image on a display unit by using a frame division technique that divides each frame of the halftone image into subframes each having a specific sustain discharge period to provide a specific intensity level, comprising a frame memory for storing display data of a given frame; a comparator for comparing the display data stored in the frame memory with display data of the next frame; and a data addition unit for adding data from the comparator to the display data of one of the frames.

BRIEF DESCRIPTION OF THE DRAWINGS

The present invention will be more clearly understood from the description of the preferred embodiments as set forth below with reference to the accompanying drawings, wherein:

FIG. 17 shows relationships between subframes and intensity levels according to the first aspect of the present invention;

FIG. 24 shows a table containing reference data used when selecting a subframe according to the first aspect of the present invention;

FIG. 63 is a flowchart showing the operation of a display unit according to the present invention; and FIG. 64 is a flowchart showing the operation of another display unit according to the present invention.

DESCRIPTION OF THE PREFERRED EMBODIMENTS

For a better understanding of the preferred embodiments of the present invention, the problem in the prior art will be explained.

A conventional memory-type gas discharge panel displays halftone images according to a frame division technique that divides each frame of an image into N subframes each providing a specific intensity level. The subframes are SF0, SF1, SF2, . . . , SF(N−1) that provide intensity levels of $2^0, 2^1, 2^2, \ldots, 2^{N-1}$, respectively. Each frame displays a given intensity level by enabling and disabling the subframes thereof, and the human eye sees the sum of the intensity levels of enabled subframes of the frame due to the persistence characteristic of the human eye. The number of intensity levels realized in each frame by combinations of subframes is $2^N$.

Figure 1:
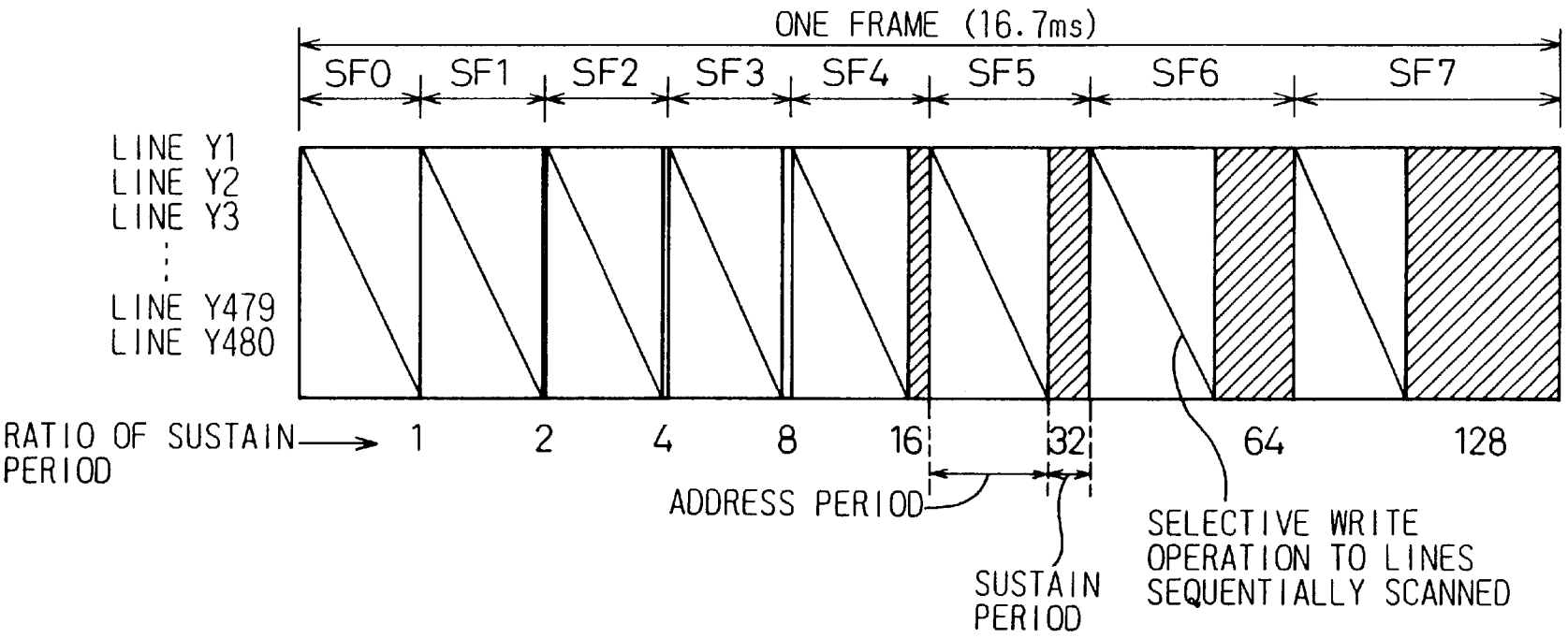
FIG. 1 shows subframes that form a frame.

FIG. 1 shows eight subframes (N=8) SF0 to SF7 contained in a frame. The subframe SF0 represents a lowest intensity level and corresponds to a least significant bit b0 of display data. The subframe SF7 represents a highest intensity level and corresponds to a most significant bit b7 of display data.

If frames that represent similar intensity levels with quite different combinations of subframes alternate, flicker will occur to deteriorate display quality.

Figure 2:
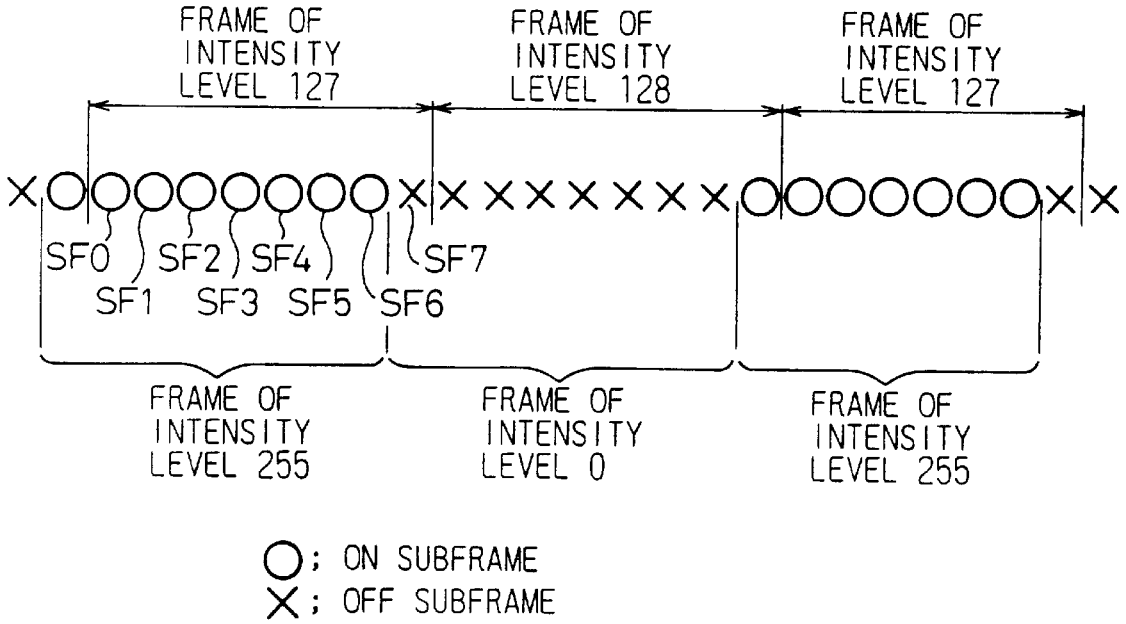
FIG. 2 shows the ON/OFF states of subframes to display intensity levels 127 and 128.

FIG. 2 shows the statuses of subframes of frames that display intensity levels 127 and 128. As shown in FIG. 2, in the intensity level 127, the subframes SF0 to SF6 are enabled (turning ON) and the subframe SF7 is disabled (turning OFF); on the other hand, in the intensity level 128, the subframes SF0 to SF6 are disabled (OFF) and the subframe SF7 is enabled (ON).

When these frames are alternated, there will be a frame period containing only OFF subframes and a frame period containing only ON subframes.

These ON and OFF frames are alternated to cause flicker. This phenomenon frequently occurs due to conversion errors or noise when converting an analog image involving smoothly changing intensity levels into a digital image. The conversion errors or noise are amplified into flicker to deteriorate display quality.

To suppress flicker, Japanese Unexamined Patent Publication No. 3-145691 arranges the subframes of each frame in order of SF0, SF2, SF4, SF6, SF7, SF5, SF3, and SF1.

Flicker occurs when frames that display similar intensity levels with quite different combinations of subframes are alternated. The flicker becomes stronger as intensity levels increase. To solve flicker, Japanese Unexamined Patent Publication No. 4-127194 halves the highest intensity level subframe and inserts a subframe having a lower intensity level between them.

Japanese Unexamined Patent Publication No. 5-127612 reports that the frame division technique sometimes provides rough, low-quality dynamic images, and proposes a method of improving the frame division technique.

The proposal employs a unit for doubling a frame frequency of less than 70 Hz in a display unit. Each frame of the doubled frame frequency has at least one normal-bit subframe including a highest-intensity-level subframe and at least one under-bit subframe. The disclosure displays a static image with every two frames representing an intensity level, and a dynamic image with every frame representing an intensity level. This technique creates display data for the doubled frames according to input display data.

Figure 3:
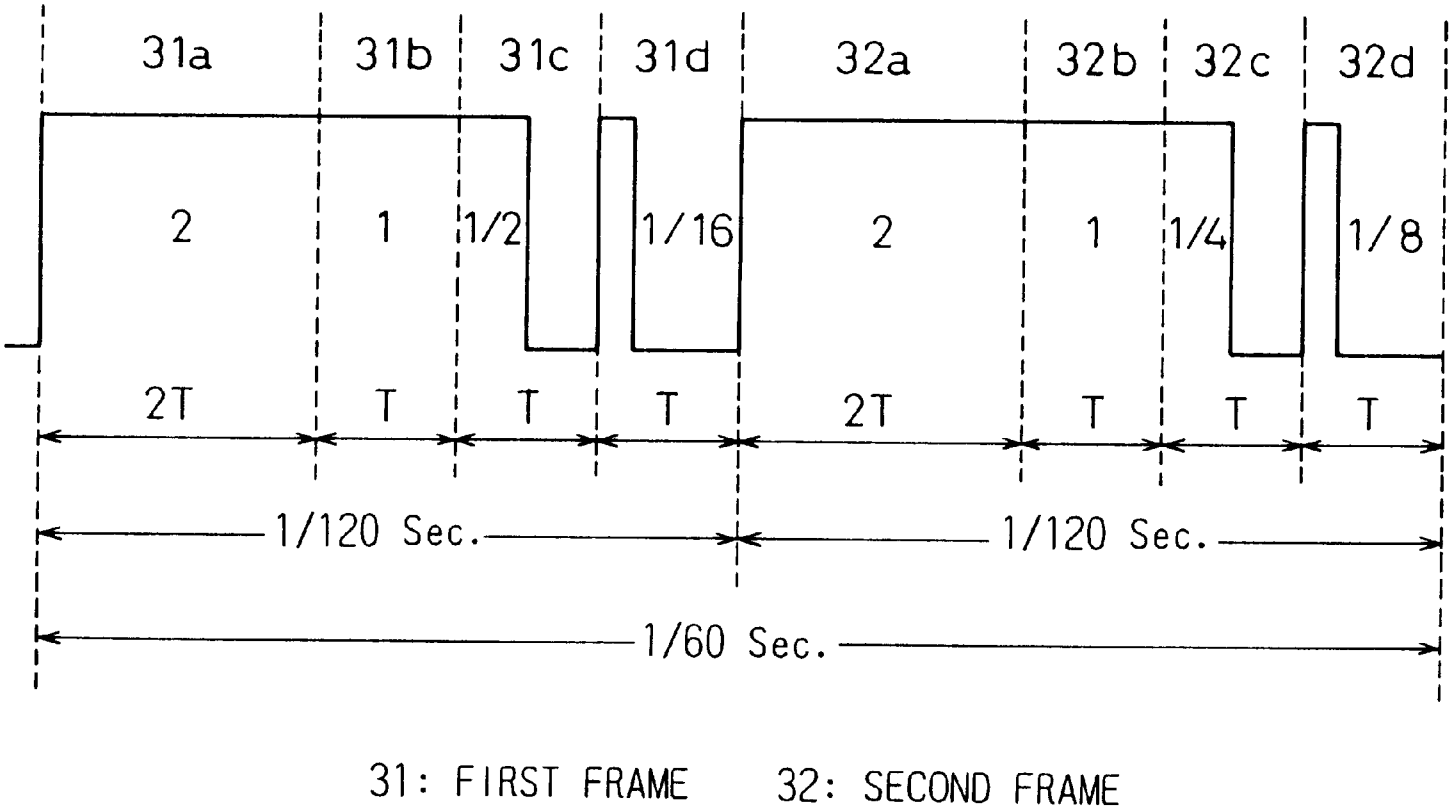
FIG. 3 shows the ON/OFF states of a first frame to display an intensity level 31 and a second frame to display an intensity level 32.

FIG. 3 shows a first frame displaying intensity level 31 and a second frame displaying intensity level 32. The first and second frames are doubled frames. In the first and second frames, subframes 31*a* and 32*a* provide an identical intensity level, and subframes 31*b* and 32*b* provide another identical intensity level. These subframes are normal-bit subframes. The other subframes are under-bit subframes.

The prior art may cause no intensity level disturbance when displaying static images or slow dynamic images. It, however, causes intensity level disturbance when displaying fast dynamic images. The intensity level disturbance will be explained with reference to FIGS. 4 to 7 in which each frame consists of six subframes that are arranged in order of SF5, SF4, SF3, SF2, SF1, and SF0.

Figure 4:
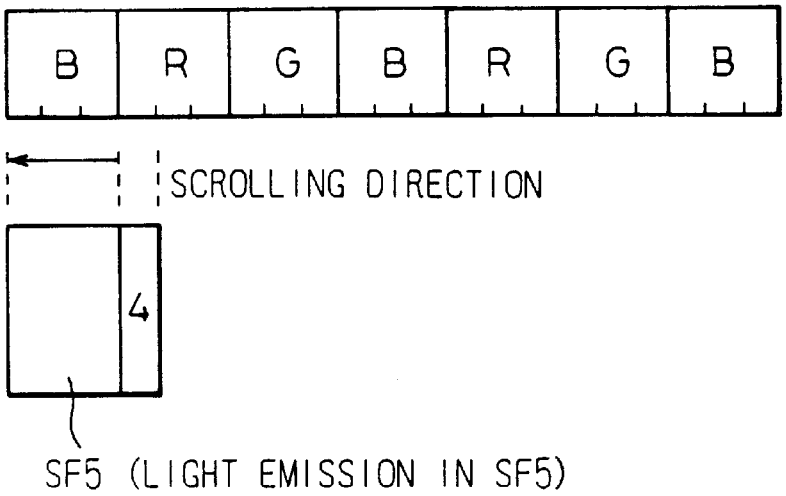
FIG. 4 shows an intensity level disturbance caused by a prior art.
Figure 5:
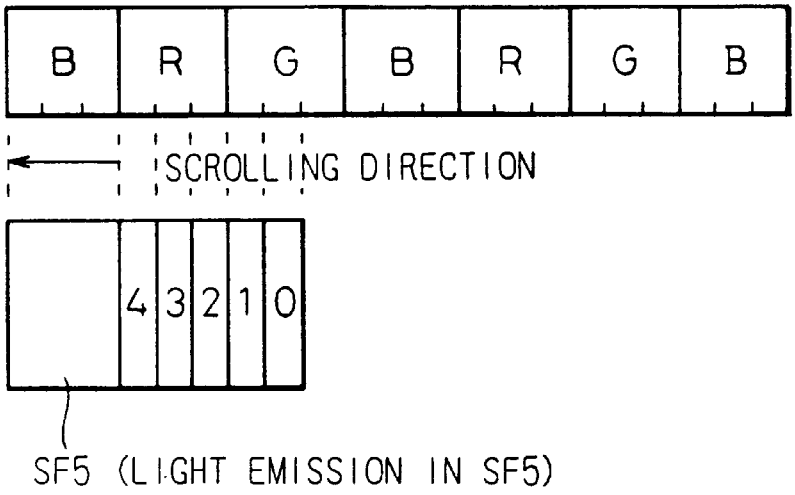
FIG. 5 shows another intensity level disturbance caused by the prior art.
Figure 6:
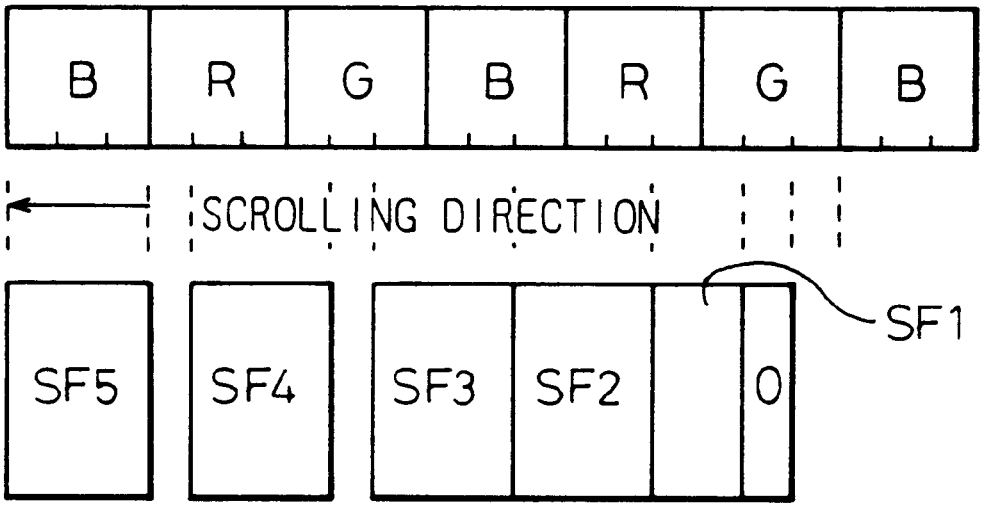
FIG. 6 shows still another intensity level disturbance caused by the prior art.
Figure 7:
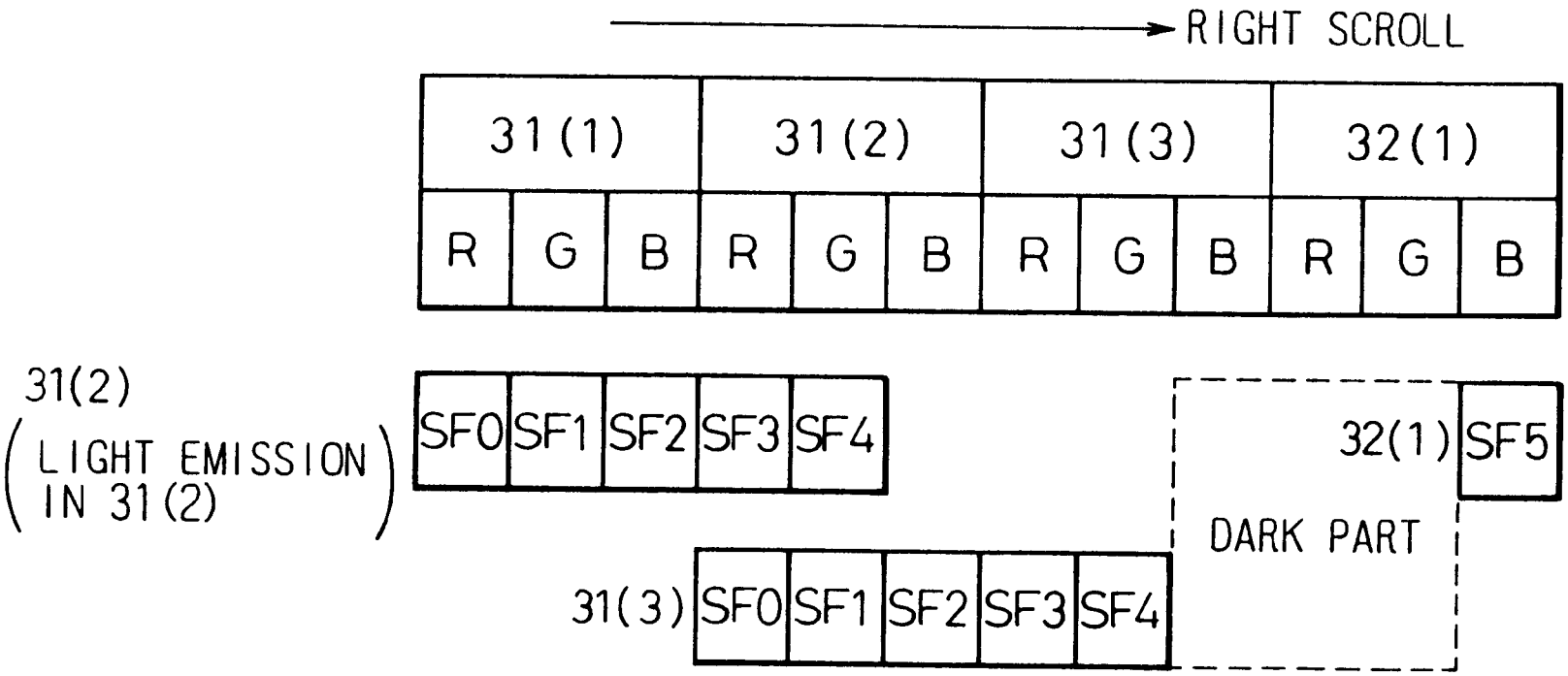
FIG. 7 shows a dark part formed between intensity levels 31 and 32 during a right scroll.

FIGS. 4 to 6 show different types of intensity level disturbance according to a prior art and FIG. 7 shows a dark part formed between intensity levels 31 and 32 during a right scroll.

A vertical blue line is displayed with the subframe SF5 being enabled (turned ON) and is scrolled from the right to the left. When the blue line is scrolled at a speed of a pixel per frame, the human eye sees as if it is smoothly moving even over red and green subpixels that are not turned ON actually. The smooth movement is visible even when the blue line is moved at a speed of several pixels per frame. This phenomenon occurring on the human eye is called an "apparent motion" or "β motion" in psychology.

In FIG. 4, a vertical blue line is displayed with the subframes SF5 and SF4 being enabled and is scrolled from the right to the left at a speed of a pixel per frame. In this case, the human eye sees the subframes SF5 and SF4 being spatially separated from each other. Although the subframe SF5 of a blue subpixel is enabled in FIG. 4, the human eye sees as if it is moving over red and green subpixels.

When the subframe SF4 is turned ON after a write period of about 2 msec after turning ON the subframe SF5, the human eye sees as if the subframe SF4 follows the subframe SF5 in the scrolling direction. If all subframes of each frame are enabled and scrolled as shown in FIG. 5, they are viewed as if they are spatially separated from one another.

FIG. 6 shows a vertical blue line displayed with the subframes SF5 to SF0 being enabled and scrolled from the right to the left at a speed of two pixels per frame. Due to the extended intervals to two pixels, the human eye sees faster movements of the subframes. When the subframe SF4 is turned ON, the subframe SF5 is ahead thereof. Namely, the human eye sees the subframes spreading for a distance corresponding to a frame period.

Although the subframes of each frame actually emit light in the same pixel, the human eye sees as if they emit light in different pixels when a dynamic image is displayed. In this case, an intensity level assigned to a given frame is not displayed as the sum of the subframes of the frame, thereby causing intensity level disturbance.

Figure 8:
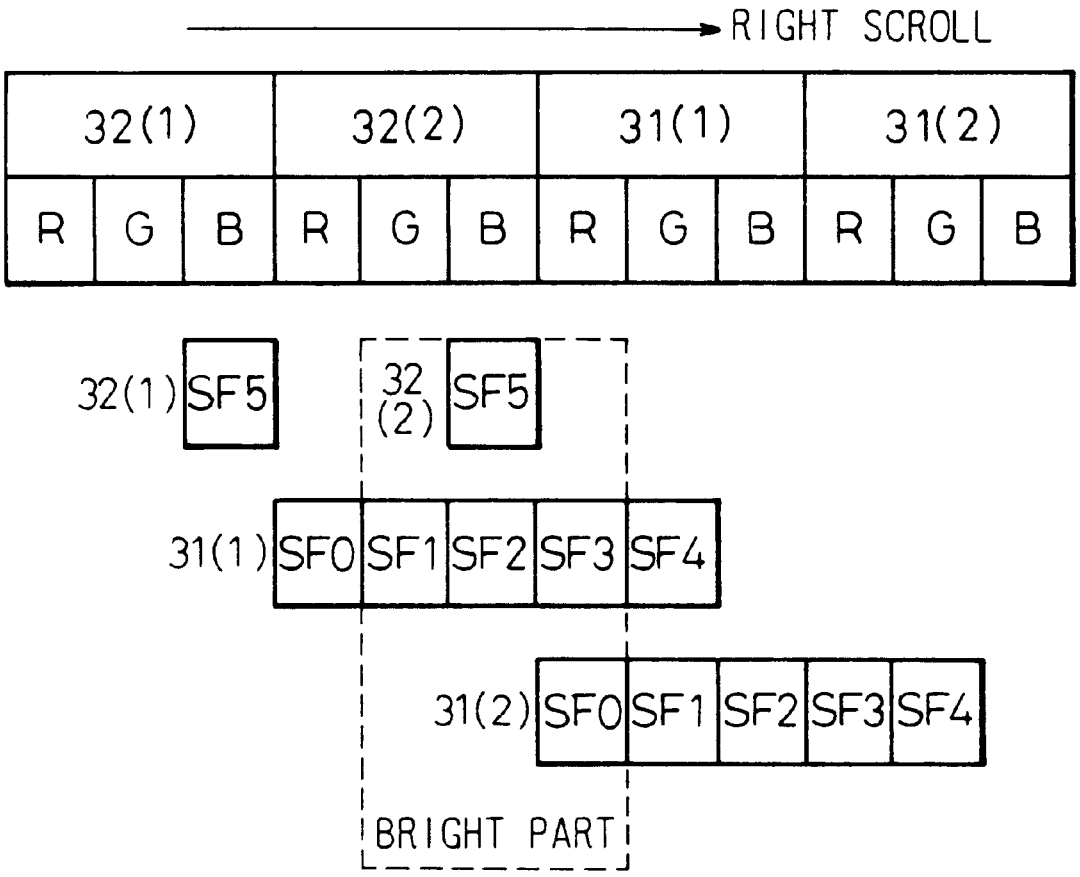
FIG. 8 shows a bright part formed between intensity levels 32 and 31 during a right scroll.

FIGS. 7 and 8 show dark and bright parts that appear between specific intensity levels when displaying a halftone image of a single color and scrolling the image.

In the figures, each frame consists of six subframes SF5 to SF0 that are arranged in descending order of the intensity levels thereof. A halftone image is displayed with blue whose intensity level is gradually increased from the left to the right, and the image is scrolled to the right. A dark part appears between specific intensity levels that involve quite different numbers of ON subframes.

Such dark part is produced between, for example, intensity levels 31 and 32, 15 and 16, or 7 and 8. In FIG. 7, the image is moved at a speed of two pixels per frame, and a dark part appears between intensity level 31, which is realized by enabling (turning ON) the subframes SF4 to SF0, and intensity level 32, which is realized by enabling the subframe SF5 alone.

The dark part occurs because the subframes are spatially separated from one another when displaying dynamic images. The dark part of FIG. 7 extends for one pixel, i.e., three red (R), green (G), and blue (B) subpixels.

Figure 9:
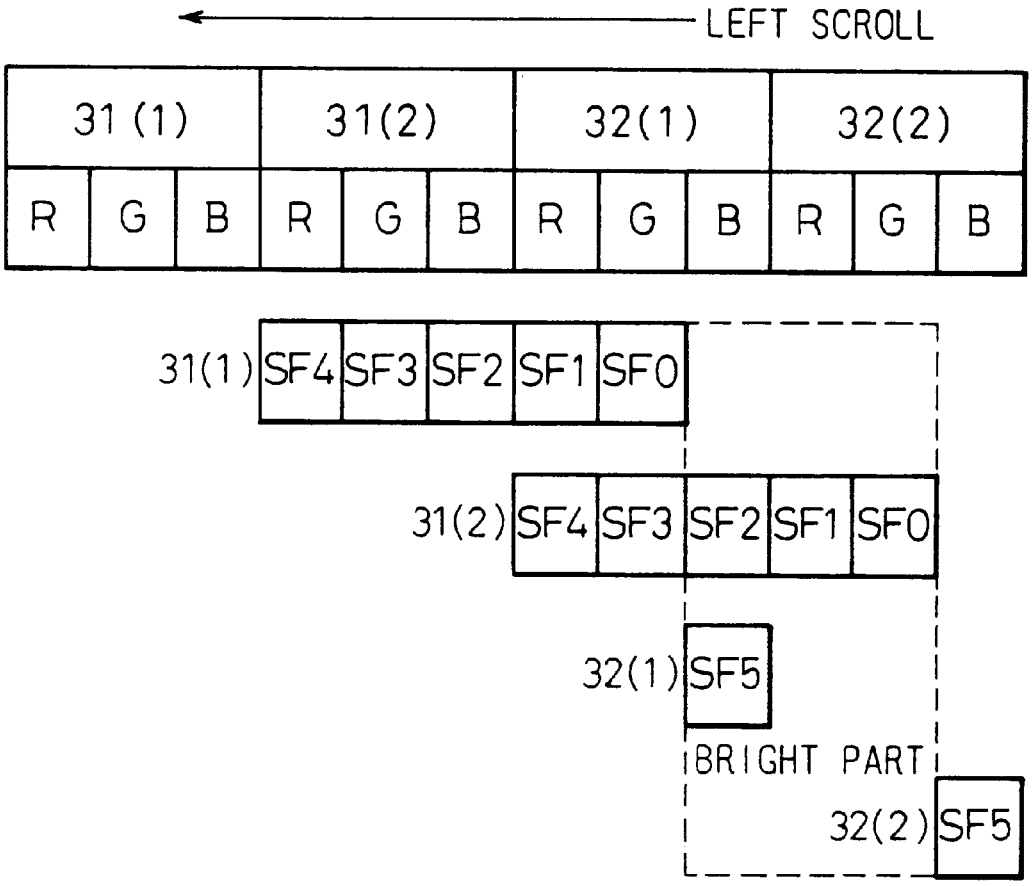
FIG. 9 shows a bright part formed during a left scroll of the example of FIG. 7.

When the image is scrolled to the left, a bright part occurs between intensity levels 31 and 32 as shown in FIG. 9.

When displaying a dynamic image with single color or with the same subframes being enabled in each subpixel of a given pixel, the image may involve a dark or bright part. When displaying a dynamic image with different subframes being enabled in the subpixels of a given pixel, the image may involve unwanted colors.

For example, false color contours of amaranthine and green appear along the flesh-colored cheek of an image of a person displayed, when the person displayed looks back.

Next, preferred embodiments of the present invention will be explained with reference to the drawings.

A first aspect of the present invention provides a method of displaying a halftone image on a display unit according to a frame division technique that divides each frame of the halftone image into subframes each having an addressing period and a specific sustain discharge period to provide a specific intensity level. When displaying dynamic halftone images, the method differs the position of each frame of image on the display unit from subframe to subframe. More precisely, the method successively advances the position of each dynamic image on the display unit from subframe to subframe between a first position determined by display data provided for a given frame and a second position determined by display data provided for the next frame. The method determines the position of the dynamic image in each subframe according to a motion vector set between the first and second positions.

Figure 10:
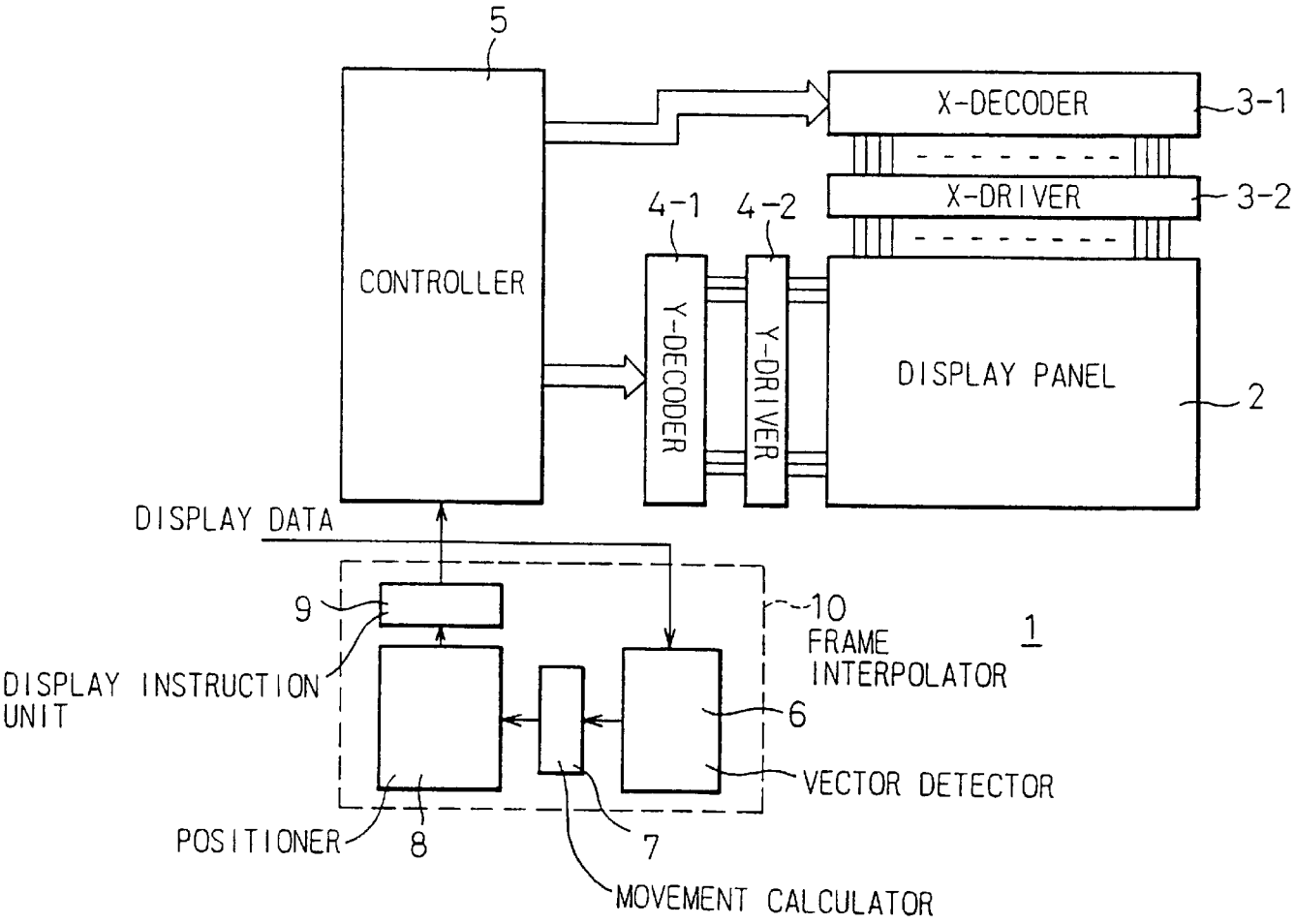
FIG. 10 is a block diagram showing a display unit according to the present invention.

FIG. 10 is a block diagram showing a display unit employing a halftone image displaying method according to a first embodiment of the first aspect of the present invention. The display unit 1 has a display panel 2, an X-decoder 3-1, an X-driver 3-2, a Y-decoder 4-1, a Y-driver 4-2, and a controller 5. The controller 5 controls the decoders and drivers, which drive the panel 2.

A frame of an image to be displayed on the panel 2 consists of subframes that are combined to display a required intensity level. The controller 5 divides each subframe into an addressing period and a sustain discharge period. The sustain discharge period of each subframe is set to provide an intensity level specific to the subframe. A vector detector 6 detects a motion vector indicating the moving direction of an image according to display data provided for a given frame and display data provided for the next frame. A display instruction unit 9 determines display positions for the subframes according to the motion vector.

The panel 2 may be a memory-type gas discharge panel, an EL panel, or a liquid crystal panel, capable of displaying halftone images with the use of subframes.

A movement calculator 7 has a divider and a multiplier. The movement calculator 7 finds, in each frame, a delay time between a given subframe and the first subframe, divides the delay time by a frame period, multiplies the quotient by the motion vector detected by the vector detector 6, and calculates a movement for the subframe. A positioner 8 determines the position of an image to be displayed in a given subframe. The display instruction unit 9 provides an instruction to display the image according to the position determined by the positioner 8. These units 6 to 9 form a frame interpolator 10.

More precisely, the vector detector 6 compares display data for a given frame with display data for the next frame and detects a motion vector that indicates the moving direction of a dynamic halftone image represented with the display data. The movement calculator 7 finds a delay time between a given subframe and the first subframe, divides the delay time by a frame period, to provide a correction value, multiplies the motion vector by the correction value, and calculates a movement for the subframe. The positioner 8 determines the position of an image to be displayed in the subframe according to the movement calculated by the movement calculator 7. The display instruction unit 9 provides an instruction to display the image according to the position determined by the positioner 8. Then, the halftone image is displayed on the display panel 2.

Figure 11A:
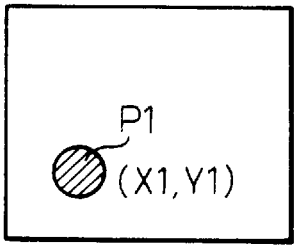
FIGS. 11A to 11D show the display positions of a halftone image according to a prior art.
Figure 11C:
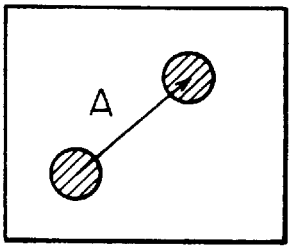
Figure 11B:
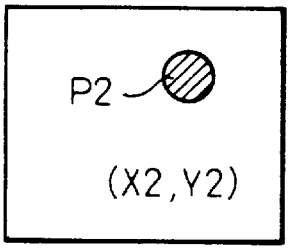

FIGS. 11A to 11D show the display positions of a halftone image according to a prior art. The halftone image is displayed in frames n and n+1 according to display data D1. In FIG. 11A, the image is displayed at a position P1 having coordinates (X1, Y1) in the frame n. In FIG. 11B, the image is displayed at a position P2 having coordinates (X2, Y2) in the frame n+1. FIG. 11C shows a motion vector A oriented from the first position P1 in the frame n toward the second position P2 in the frame n+1.

Figure 11D:
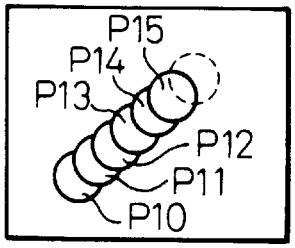

FIG. 11D shows spatially separated subframes between the positions P1 and P2 although the last one of the subframes actually emits light at the position P1.

Figures 12A, 12B:
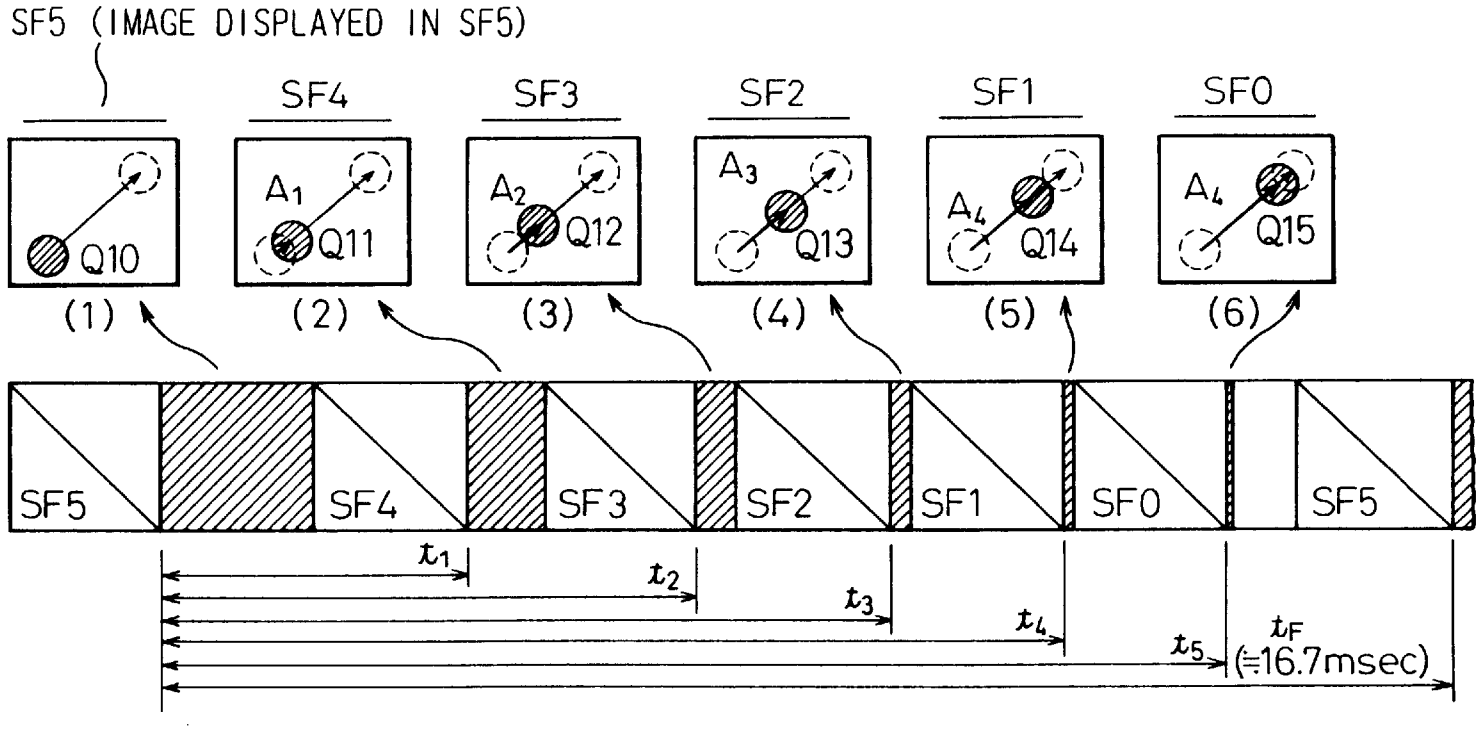
FIG. 12A shows the positions of a halftone image in the subframes of a given frame according to a first aspect of the present invention.
FIG. 12B shows the timing of turning ON the subframes of a frame.

FIG. 12A shows the positions of the same halftone image in the subframes of a given frame according to the first aspect of the present invention, and FIG. 12B shows the timing of enabling the subframes.

Due to the apparent motion of the human eye, the display positions of the subframes SF5 to SF0 are P15 to P10, respectively, as shown in FIG. 11D. These display positions are expressed as follows:

$$
\begin{aligned}
P10 &= P1 + a_0 A \\
&= (X1,\ Y1) \\
P11 &= P1 + a_1 A \\
&= (X1 + a_1(X2 - X1),\ Y1 + a_1(Y2 - Y1)) \\
P12 &= P1 + a_2 A \\
&= (X1 + a_2(X2 - X1),\ Y1 + a_2(Y2 - Y1)) \\
P13 &= P1 + a_3 A \\
&= (X1 + a_3(X2 - X1),\ Y1 + a_3(Y2 - Y1)) \\
P14 &= P1 + a_4 A \\
&= (X1 + a_4(X2 - X1),\ Y1 + a_4(Y2 - Y1)) \\
P15 &= P1 + a_5 A \\
&= (X1 + a_5(X2 - X1),\ Y1 + a_5(Y2 - Y1))
\end{aligned}
$$

where $a_0=(t_5-t_5)/t_F$ $a_1=(t_5-t_4)/t_F$ $a_2=(t_5-t_3)/t_F$ $a_3=(t_5-t_2)/t_F$ $a_4=(t_5-t_1)/t_F$ $a_5=t_5/t_F$

P1=(X1, Y1)

$A=(X2-X1,\ Y2-Y1)$

As shown in FIG. 11D, the image is seen at different positions in the subframes, respectively, according to the prior art, to provide unwanted intensity levels or colors and cause intensity level disturbance or false color contours. On the other hand, the first aspect of the present invention compares display data provides for consecutive frames with each other, detects a motion vector, finds in each frame a delay time between a given subframe and the first subframe, divides the delay time by a frame period, to provide a coefficient, multiplies the motion vector by the coefficient, and calculates a display position for each subframe, thereby suppressing intensity level disturbance or false color contours and improving display quality.

As shown in (1) to (6) of FIG. 12A, the first aspect of the present invention gradually moves the image from the first display position P1 to the second display position P2 according to calculated data.

The first aspect of the present invention determines a motion vector according to a first position of display data provided for a given frame and a second position of display data provided for the next frame.

FIG. 12B shows a frame consisting of six subframes SF5 to SF0 that are arranged in this order. The subframe SF5 provides the highest intensity level and the subframe SF0 provides the lowest intensity level.

FIG. 12A(1) shows that the first subframe SF5 of the frame n is carrying out sustain discharge. The subframe SF5 displays an image according to the display data D1 at the first position P1 (Q10).

The second display position P2 indicated with a dotted line is a position where the frame n+1 displays the image.

The motion vector A indicates display coordinates or the moving state of a display block (Xij) between the frames n and n+1.

FIG. 12A(2) shows that the second subframe SF4 of the frame n is carrying out sustain discharge to display the image at a position Q11 between the positions P1 and P2.

The present invention uses a delay time t1 between the sustain discharge of the subframe SF4 and the sustain discharge of the subframe SF5 as a control factor. The delay time t1 is divided by a frame period $t_F$, and the quotient is multiplied by the motion vector A, to calculate the position Q11.

In FIG. 12A(2), the quotient $t1/t_F$ is multiplied by the motion vector A, to provide an individual vector A1 according to which the display position Q11 for the subframe SF4 is determined.

Similarly, FIGS. 12A(3) to 12A(6) show display positions Q12 to Q15 for the subframes SF3 to SF0, respectively. These positions are calculated according to individual motion vectors A2 to A5 found for the subframes SF3 to SF0, respectively. The vectors A0 to A5 are obtained as follows:

$$A0=0\times A \quad (1)$$

$$A1=(t1/tF)\times A \quad (2)$$

$$A2=(t2/tF)\times A \quad (3)$$

$$A3=(t3/tF)\times A \quad (4)$$

$$A4=(t4/tF)\times A \quad (5)$$

$$A5=(t5/tF)\times A \quad (6)$$

The display positions Q10 to Q15 are expressed as follows:

$$\begin{aligned}
Q10 &= P1+A0=(X1, Y1)\\
Q11 &= P1+A1\\
&= (X1+(t1/tF)Ax,\ Y1+(t1/tF)Ay)\\
Q12 &= P1+A2\\
&= (X1+(t2/tF)Ax,\ Y1+(t2/tF)Ay)\\
Q13 &= P1+A3\\
&= (X1+(t3/tF)Ax,\ Y1+(t3/tF)Ay)\\
Q14 &= P1+A4\\
&= (X1+(t4/tF)Ax,\ Y1+(t4/tF)Ay)\\
Q15 &= P1+A5\\
&= (X1+(t5/tF)Ax,\ Y1+(t5/tF)Ay)
\end{aligned}$$

where Ax and Ay are the X and Y components of the motion vector A.

$$Ax=X2-X1$$

$$Ay=Y2-Y1$$

In this way, the first aspect of the present invention divides each frame into at least two subframes that provide each a specific intensity level. The moving direction and size of a display image of each frame are detected pixel by pixel, or pixel block by pixel block. The first subframe of the frame displays the image as it is, and the next subframe displays the image at a position shifted from the first position in the moving direction.

According to the first aspect, it is preferable to make the subframe that provides the highest intensity level as a vector origin. The subframe serving as the vector origin displays an image without moving it.

The first aspect of the present invention forms a motion vector for a given frame according to display data provided for the frame and display data provided for the next frame, and prepares display data for each subframe of the frame in question according to the motion vector. This technique displays dynamic images without spatially dispersing the subframes of each frame, thereby preventing intensity level disturbance and false color contours.

The first aspect employs the frame interpolator 10 (FIG. 10) to create display data for each subframe.

Figure 13:
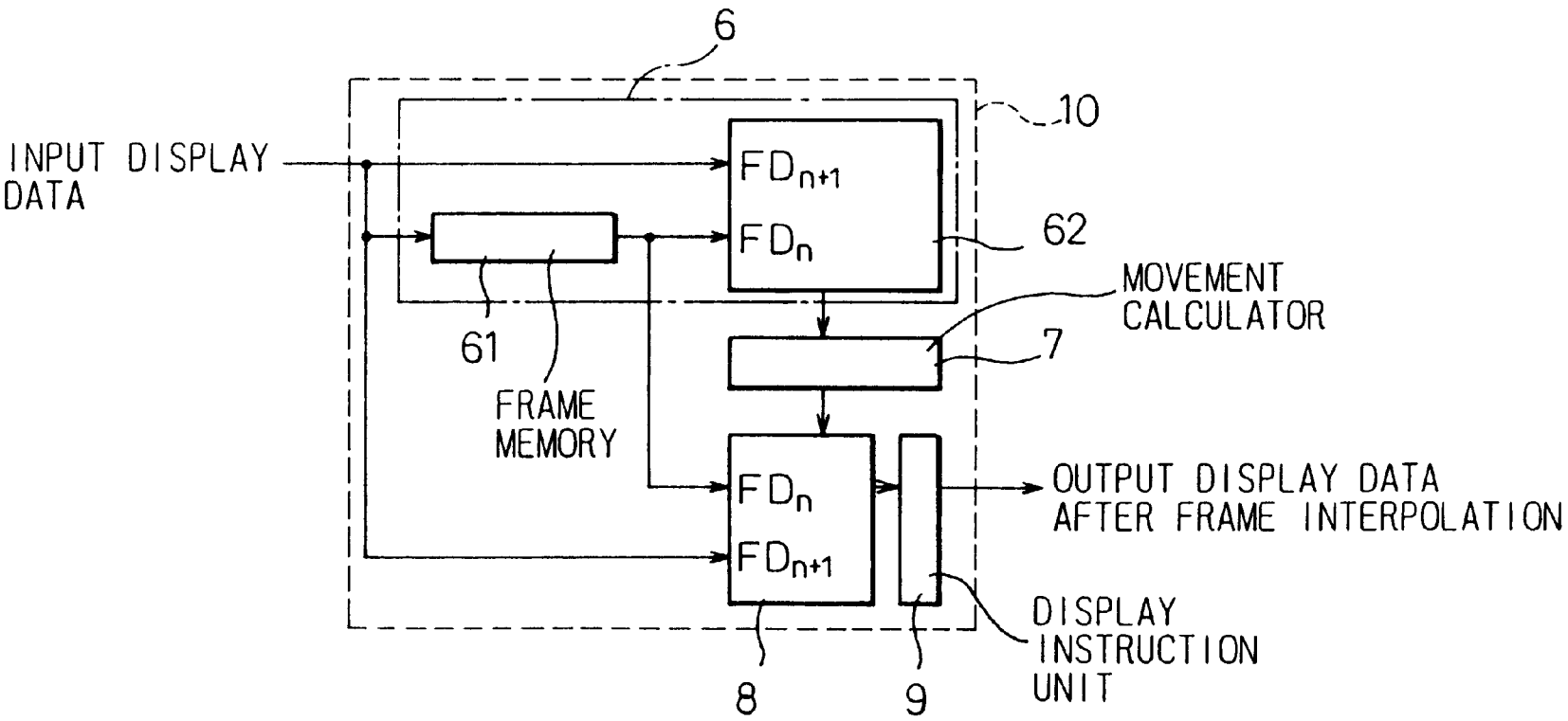
FIG. 13 is a block diagram showing a frame interpolator according to the first aspect of the present invention.

FIG. 13 shows an example of the frame interpolator 10 according to the first aspect of the present invention.

The frame interpolator 10 has a vector detector 6, which consists of a frame memory 61 for storing display data for a frame "n" and a detector 62. The detector 62 receives the display data for the frame n from the frame memory 61 as well as display data for the next frame "n+1," and according to these pieces of data, provides a motion vector A for the display data for the frame n. A movement calculator 7 finds a delay time tn between the light emission timing of a given subframe SFn and the light emission timing of the first subframe, divides the delay time by a frame period tF, for example, 16.7 msec, to provide a control function tn/tF, multiplies the control function tn/tF by the motion vector A, and calculates an individual motion vector An for the subframe SFn.

A positioner 8 determines the position of an image to be displayed in the subframe SFn according to the individual motion vector An. The positional data is supplied to the controller 5 of the display unit 1 through a display instruction unit 9.

Figure 14:
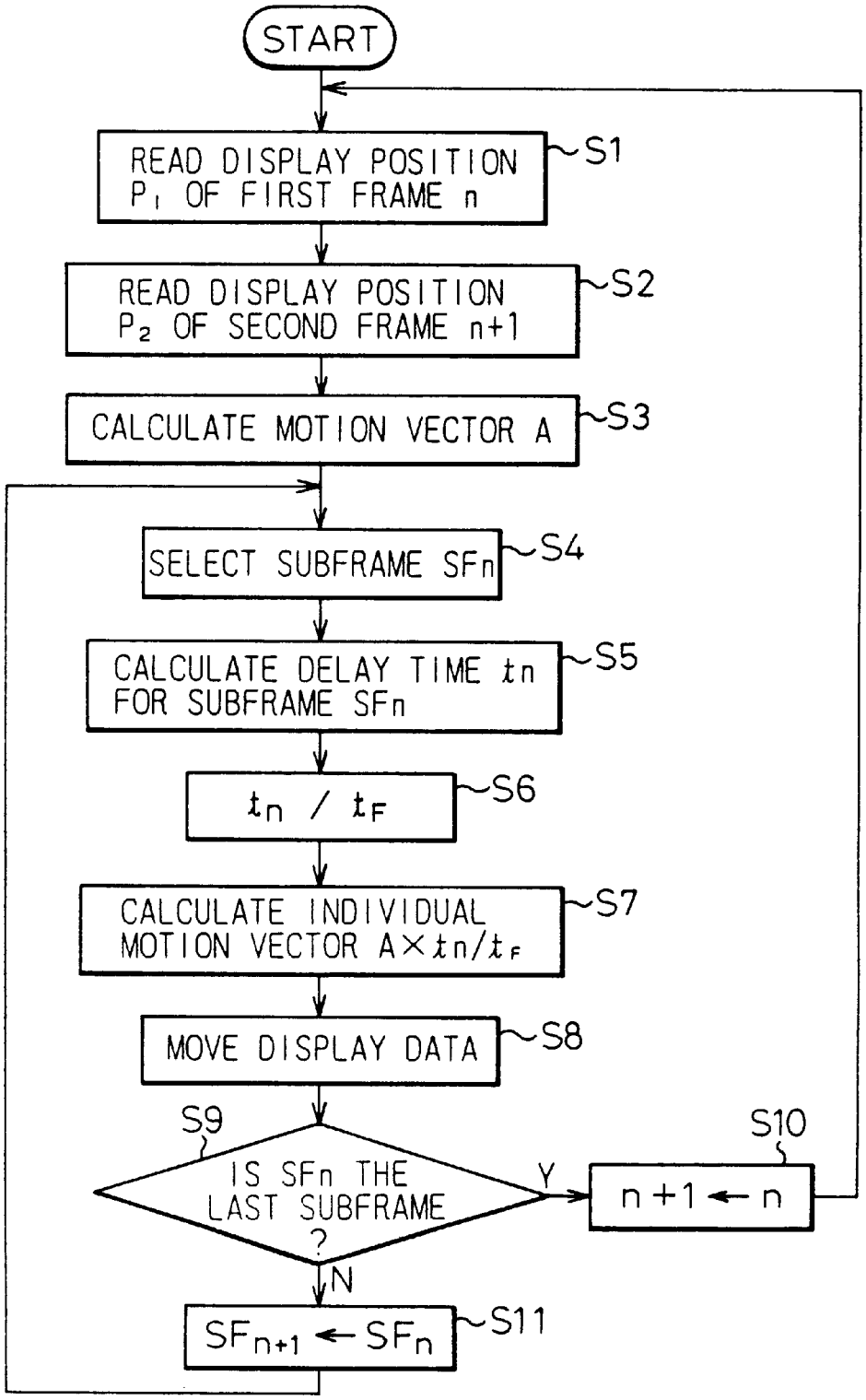
FIG. 14 is a flowchart showing the steps of displaying halftone images according to the first aspect of the present invention.

FIG. 14 is a flowchart showing the steps of the method according to the first aspect of the present invention.

Step S1 reads a display position of an image in a first frame n. The display position P1 is equal to a position where the image is displayed in the subframe SF5.

Step S2 reads a second display position P2 of the image in a second frame n+1.

Step S3 calculates a motion vector A according to the first and second display positions P1 and P2. Step S4 selects a subframe SFn in the frame n.

Step S5 finds a delay time tn between the light emission timing of the subframe SFn and that of the first subframe SF5. Step S6 divides the delay time tn by a frame period tF and provides a control function tn/tF. Step S7 multiplies the control function tn/tF by the motion vector A and calculates an individual motion vector An for the subframe SFn.

Step S8 moves the image to a calculated display position. Step S9 checks to see if the subframe SFn is the last subframe. If it is not the last subframe, step S10 increments n by one, and step S4 is again carried out. If the subframe SFn is the last subframe in step S9, step S11 increments the frame number n by one, and step S1 is again carried out. These steps are repeated until all frames are displayed.

Figure 15:
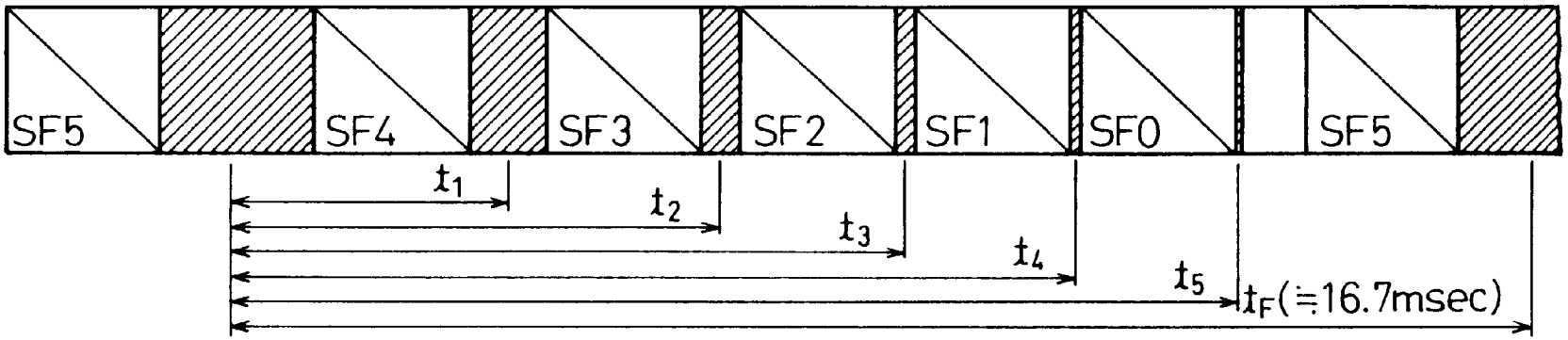
FIG. 15 shows a method of determining the delay time of each subframe.
Figure 16:
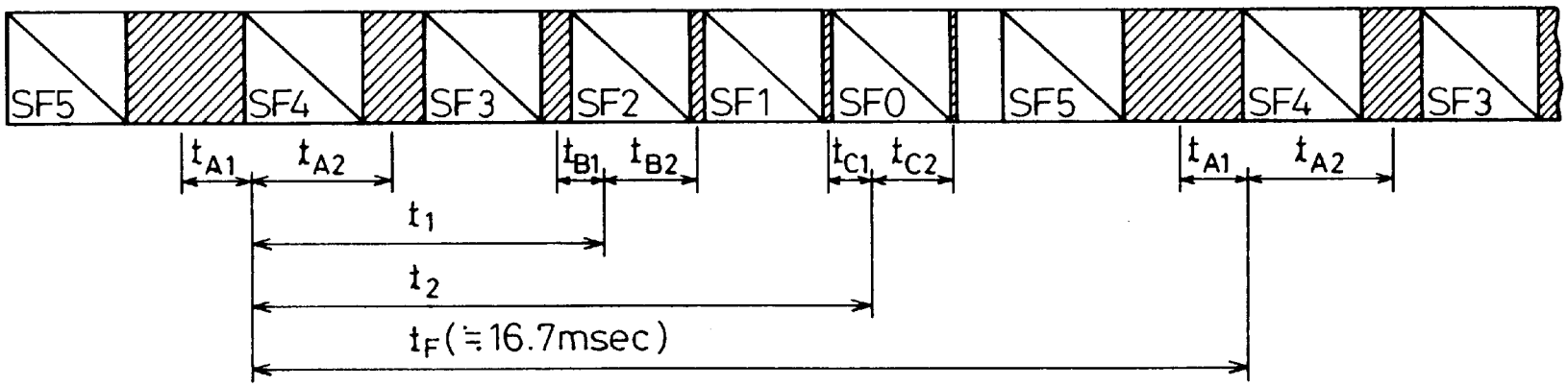
FIG. 16 shows another method of determining the delay time of each subframe.

FIG. 15 shows an example of determining the delay time of each subframe, and FIG. 16 shows another example of determining the same.

The technique of FIG. 15 sets a delay time start point at the center of the light emission period of a subframe that serves as the origin of a motion vector. The delay time of a given subframe is measured between the start point and the center of the light emission period of the given subframe.

The technique of FIG. 16 is employed when the number of subframes to be turned ON (enabled) is smaller than the total number of subframes. In this case, the subframes are grouped so that the number of groups is equal to the number of subframes to be enabled. The center of each group is used to calculate a delay time.

In FIG. 16, the number of subframes contained in each frame is six, and the number of subframes to be enabled is three. The origin of a motion vector is set at the temporal center of the light emission periods of the first two subframes SF5 and SF4, i.e., at a position corresponding to a reciprocal of the ratio of intensity levels of the subframes SF5 and SF4. A point for measuring the delay time of a given subframe group is set at the center of the intensity levels of the subframe group.

Another embodiment of the first aspect of the present invention will be explained.

As explained above, the conventional frame division technique causes the apparent motion when displaying dynamic images so that the human eye sees the subframes of each frame spatially separated from one another. The following embodiment solves this problem.

FIG. 17 shows a frame consisting of six subframes SF5 to SF0. The intensity levels provided by the subframes gradually increase from SF0 to SF5.

Returning to FIG. 7, there is an image consisting of four pixels among which three display intensity level 31 and one displays intensity level 32. The image is scrolled to the right at a speed of two pixels per frame. The scroll speed is slow, and only a blue subpixel is enabled (turned ON) in each pixel, i.e., red and green subpixels in each pixel are disabled (turned OFF). A time point for enabling the subframe SF5 is a reference time point.

According to FIGS. 7 and 17, it is understood that a three-subpixel interval between pixels 31(3) and 32(1) involves no light emission, to produce a dark part S. The present invention forcibly emits light during the three-pixel interval, to suppress the dark part S. In FIG. 7, an additional subframe will be enabled in the pixel 32(1), to increase the intensity level of the pixel 32(1) higher than 32.

Returning to FIG. 8, there is an image consisting of four pixels among which two display intensity level 32 and two display intensity level 31. The image is scrolled to the right.

A three-subpixel interval between pixels 32(2) and 31(1) involves much light emission, to produce a bright part M. The present invention forcibly turns OFF some subframes, to suppress the bright part M. In FIG. 7, some subframes in one of the pixels 31(1) and 31(2) are turned OFF, to drop the intensity level of the pixel in question below 31.

Any image scrolled leftwards, rightwards, or vertically is handled in the same manner.

FIG. 9 shows the same image as FIG. 7 but scrolled to the left. FIG. 9 produces a bright part M instead of the dark part S of FIG. 7. Namely, dark and bright parts appear oppositely when the horizontal scrolling direction is reversed.

Vertical scrolling causes no false color contours because each vertical stripe made of the same kind of subpixels involves a single color. The vertical scrolling, however, causes dark and bright parts, which may be removed by the same processes as for the horizontal scrolling.

Figure 18:
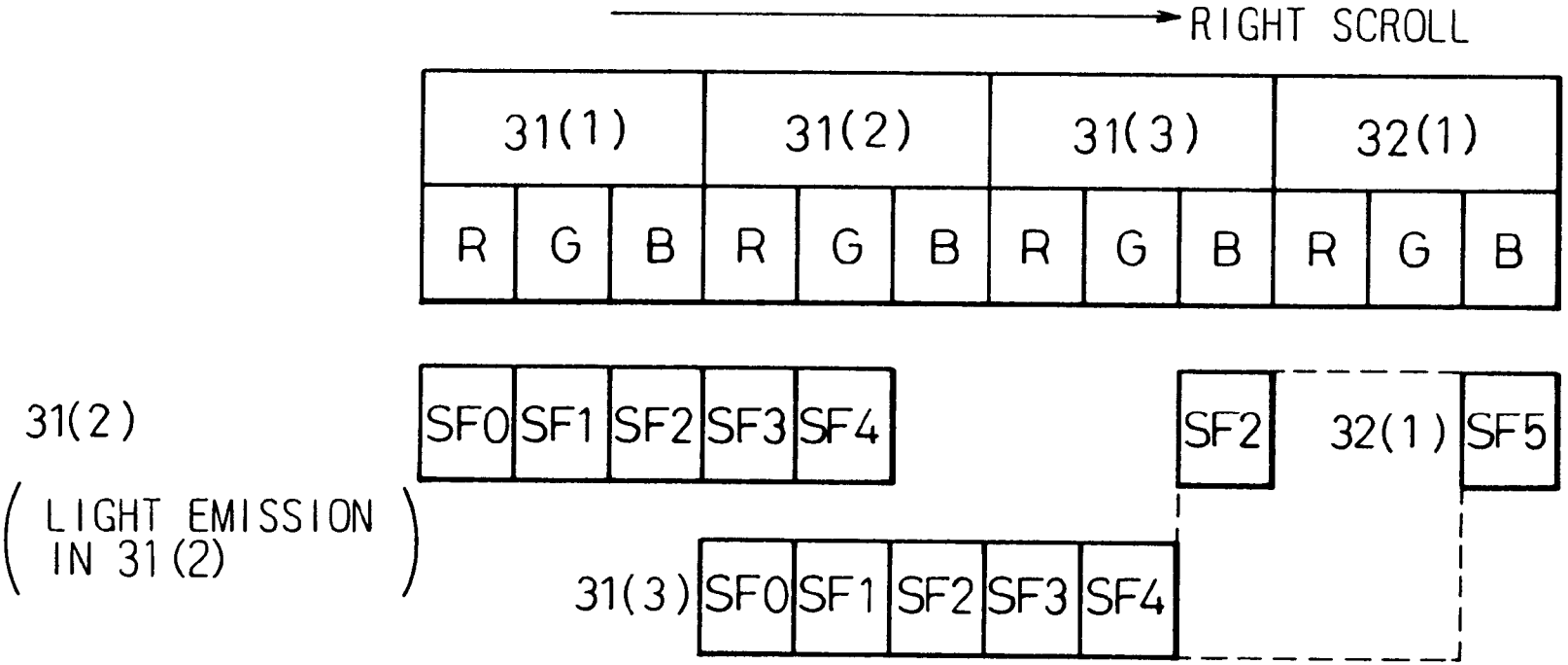
FIG. 18 shows a method of solving the dark part of FIG. 7.

FIG. 18 shows a method of solving the dark part S of FIG. 7 encircled with a dotted line. The subframe SF2 of the pixel 32(1) is additionally enabled (turned ON), to increase the intensity level of the pixel 32(1) from 32 to 36, thereby suppressing the dark part S.

Turning ON the subframe SF2 is effective to suppress the dark part S only when the scroll speed is slow. If the scroll speed is fast, the subframes SF2 and SF3 will be turned ON to suppress the dark part S.

As a scroll speed increases, the number of subframes to be additionally turned ON must be increased.

Figure 19:
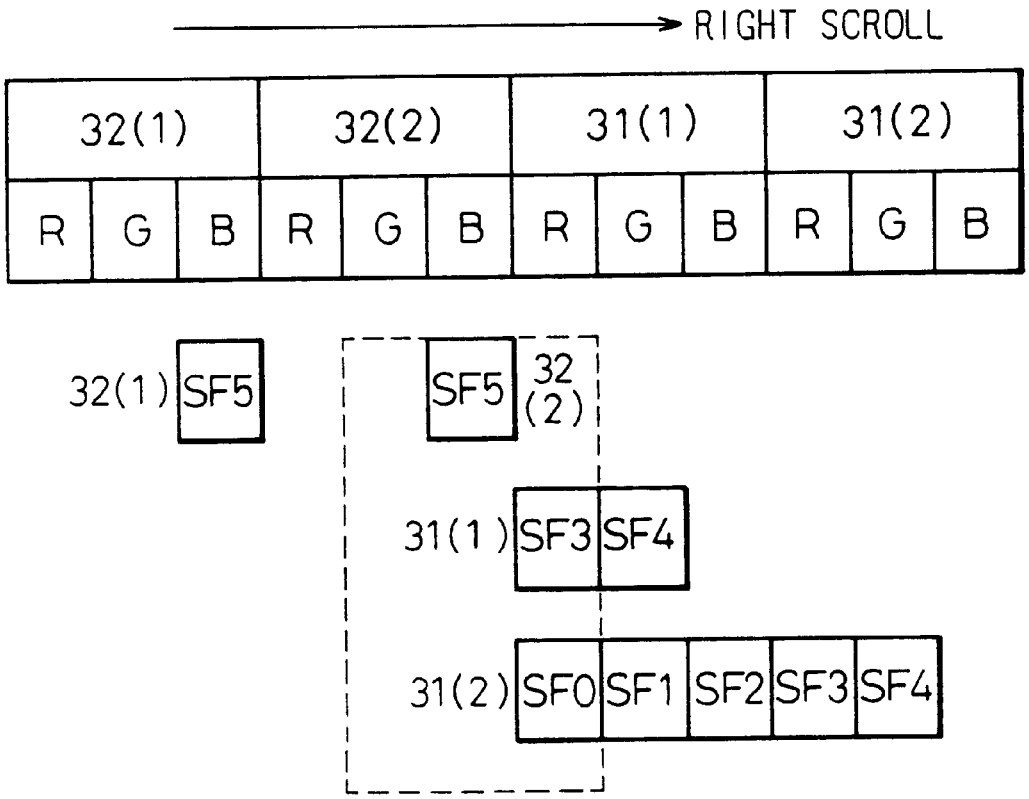
FIG. 19 shows a method of solving the bright part of FIG. 8.

FIG. 19 shows a method of solving the bright part M of FIG. 8 encircled with a dotted line. The subframes SF0 to SF2 of the pixel 31(1) are turned OFF (disabled), to decrease the intensity level of the pixel, thereby suppressing the bright part M.

Turning OFF the subframes SF0 to SF2 is effective to suppress the bright part M only when the scroll speed is slow. If the scroll speed is fast, the subframes SF0 to SF3 will be disabled to suppress the bright part M.

Figure 20:
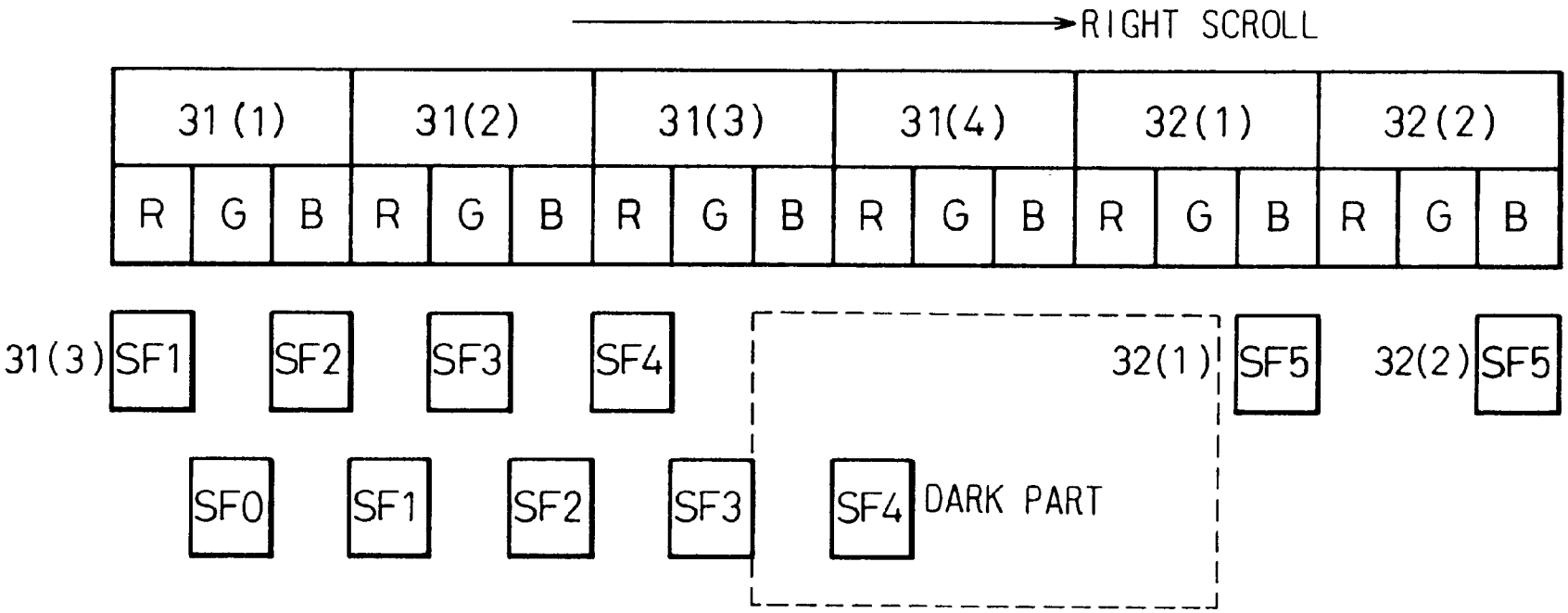
FIG. 20 shows a dark part formed between intensity levels 31 and 32.
Figure 22:
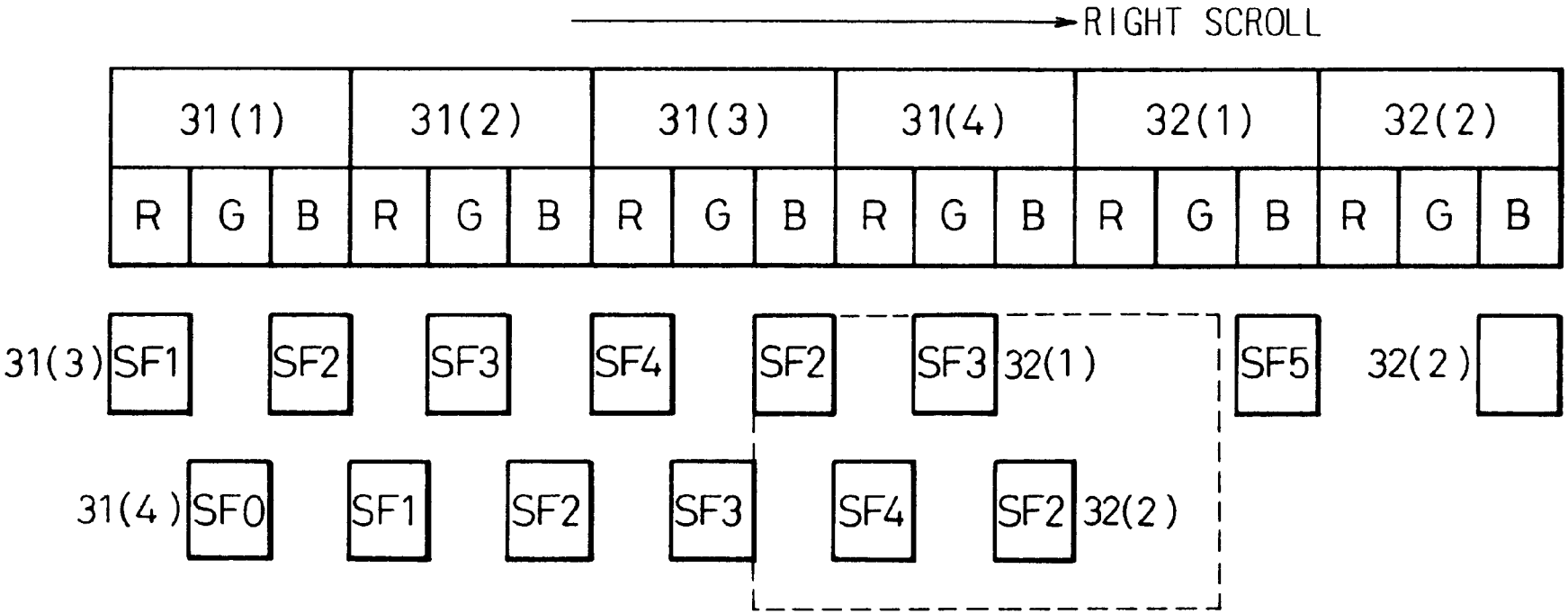
FIG. 22 shows a method of solving the dark part of FIG. 20.

FIG. 20 shows an image consisting of six pixels with four displaying intensity level 31 and two displaying intensity level 32. The image is scrolled to the right at a speed of four pixels per frame. A dark part S of FIG. 20 is wider than that of FIG. 7 scrolling at a speed of two pixels per frame. To suppress the wide dark part S of FIG. 20, not only the subframes SF2 and SF3 of the pixel 32(1) but also the subframe SF2 of the pixel 32(2) must be additionally turned ON as shown in FIG. 22. According to psychological tests, only turning ON the subframes SF2 and SF3 of the pixel 32(1) was insufficient to suppress the dark part S, and additionally turning ON the subframe SF2 of the pixel 32(2) was effective to cancel the same.

Namely, changing the intensity levels of the pixels 31(4), 32(1), and 32(2) to 31, 44, and 36, respectively suppresses the dark part S as well as false color contours.

Figure 21:
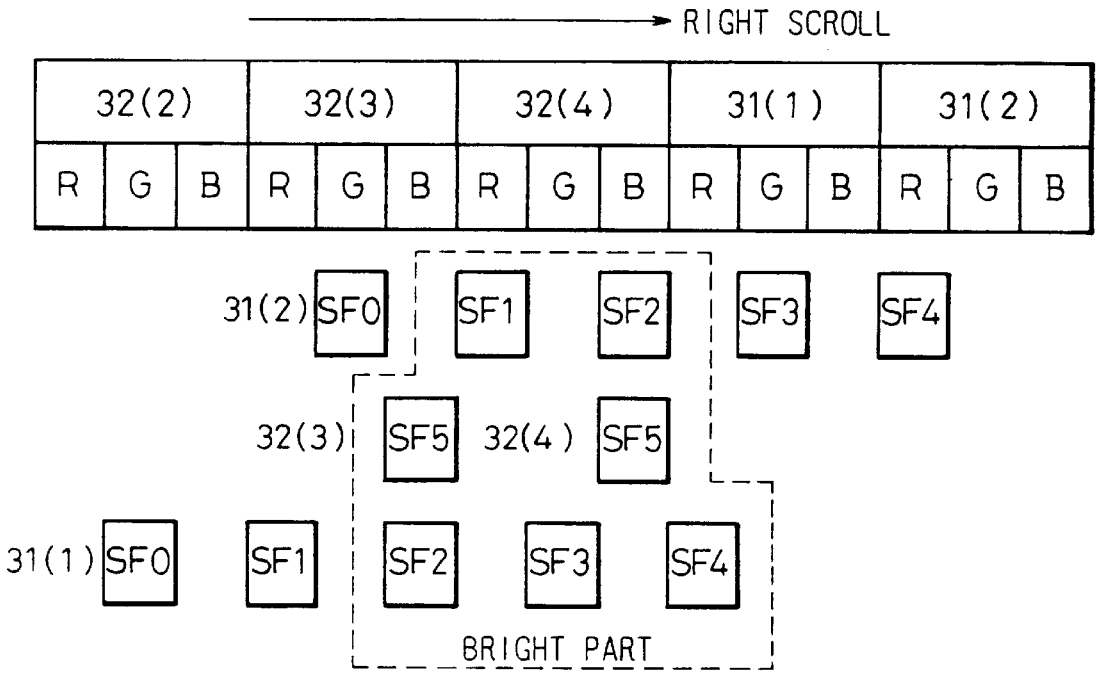
FIG. 21 shows a bright part formed between intensity levels 32 and 31.

FIG. 21 shows an image consisting of five pixels with three displaying intensity level 32 and two displaying intensity level 31. The image is scrolled to the right at a speed of four pixels per frame. A bright part M of FIG. 21 is wider and brighter than that of FIG. 8 scrolling at a speed of two pixels per frame.

Figure 23:
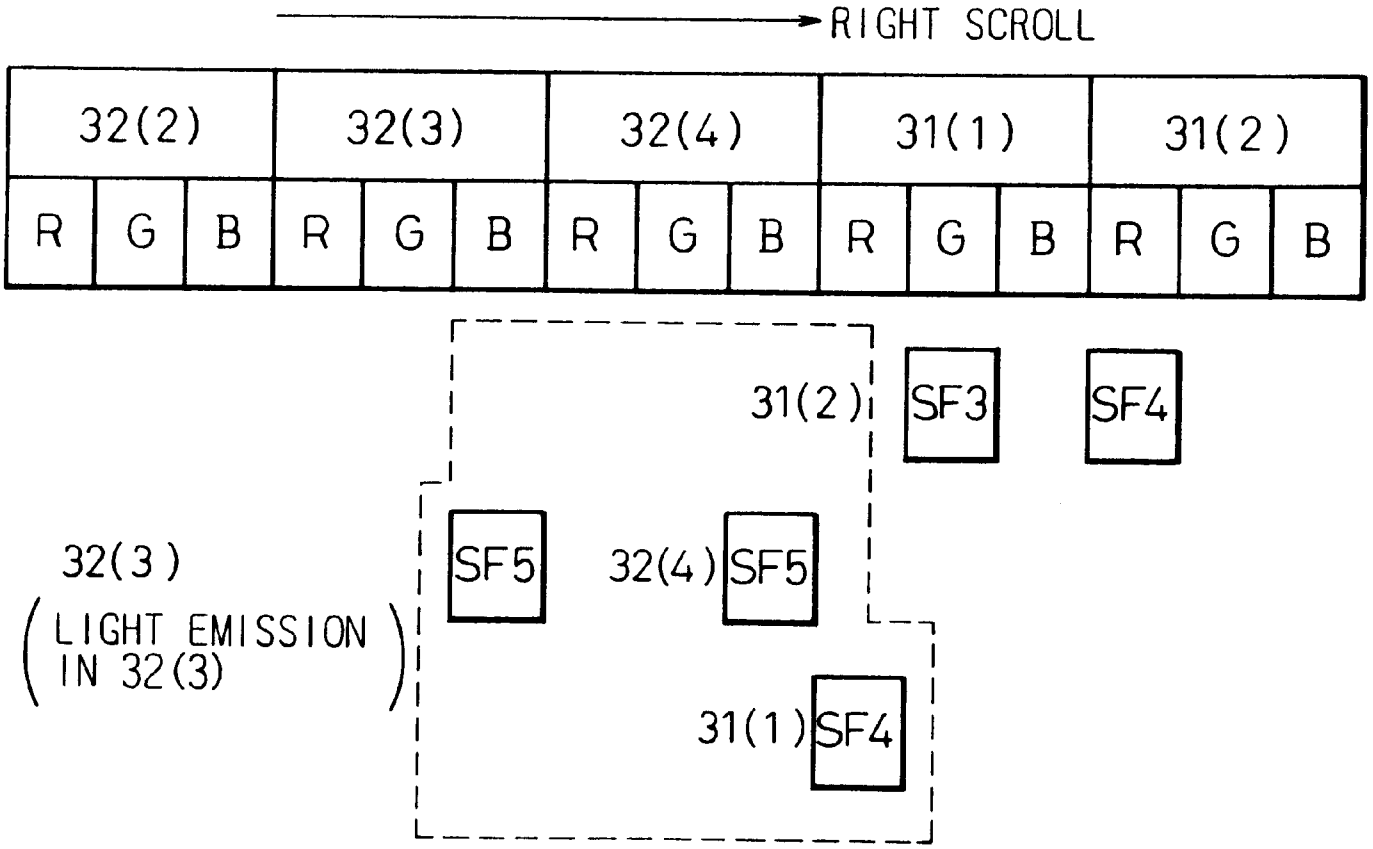
FIG. 23 shows a method of solving the bright part of FIG. 21.

To suppress the bright part M of FIG. 21, not only the subframes SF2 and SF3 of the pixel 31(1) but also the subframes SF1 and SF2 of the pixel 31(2) must be turned OFF (disabled) as shown in FIG. 23.

Namely, the intensity levels of the pixels 31(1) and 31(2) are changed to 19 and 25, respectively, to suppress the bright part M as well as false color contours.

As explained above, the second embodiment of the first aspect of the present invention provides a method of displaying a halftone image on a display unit according to a frame division technique that divides each frame of the halftone image into subframes each having an addressing period and a specific sustain discharge period to provide a specific intensity level. If combinations of subframes to realize different intensity levels between frames of a dynamic halftone image produce a bright part, the second embodiment disables some of the subframes, thereby canceling the bright part, and if they produce a dark part, the second embodiment additionally enables some subframes, thereby canceling the dark part.

The number of subframes to be additionally enabled or disabled is determined according to the scroll speed or intensity levels of the dynamic image. If the scroll speed is high or if the intensity levels are high, the number of subframes to be additionally turned OFF or ON is increased, and in the opposite case, the number is decreased.

To select subframes to be additionally turned OFF or ON, the second embodiment employs a table 11 shown in FIGS. 10 and 24 stored in a memory.

The second embodiment of the first aspect of the present invention may turn OFF or ON subframes in the next frame, if the scroll speed is high.

The first embodiment of the first aspect of the present invention detects a motion vector for each pixel or pixel block (for example, 16×16 pixels) according to display data provided for consecutive frames. The first subframe in a given frame displays display data provided for the frame as it is. A delay time is found between the first subframe and a given one of the other subframes. The delay time is divided by a frame period. The quotient is multiplied by the motion vector, to calculate a display position for the given subframe.

This method solves the problem of the apparent motion that the subframes of a frame of a dynamic image are spatially separated from one another, prevents intensity level disturbance, and improves display quality.

The second embodiment of the first aspect of the present invention cancels a dark or bright part caused between specific intensity levels due to the spatial separation of the subframes of a frame of a dynamic image, by turning ON or OFF subframes between the intensity levels.

Accordingly, the second embodiment prevents false color contours and improves the display quality of matrix display panels such as plasma display panels that display digital signals.

As explained above in detail, the first aspect of the present invention detects a motion vector between consecutive frames according to display data of a dynamic image provided for the frames, finds in each frame a delay time between the first subframe and a given subframe, divides the delay time by a frame period, and multiplies the quotient by the motion vector, to calculate an individual motion vector for the given subframe. The given subframe displays an image according to the individual motion vector. The first aspect of the present invention prevents false color contours and intensity level disturbance, thereby improving the display quality of dynamic images.

False color contours appearing on a dynamic image displayed according to the prior art will be explained with reference to FIGS. 25A to 27C. In the figures, each frame consists of subframes SF0 to SF7 with the subframe SF0 providing the lowest intensity level and the subframe SF7 providing the highest intensity level.

Figure 25A:
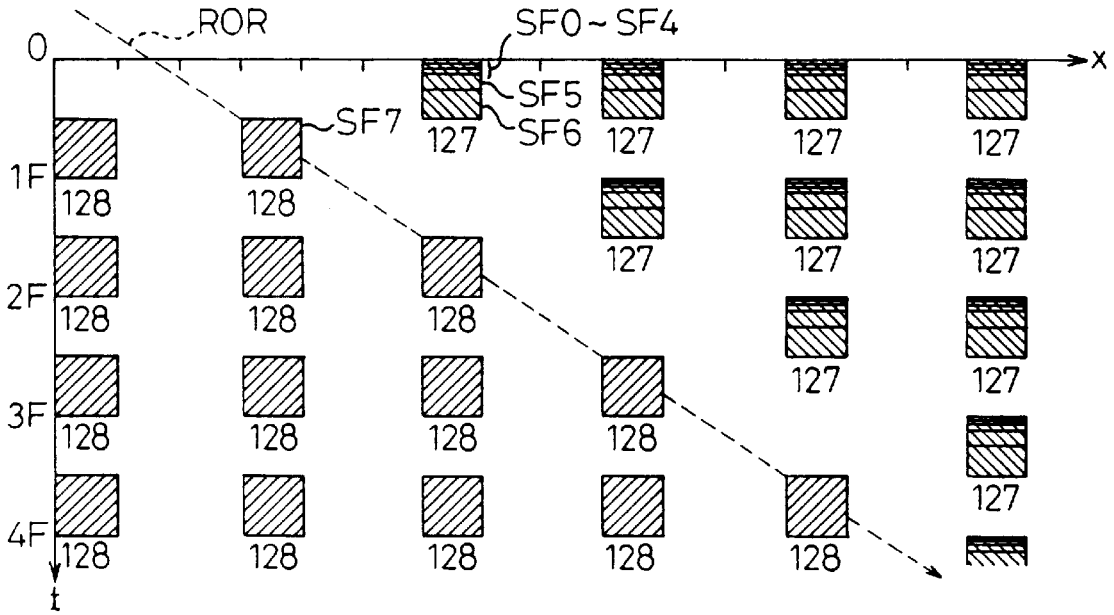
FIGS. 25A and 25B show images scrolled on a screen.
Figure 25B:
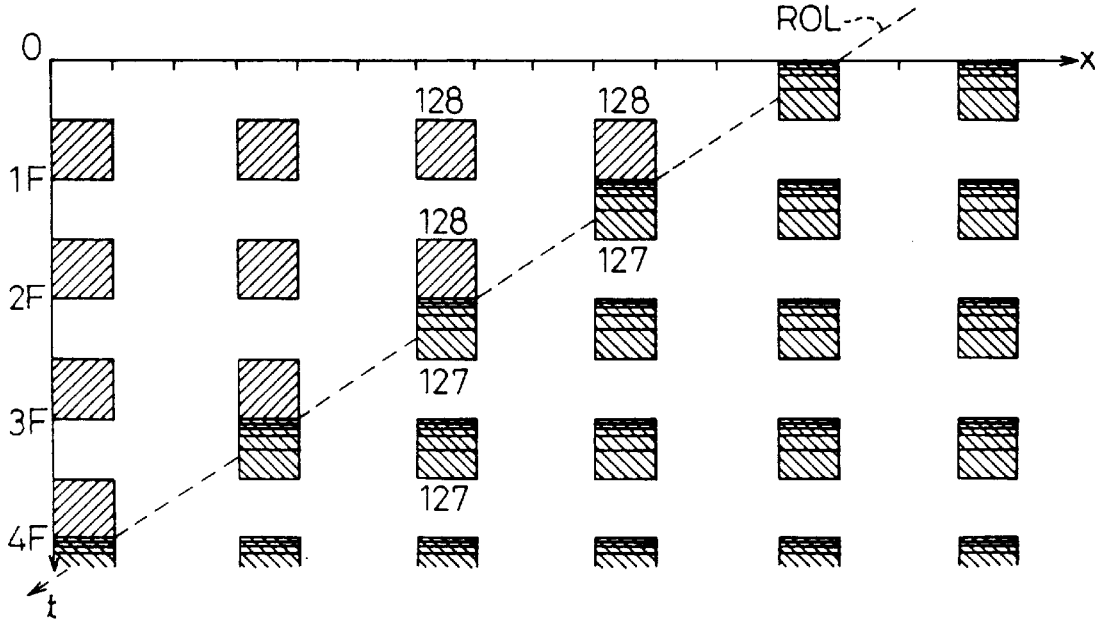

FIG. 25A shows a dynamic image scrolled from the left to the right at a speed of a pixel per frame, and FIG. 25B shows a dynamic image scrolled from the right to the left at a speed of a pixel per frame. In FIGS. 25A and 25B, an ordinate indicates time t, and an abscissa indicates a spatial position x. Reference marks 1F to 4F indicate frames.

Figure 26A:
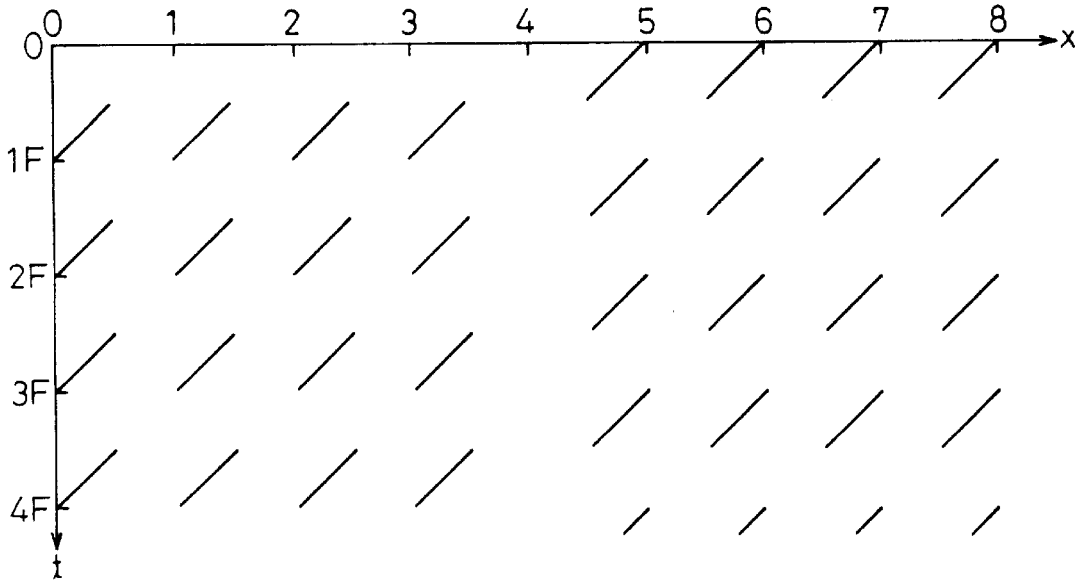
FIGS. 26A to 26C show a problem occurring when images are scrolled from the left to the right on a screen.
Figure 26B:
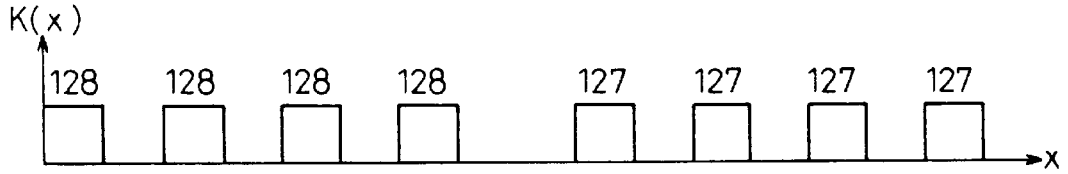
Figure 26C:
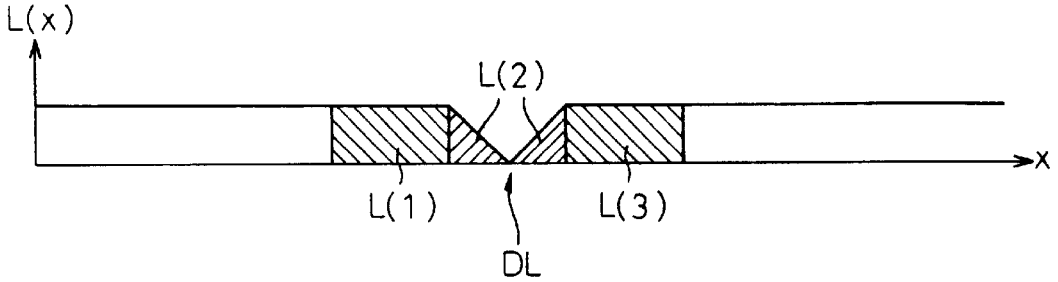
Figure 27A:
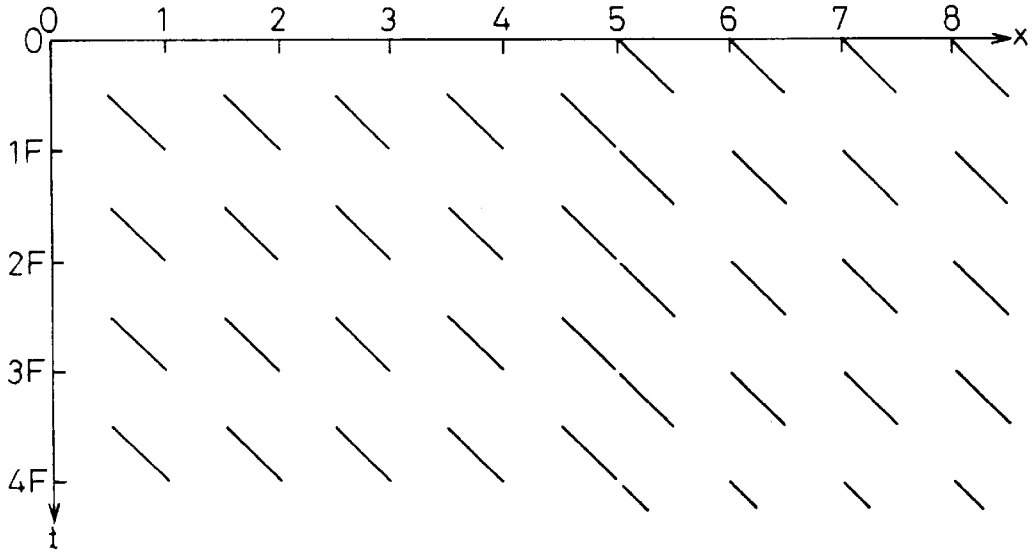
FIGS. 27A to 27C show a problem occurring when images are scrolled from the right to the left on a screen.
Figure 27B:
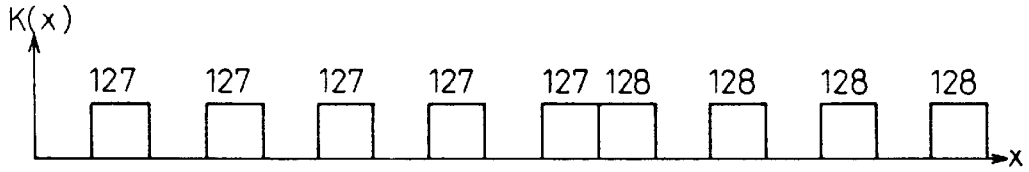
Figure 27C:
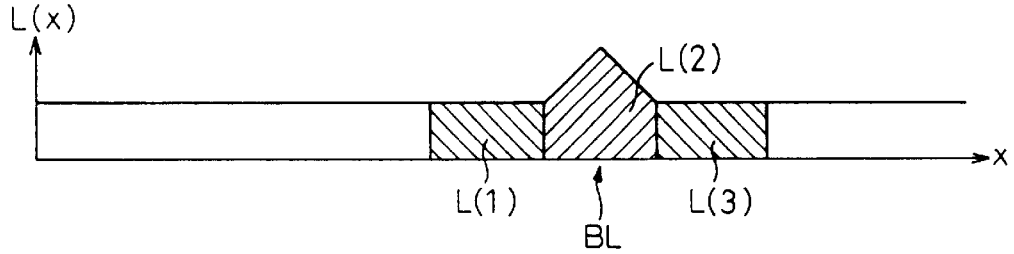

FIGS. 26A to 26C correspond to FIG. 25A and show a problem occurring when an image is scrolled from the left to the right. FIGS. 27A to 27C correspond to FIG. 25B and show a problem occurring when an image is scrolled from the right to the left.

The image of FIG. 25A includes adjacent pixels that display intensity levels 128 and 127 and is scrolled from the left to the right at a speed of a pixel per frame. Due to the apparent motion, a coordinate origin on the retina of the human eye moves along a dotted line ROR. The image of FIG. 25A is seen as shown in FIG. 26A when coordinates on the retina are fixed. In FIG. 25A, the scale of the ordinate indicates the position on the retina, and one unit of the scale corresponds to a distance (or length) determined by moving the image in one frame period.

The image of FIG. 25B includes adjacent pixels that display intensity levels 128 and 127 and is scrolled from the right to the left at a speed of a pixel per frame. A coordinate origin on the retina moves along a dotted line ROL. The image of FIG. 25B is seen as shown in FIG. 27A when coordinates on the retina are fixed. In FIG. 25B, the scale of the ordinate is the same as that shown in FIG. 25A.

Intensity level 127 is realized by enabling (turning ON) the subframes SF0 to SF6 and disabling (turning OFF) the subframe SF7. Intensity level 128 is realized by turning OFF the subframes SF0 to SF6 and turning ON the subframe SF7. For the sake of simplicity, each pixel has no area in FIGS. 26A and 27A.

When the image having intensity levels 128 and 127 is scrolled from the left to the right, an intensity level K(x) at a position x on the retina forms a gap between the pixels that display intensity levels 128 and 127 as shown in FIG. 26B. As a result, a stimulus L(x) on the retina drops to form a valley between intensity levels 128 and 127 as shown in FIG. 26C.

Integrated stimuli for x=2.5 to 3.5, x=3.5 to 4.5, and x=4.5 to 5.5 are L(1), L(2), and L(3), respectively, and are expressed as follows:

$$L(1)\sim L(3)>>L(2)$$

Due to this, a dark line DL appears between the pixels that display intensity levels 128 and 127. This is the intensity level disturbance.

The stimulus L(x) on the retina is expressed as follows:

$$L(x)=\int_{\lambda-0.5}^{\lambda+0.5}K(x)\,dx$$

Where, λ denotes an optional integer. Note that, in the above equation, the integral area is determined from λ−0.5 to λ+0.5, but the integral area can be variously determined. Nevertheless, this integral area is preferably determined to coincide with the area where the intensity level disturbance is caused.

When the image having intensity levels 128 and 127 is scrolled from the right to the left, an intensity level K(x) at a position x on the retina is continuous between the pixels that display intensity levels 128 and 127 as shown in FIG. 27B. As a result, stimulus L(x) on the retina reaches a peak between intensity levels 128 and 127 as shown in FIG. 27C.

Integrated stimuli for x=2.5 to 3.5, x=3.5 to 4.5, and x=4.5 to 5.5 are L(1), L(2), and L(3), respectively, and are expressed as follows:

$$L(1)\sim L(3)<<L(2)$$

Due to this, a bright line BL appears between the pixels that display intensity levels 128 and 127.

When an image consisting of green subpixels displaying intensity levels 128 and 127, respectively, and a red subpixel displaying intensity level 64 is moved from the right to the left, a dark line appears between the green subpixels that display intensity levels 128 and 127. At this time, the red subpixel keeps intensity level 64 because it has no intensity level boundary. The human eye combines the subpixels and sees a red color in the green dark line, to thereby cause a false color contour.

This phenomenon frequently occurs in a flesh-colored part where intensity levels smoothly change. For example, false color contours of red and green appear along the flesh-colored cheek of an image of a person displayed, when the person displayed looks back.

Figure 28A:
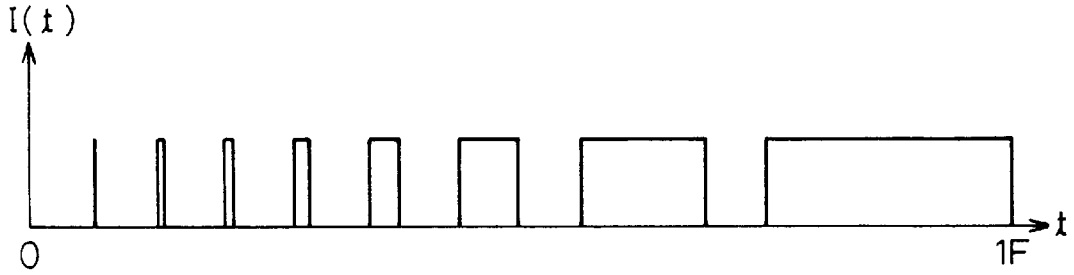
FIGS. 28A and 28B show a method of modulating pulse width and number in a frame according to the present invention.
Figure 28B:
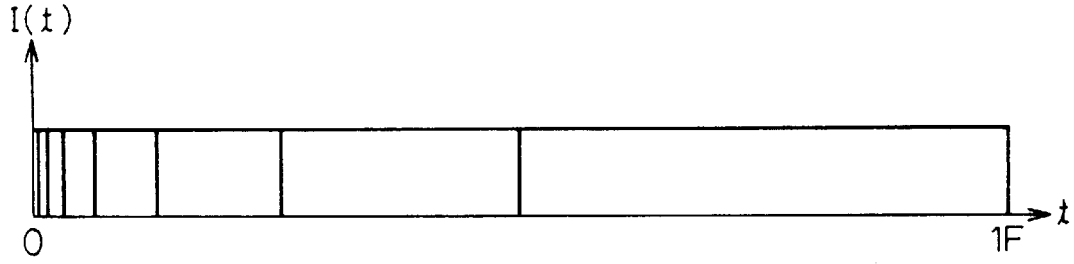

FIGS. 28A and 28B show image displaying techniques to which the present invention is applied. The technique of FIG. 28A corresponds to that of FIG. 1.

The technique of FIG. 28A divides each frame into subframes each having separate addressing and sustain discharge (light emission) periods. The technique of FIG. 28B distributes an addressing period into sustain discharge periods.

Figure 29A:
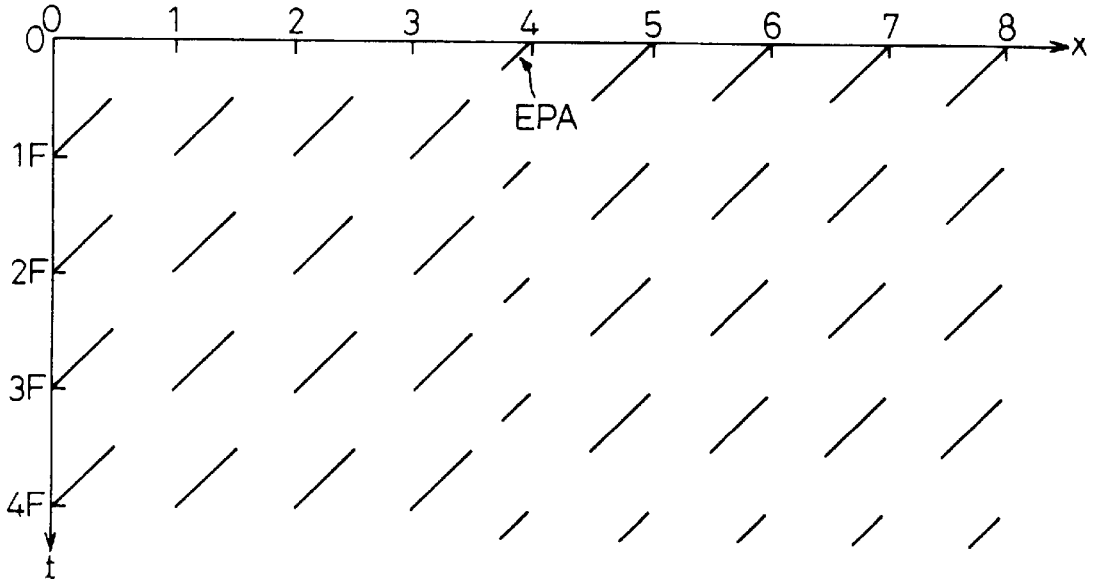
FIGS. 29A to 29C show a principle of displaying halftone images according to the present invention.
Figure 29B:
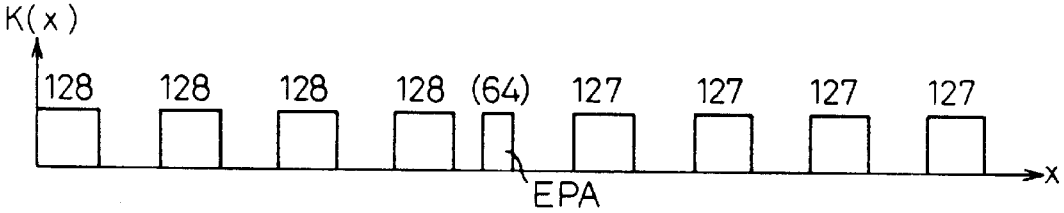
Figure 29C:
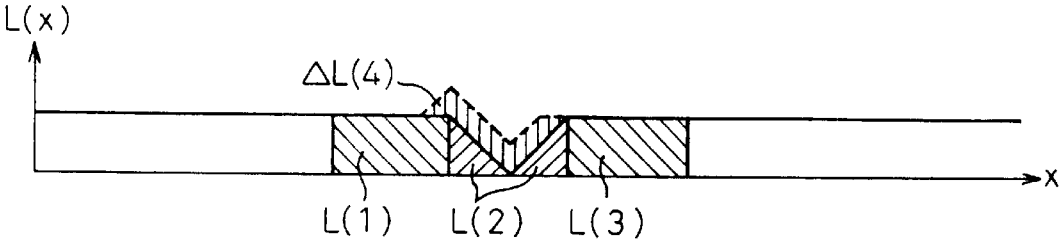

FIGS. 29A to 29C show a principle of displaying halftone images according to the second aspect of the present invention. These drawings correspond to FIGS. 26A to 26C, respectively.

When L(1)~L(3)>>L(2) to form a dark line DL between the pixels that display intensity levels 128 and 127, an equivalent pulse (subframe, or light emission block) is enabled to apply a stimulus ΔL(4) as follows:

$$\text{if } L(1)>L(3) \text{ then } L(1)\geqq L(2)+\Delta L(4)\geqq L(3)$$

$$\text{if } L(1)<L(3) \text{ then } L(1)\leqq L(2)+\Delta L(4)\leqq L(3)$$

In FIGS. 29A and 29B, an equivalent pulse EPA is enabled with respect to a dark line caused between intensity levels 128 and 127 that are scrolled from the left to the right. As a result, the stimulus L(2) at an interface between intensity levels 128 and 127 is increased by ΔL(4) as shown in FIG. 29C, thereby preventing smears or false color contours.

The first principle of the second aspect of the present invention provides a method of displaying a halftone image on a display unit with each frame of the halftone image having subframes that have individual intensity levels and are combined to provide a required intensity level. The method includes the step of enabling an intensity level adjusting subframe in the subframes of one of consecutive frames that involve a change in intensity level between them, to substantially satisfy an expression of $S1\leqq S2+\Delta S\leqq S3$, or $S1\geqq S2+\Delta S\geqq S3$, where S1 is an average of B(t), which is a temporal change in a stimulus on the human eye, before the change of intensity level, S2 is an average of B(t) during the change of intensity level, S3 is an average of B(t) after the change of intensity level, and ΔS is an average of a temporal change in a stimulus on the human eye due to the intensity level adjusting subframe.

ΔS is determined to substantially satisfy $0\leqq\Delta S\leqq 2(S1-S2)$, or $0\leqq\Delta S\leqq 2(S3-S2)$.

Figure 30A:
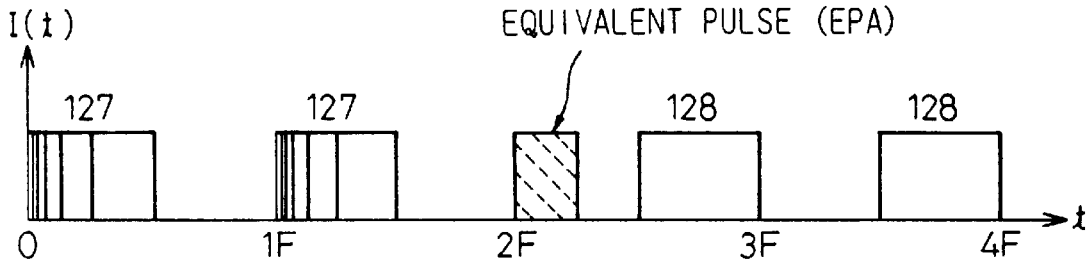
FIGS. 30A and 30B show an effect of inserting an equivalent pulse.
Figure 30B:
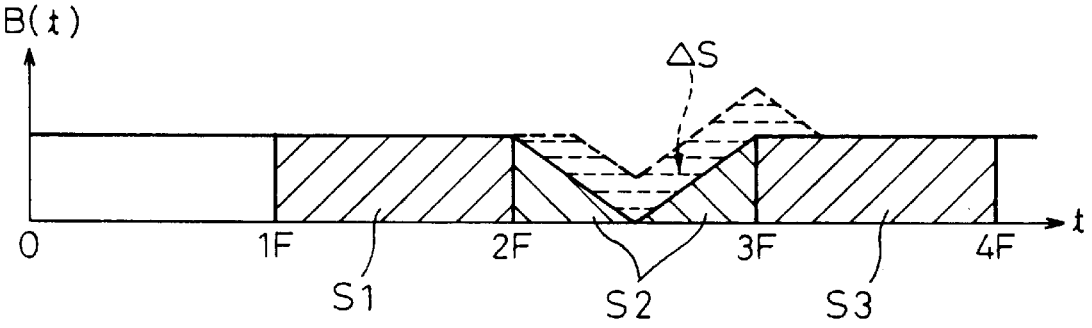

FIGS. 30A and 30B show an effect of inserting an equivalent pulse to turn ON a subframe. In FIG. 30A, an ordinate represents light emission intensity I(t), and an abscissa represents time t. In FIG. 30B, an ordinate represents stimulus B(t) on the human eye, and an abscissa represents time t. Reference marks 1F to 4F represent frames.

When the equivalent pulse EPA of FIG. 30A is enabled, ΔS is added to an average S2 of the stimulus B(t) between intensity levels 127 and 128, to increase the stimulus B(t) up to S2+ΔS. It is ideal to make ΔS to be $S1\leqq S2+\Delta S\leqq S3$. However, the effect of preventing false color contours is provided even if ΔS slightly fluctuates.

Figure 31A:
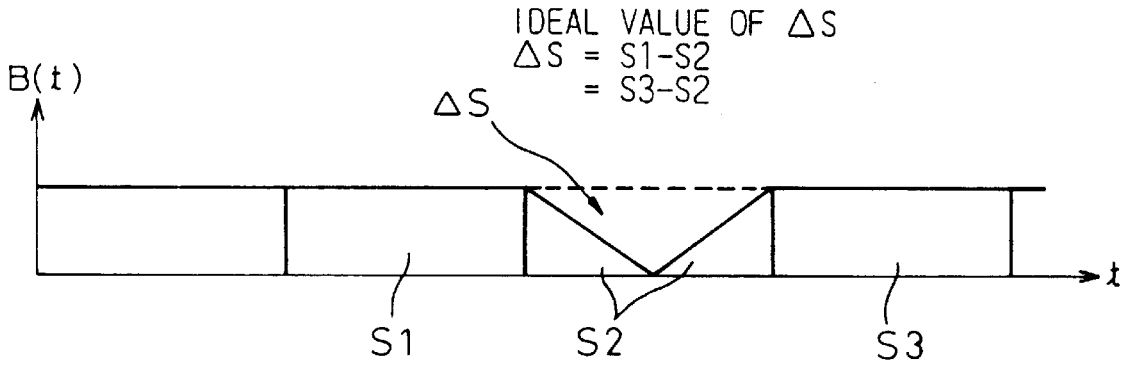
FIGS. 31A and 31B show the conditions of ΔS produced by an equivalent pulse.
Figure 31B:
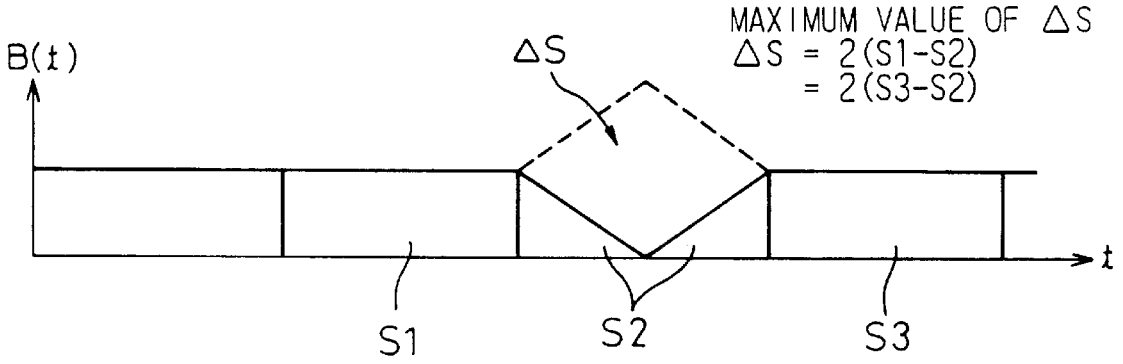

FIGS. 31A and 31B show the conditions of ΔS produced by an equivalent pulse, in which FIG. 31A shows an ideal form of ΔS and FIG. 31B shows a maximum value of ΔS.

As indicated with a dotted line in FIG. 31A, it is ideal that ΔS=S1−S2, or ΔS=S3−S2. It is, however, difficult to secure the ideal value, and therefore, ΔS is set in a given range in practice.

As indicated with a dotted line in FIG. 31B, the maximum value of ΔS is 2(S1−S2) or 2(S3−S2). If ΔS exceeds the maximum value, false color contours worsen. It is understood that ΔS provides some effect if it is greater than zero. Accordingly, ΔS may be determined as $0\leqq\Delta S\leqq 2(S1-S2)$, or $0\leqq\Delta S\leqq 2(S3-S2)$.

FIGS. 32A to 32F show the area of each pixel based on FIGS. 29A to 29C. For the sake of simplicity, FIGS. 26A to 26C and 29A to 29C show each pixel without area. In practice, each pixel has a predetermined area, and therefore, the images of FIGS. 26A to 26C and 29A to 29C will be those shown in FIGS. 32A to 32F in practice. In FIGS. 32A to 32F, a scroll speed is determined one pixel per frame.

Figure 32A:
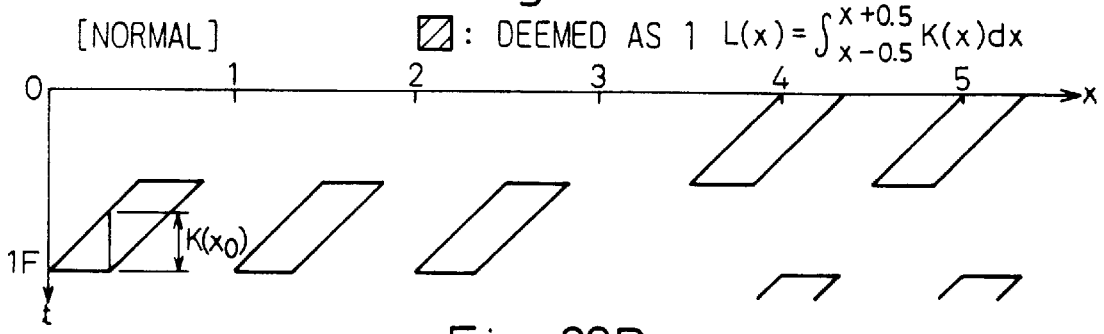
FIGS. 32A to 32F show the area of each pixel according to the principle of FIGS. 29A to 29C.
Figure 32B:
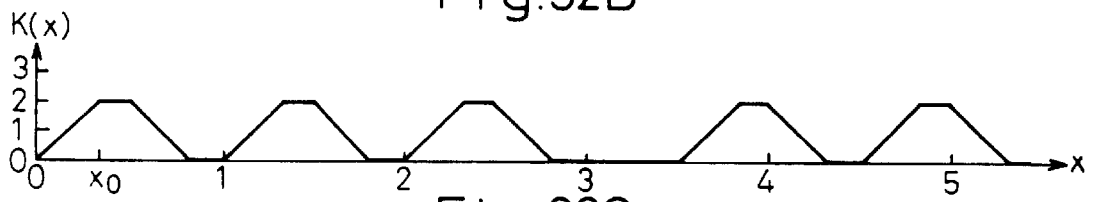
Figure 32C:
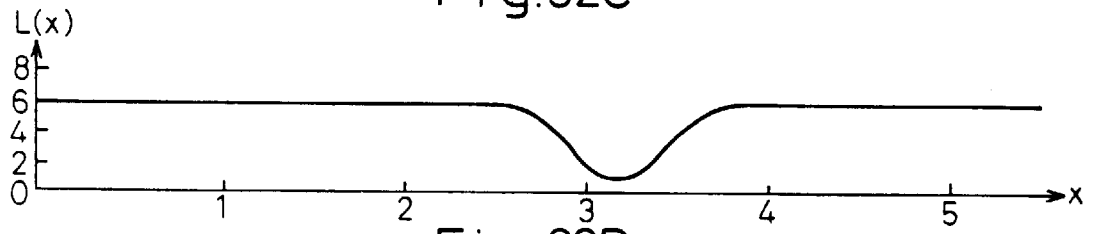
Figure 32D:
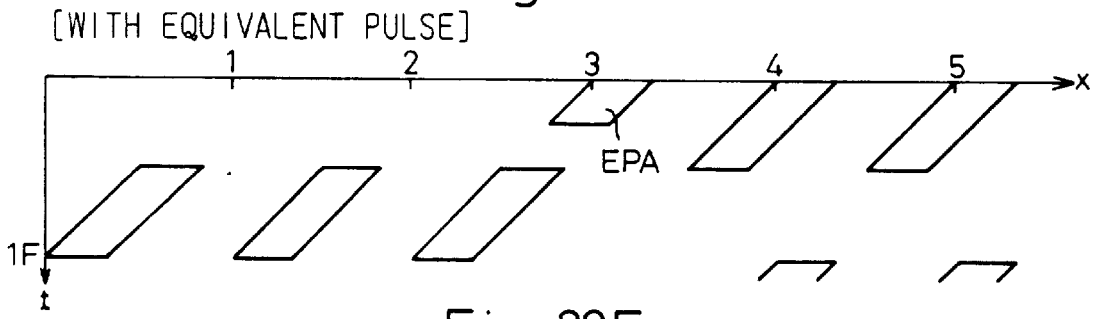
Figure 32E:
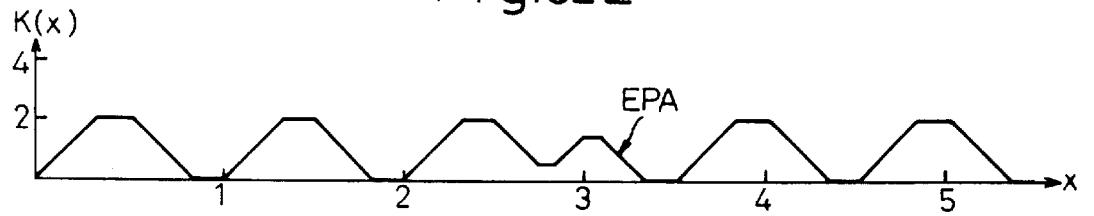
Figure 32F:
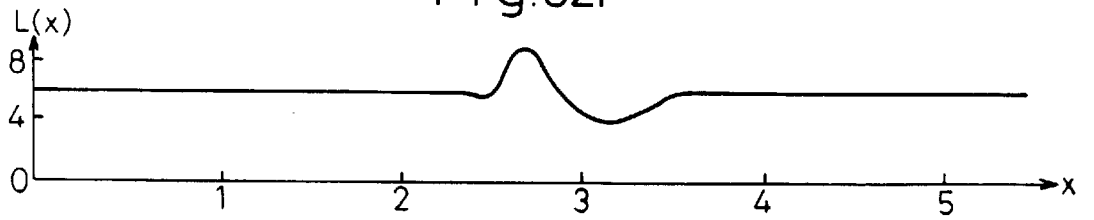

FIG. 32A corresponds to a frame 1F of FIG. 26A, FIG. 32B to FIG. 26B, FIG. 32C to FIG. 26C, FIG. 32D to a frame 1F of FIG. 29A, FIG. 32E to FIG. 29B, and FIG. 32F to FIG. 29C.

Figure 33A:
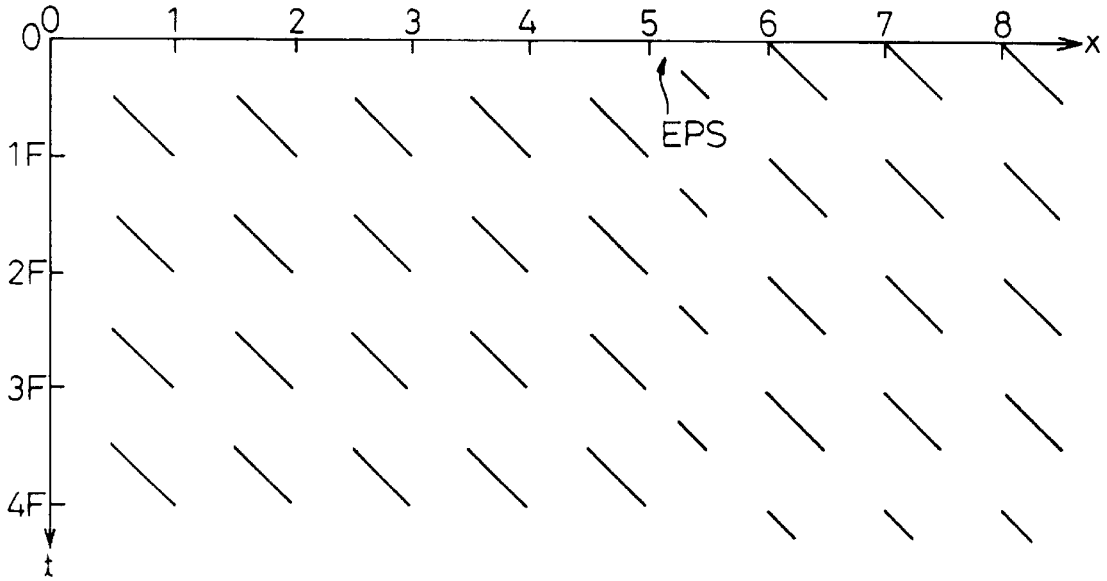
FIGS. 33A to 33C show another principle of displaying halftone images according to the present invention.
Figure 33B:
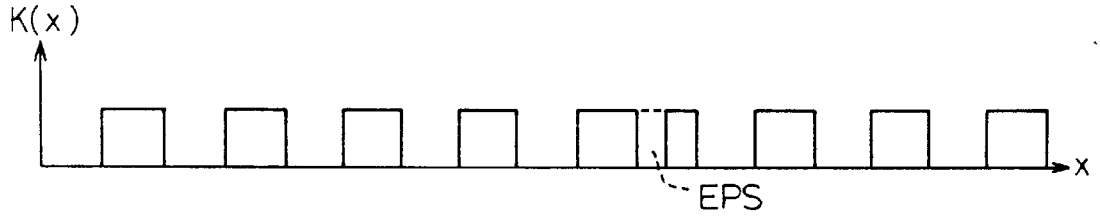
Figure 33C:
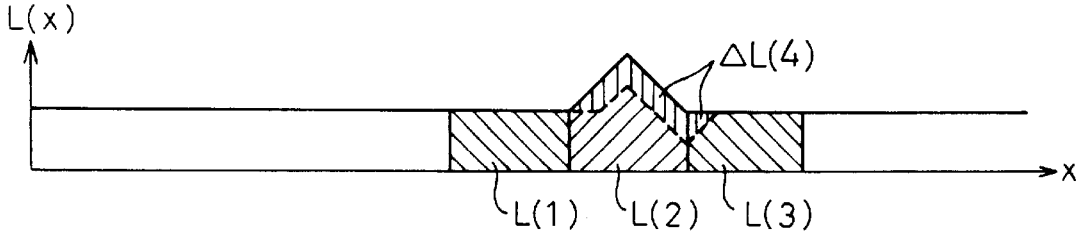

FIGS. 33A to 33C show another principle of displaying halftone images according to the second aspect of the present invention and correspond to FIGS. 27A to 27C.

When L(1)~L(3)<<L(2) to form a bright line BL between the pixels that display intensity levels 128 and 127, an equivalent pulse (subframe, or light emission block) is disabled (turned OFF) to remove a stimulus ΔL(4) as follows:

$$\text{if } L(1)>L(3) \text{ then } L(1)\geqq L(2)-\Delta L(4)\geqq L(3)$$

$$\text{if } L(1)<L(3) \text{ then } L(1)\leqq L(2)-\Delta L(4)\leqq L(3)$$

In FIGS. 33A and 33B, an equivalent pulse EPA is disabled with respect to a bright line caused between intensity levels 128 and 127 that are scrolled from the right to the left. As a result, the stimulus L(2) at an interface between intensity levels 128 and 127 is decreased by ΔL(4) as shown in FIG. 33C, thereby preventing false color contours.

As explained above, the second principle of the second aspect of the present invention provides a method of displaying a halftone image on a display unit with each frame of the halftone image having subframes that have individual intensity levels and are combined to provide a required intensity level. The method includes the step of disabling an intensity level adjusting subframe in the subframes of one of consecutive frames that display different intensity levels, to substantially satisfy an expression of $S1\leqq S2-\Delta S\leqq S3$ or $S1\geqq S2-\Delta S\geqq S3$, where S1 is an average of B(t), which is a temporal change in a stimulus on the human eye, before the change of intensity level, S2 is an average of B(t) during the change of intensity level, S3 is an average of B(t) after the change of intensity level, and ΔS is an average of a temporal change in a stimulus on the human eye due to the intensity level adjusting subframe.

ΔS is determined to substantially satisfy $0\leqq\Delta S\leqq 2(S2-S1)$, or $0\leqq\Delta S\leqq 2(S2-S3)$.

Figure 34A:
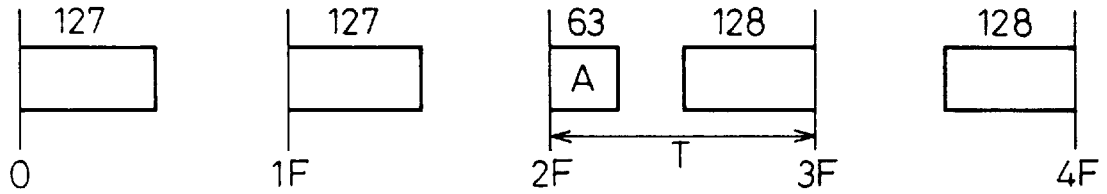
FIGS. 34A and 34B show an arrangement of bits that represent subframes according to the present invention.
Figure 34B:
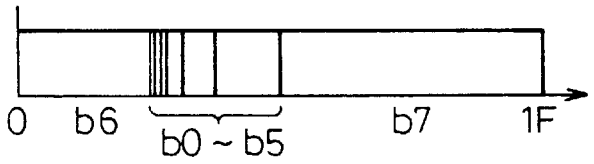

FIGS. 34A and 34B show an arrangement of bits corresponding to subframes according to the second aspect of the present invention.

In FIG. 34A, intensity level 127 realized by enabling bits b0 to b6 for the subframes SF0 to SF6 (FIG. 1) is changed to intensity level 128 realized by enabling a bit b7 for the subframe SF7. A dark part appearing at this time is canceled by enabling equivalent pulses to provide intensity level 63 at a position A. The same is carried out when intensity level is changed from 127 to 130 in a period T. Then, it is difficult to precisely express the intensity level change.

When the subframes of each frame are arranged in order of SF0 to SF7 as shown in FIG. 1, the same intensity level 63 corresponding to the subframes SF0 to SF6 is enabled when intensity level changes from 127 to 128 and from 127 to 130. As a result, it is difficult to finely display the changing intensity levels.

To solve this problem, the subframes (light emission blocks) are arranged in order of SF6, SF0, SF1, SF2, SF3, SF4, SF5, and SF7. Namely, the subframe SF6 corresponding to a bit b6 for providing intensity level 64 is set at the top of each frame. The subframe SF6 is enabled when the intensity level changes from 127 to 130, and the subframes SF0 to SF5 are used to display fine intensity level changes.

Figure 35A:
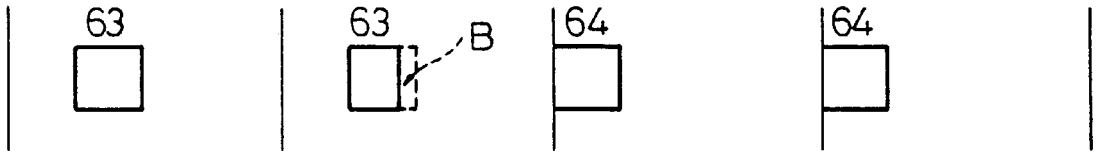
FIGS. 35A to 35C show another arrangement of bits that represent subframes according to the present invention.
Figure 35B:
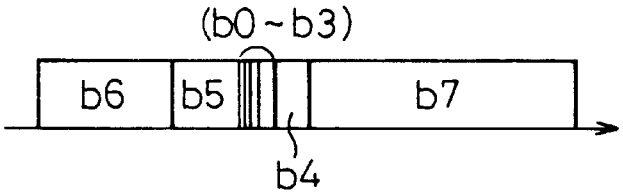
Figure 35C:
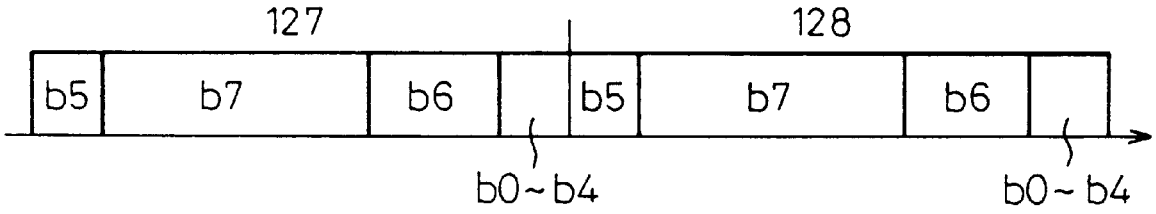

FIGS. 35A to 35C show another arrangement of bits that represent subframes according to the present invention.

According to the arrangements of FIGS. 1 and 34B, it is impossible to disable an equivalent pulse at position B of FIG. 35A when intensity level changes from 63 (subframes SF0 to SF5) to 64 (subframe SF6). Accordingly, the bit arrangement must be changed.

As shown in FIGS. 35B and 35C, the subframes are arranged in order of SF6, SF5, SF0, SF1, SF2, SF3, SF4, and SF7. In this case, intensity level 64 instead of 63 is used to adjust intensity level. As a result, an equivalent pulse for intensity level 16 may be disabled at the position B of FIG. 35A when the intensity level changes from 63 to 64.

FIGS. 36A to 38B show simulation results carried out at three different scroll speeds according to the second aspect of the present invention. In each simulation, the width of a light emission band is equal to 40 pixels containing 120 subpixels with 20 left pixels displaying intensity level 127 and 20 right pixels displaying intensity level 128. Light emission duty is 100%. Each pixel consists of red (R), green (G), and blue (B) subpixels.

Figure 36A:
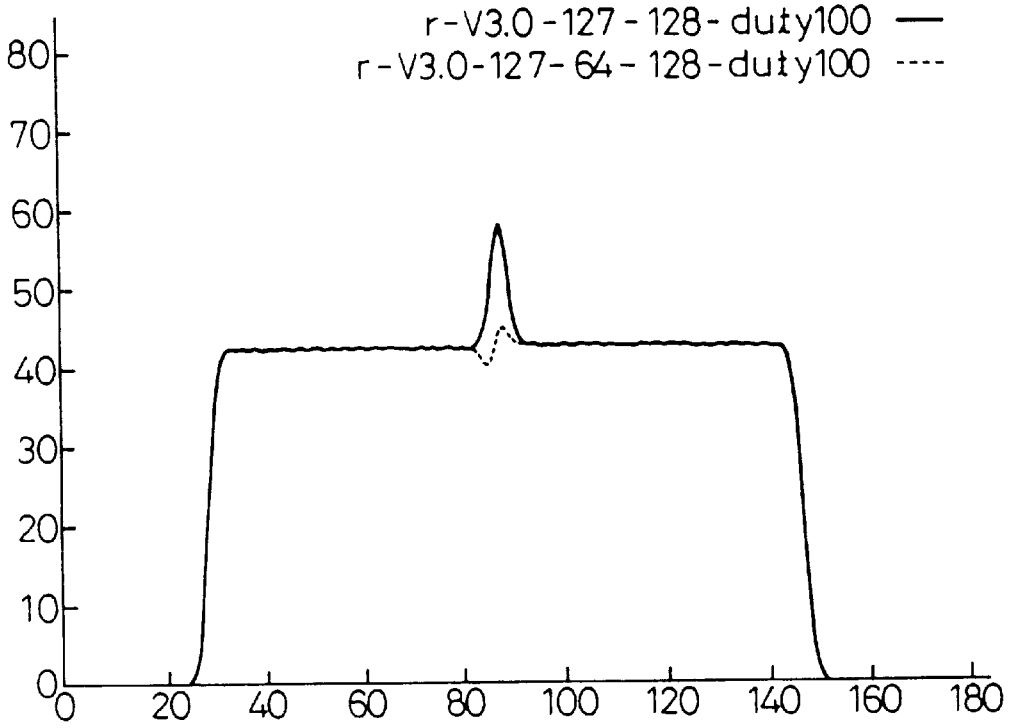
FIGS. 36A and 36B show simulations made at a first image moving speed with and without the halftone displaying method of the present invention.
Figure 36B:
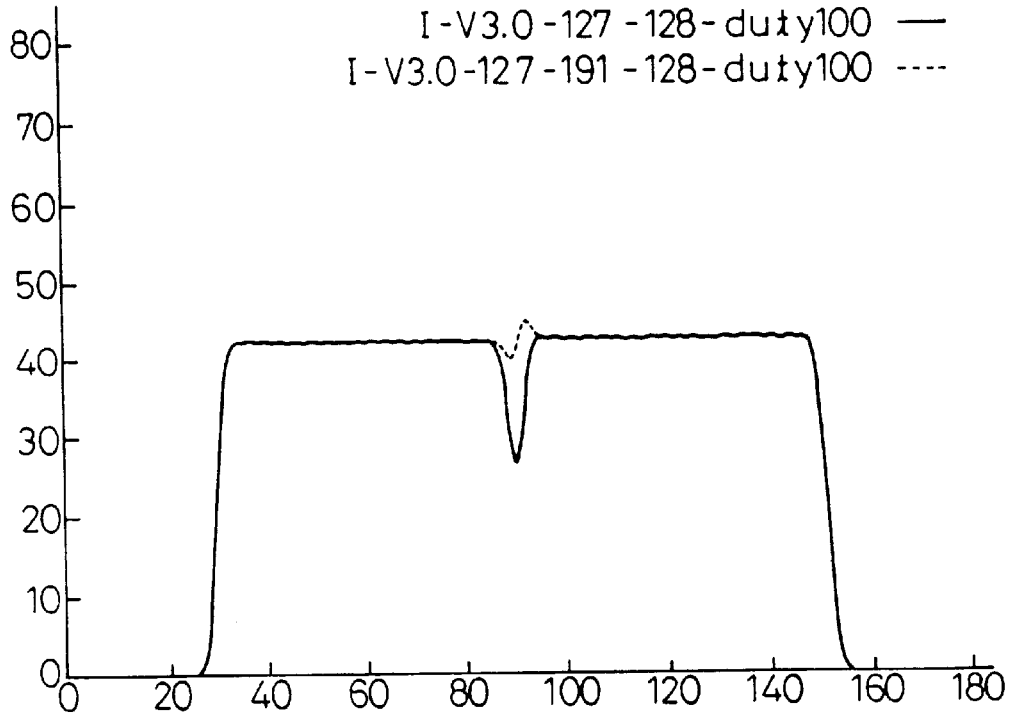
Figure 37A:
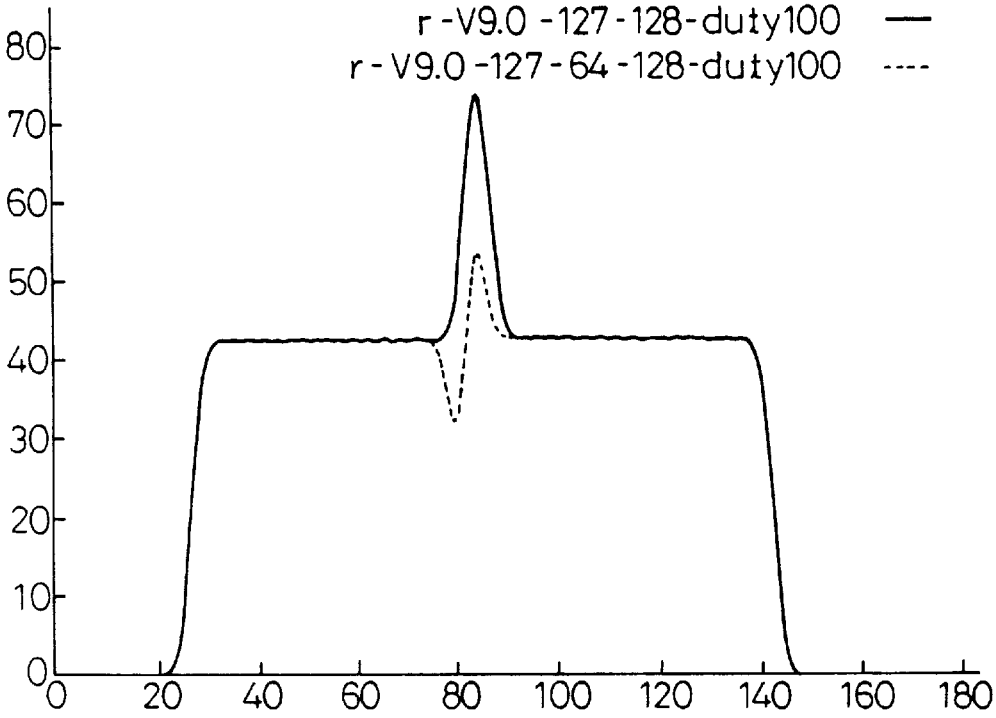
FIGS. 37A and 37B show simulations made at a second image moving speed with and without the halftone displaying method of the present invention.
Figure 37B:
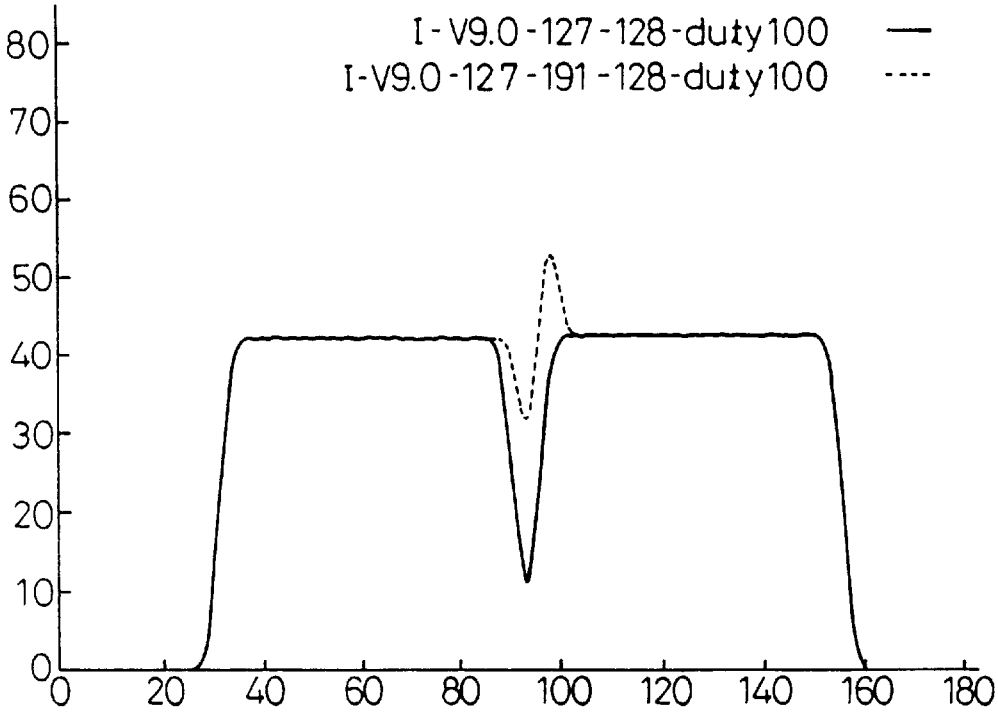
Figure 38A:
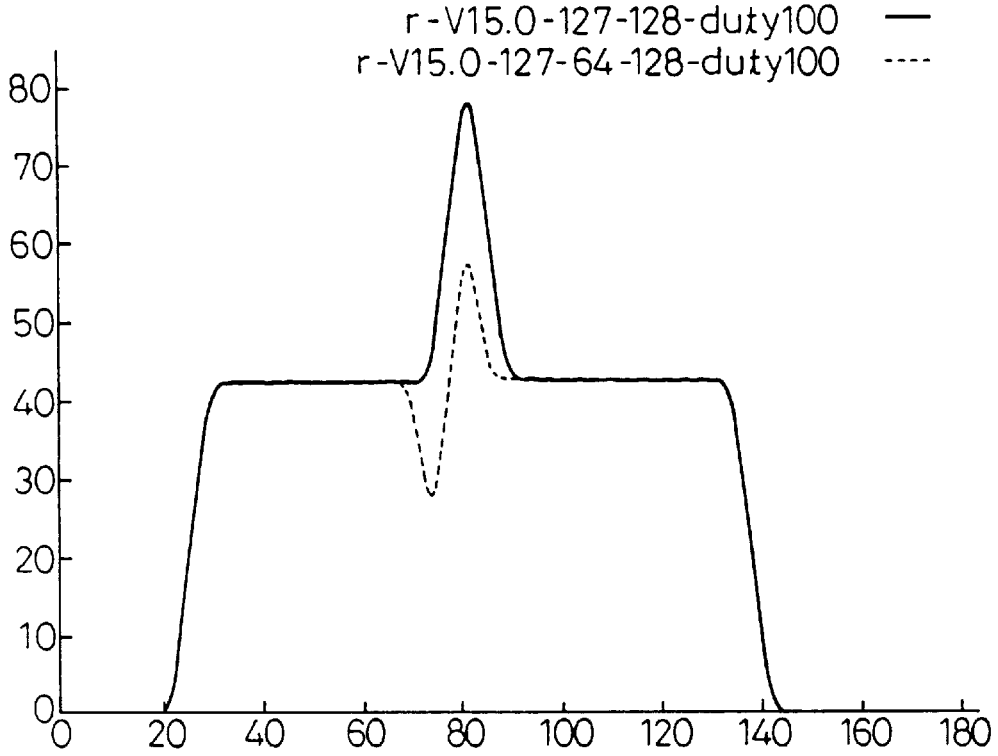
FIGS. 38A and 38B show simulations made at a third image moving speed with and without the halftone displaying method of the present invention.
Figure 38B:
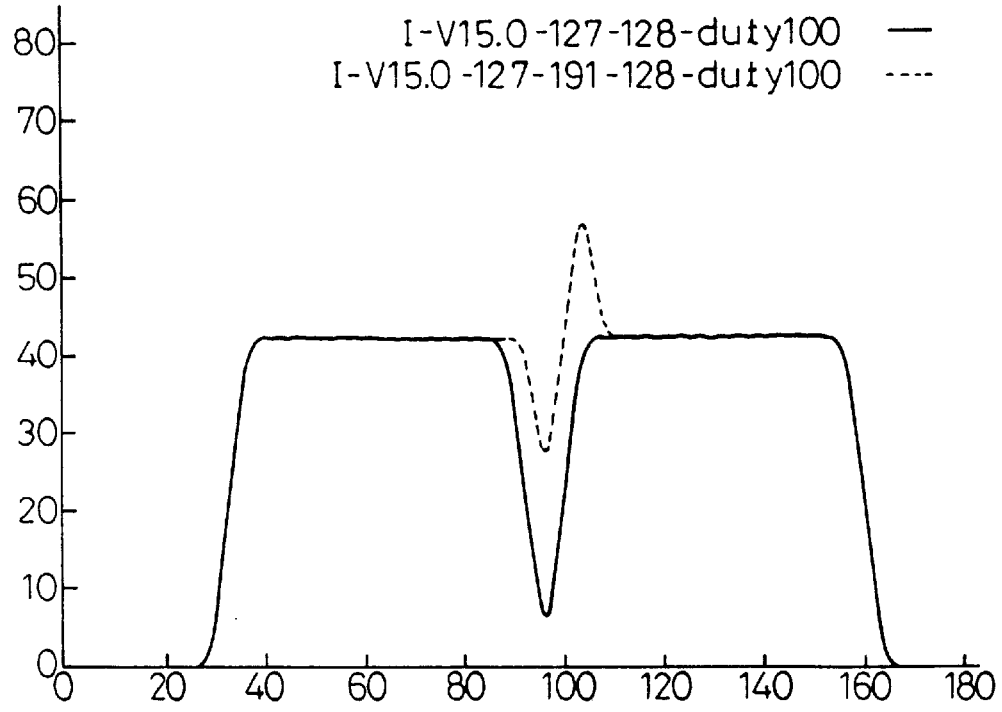

The scroll speed of the simulation of FIGS. 36A and 36B is a pixel (three subpixels) per frame, that of FIGS. 37A and 37B is three pixel (nine subpixels) per frame, and that of FIGS. 38A and 38B is five pixels (15 subpixels) per frame. In each drawing, an ordinate represents intensity level, and an abscissa represents subpixels.

In FIGS. 36A, 37A, and 38A, adjacent intensity levels 127 and 128 are scrolled from the left to the right, and an equivalent pulse EPS corresponding to intensity level 64 (subframe SF6, i.e., bit b6) is disabled. Intensity levels 127 and 128 of these drawings are opposite to those of FIGS. 25A and 25B.

In FIGS. 36B, 37B, and 38B, adjacent intensity levels 127 and 128 are scrolled from the right to the left, and an equivalent pulse EPA corresponding to intensity level 64 (subframe SF6, i.e., bit b6) is enabled. Intensity levels 127 and 128 of these drawings are opposite to those of FIGS. 25A and 25B.

In FIGS. 36A to 38B, a continuous line indicates a waveform of intensity levels the human eye senses before enabling/disabling the equivalent pulses EPA and EPS, and a dotted line indicates a waveform after the application of the equivalent pulses according to the second aspect of the present invention.

The equivalent pulses EPA and EPS are effective to relax a peak or valley, to suppress a bright or dark line. In FIGS. 36A, 37A, and 38A, a bright line appearing between intensity levels 127 and 128 is canceled by disabling the subframe SF6 (bit b6) that provides intensity level 64, thereby dropping the peak of the waveform and preventing false color contours. In FIGS. 36B, 37B, and 38B, a dark line appearing between intensity levels 127 and 128 is canceled by enabling the subframe SF6 (bit b6), thereby increasing the valley of the waveform and preventing false color contours.

FIGS. 39A to 39D show the effect of the second aspect of the present invention with an image being moved horizontally with no false pixels being seen. False pixels are seen when dynamic images are displayed on a matrix display unit. For example, a red subpixel is seen at the positions of green and blue subpixels.

Figures 39A, 39B, 39C, 39D:
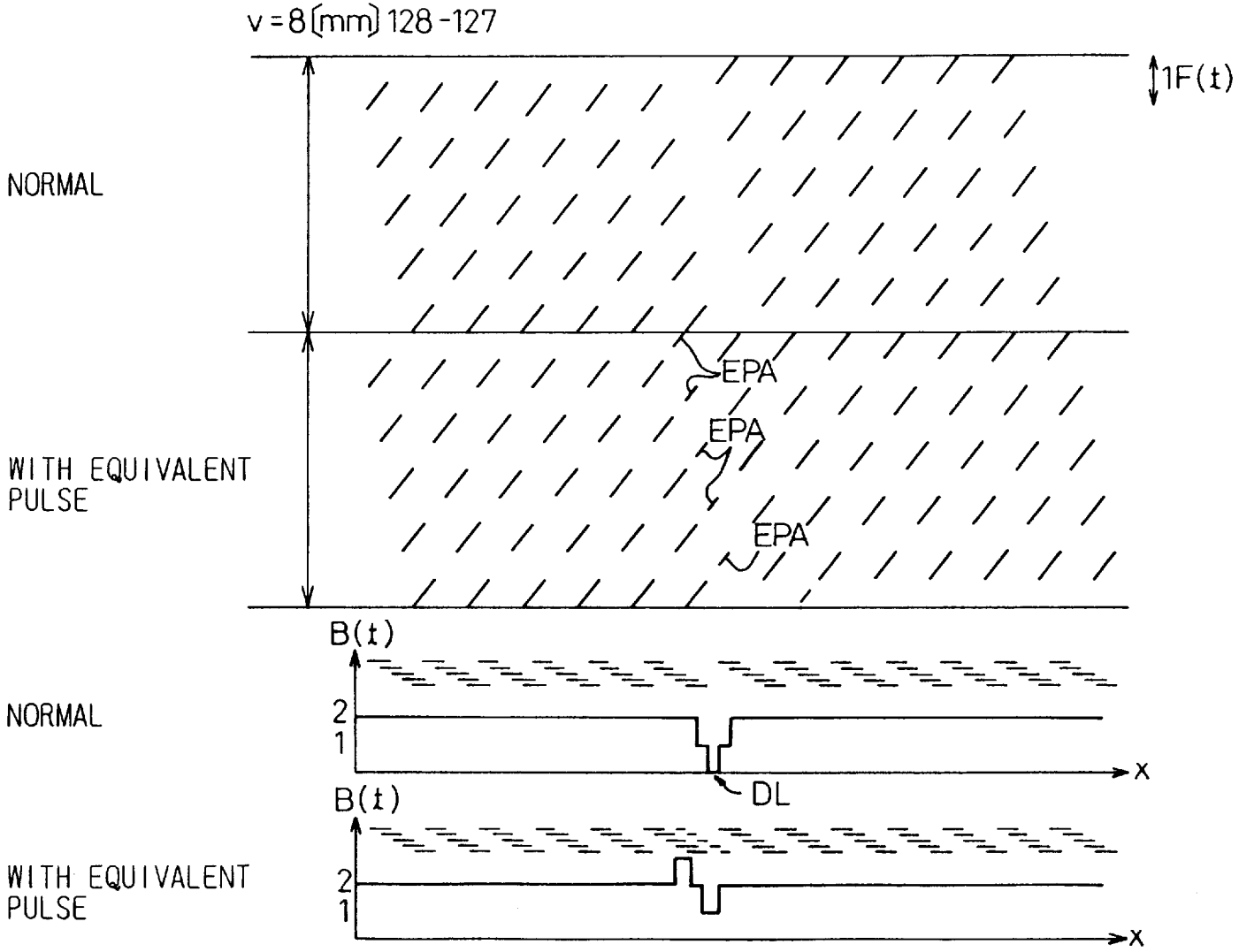
FIGS. 39A to 39D show the effect of the present invention with images being moved horizontally.

In FIG. 39A, adjacent intensity levels 128 and 127 are scrolled horizontally from the left to the right without an equivalent pulse EPA that enables an intensity level adjusting subframe. FIG. 39B shows the same scrolling situation as FIG. 39A but with the equivalent pulse. FIG. 39C shows the sum of stimuli for five frames without the equivalent pulse, and FIG. 39D shows the same but with the equivalent pulse.

When no equivalent pulse is applied, a large valley between intensity levels 128 and 127 of FIG. 39C produces a dark line. This valley is canceled by the equivalent pulse EPA as shown in FIG. 39D.

Figure 40A:
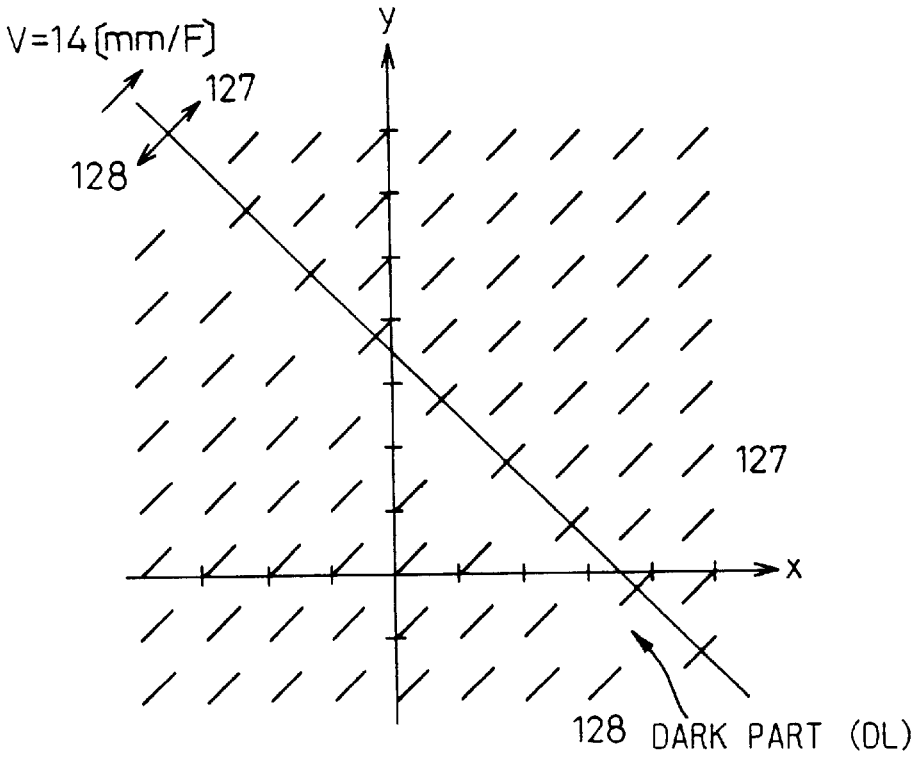
FIGS. 40A and 40B show the effect of the present invention with images being moved diagonally.
Figure 40B:
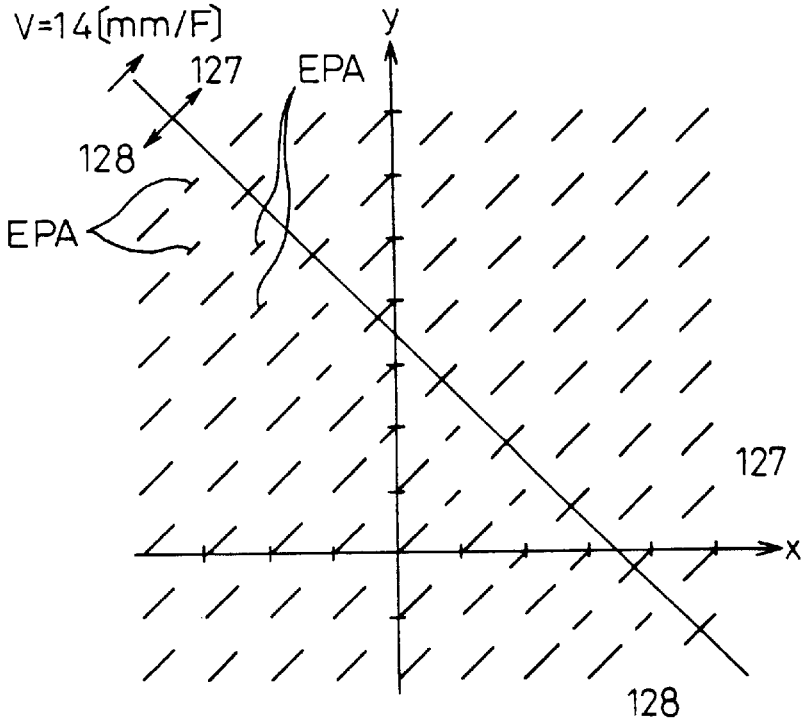

FIGS. 40A and 40B show the effect of the second aspect of the present invention with an image being moved diagonally from the lower left to the upper right.

A dark line appearing between adjacent intensity levels 128 and 127 diagonally moved is canceled by the equivalent pulse EPA similar to the case of horizontally moving the images.

FIGS. 39A to 40B show the effect of the second aspect of the present invention on dynamic images. The effect of the same on static images will be explained with reference to FIGS. 41A to 44D.

Figure 41A:
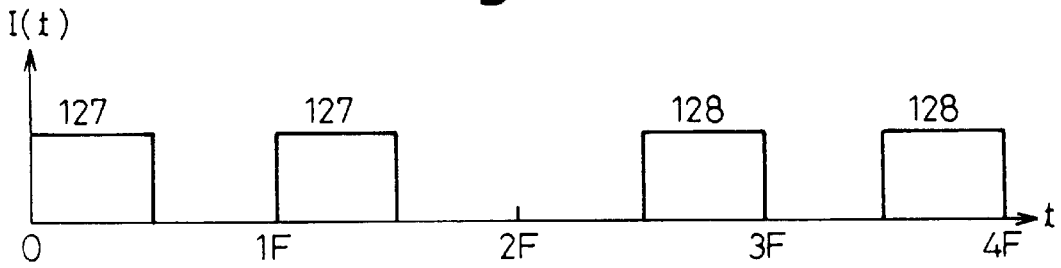
FIGS. 41A to 41D show the effect of the present invention on a static image.
Figure 41B:
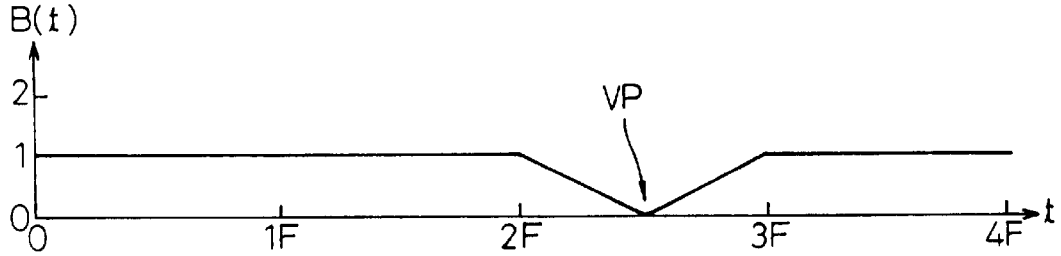

FIG. 41A shows a temporal change between intensity levels 127 and 128, and FIG. 41B shows a temporal change in stimuli on the retina with respect to the change of FIG. 41A.

Figure 41C:
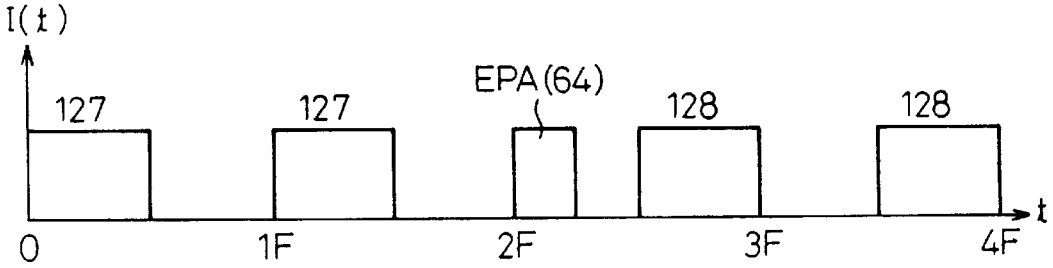
Figure 41D:
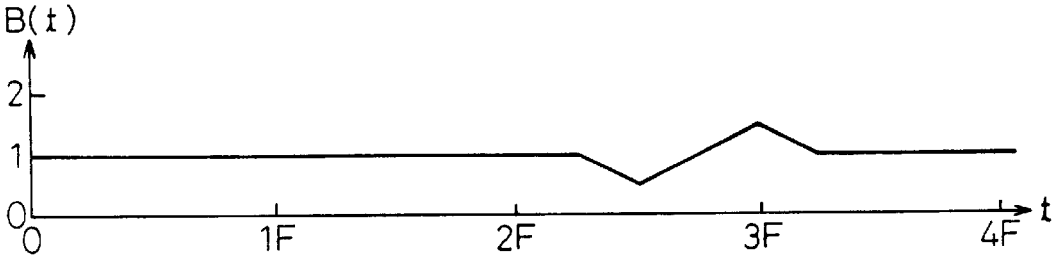

Even in a still image, there will be a valley VP in stimuli on the retina when display intensity level changes from 127 to 128 as shown in FIG. 41B. In this case, an equivalent pulse EPA for enabling, for example, the subframe for intensity level 64 is applied when the intensity level changes from 127 to 128 as shown in FIG. 41C, thereby reducing a change in the stimuli on the retina as shown in FIG. 41D.

Figure 42A:
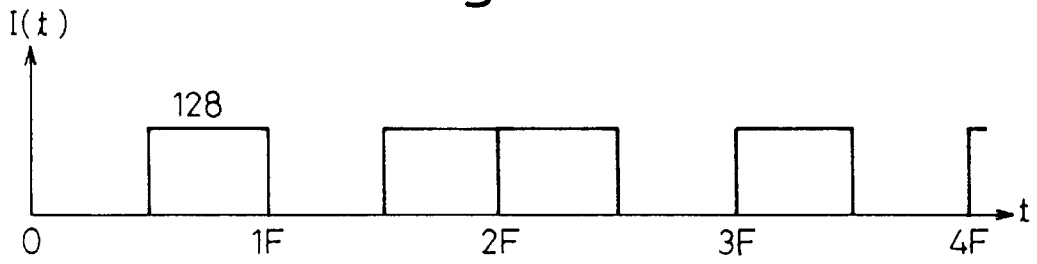
FIGS. 42A to 42D show another effect of the present invention on a static image.
Figure 42B:
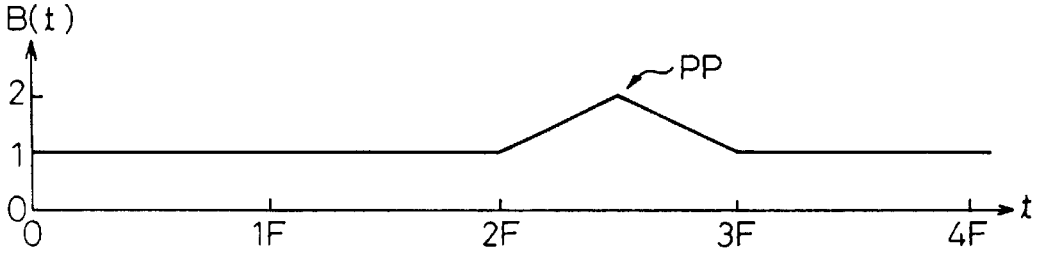
Figure 42C:
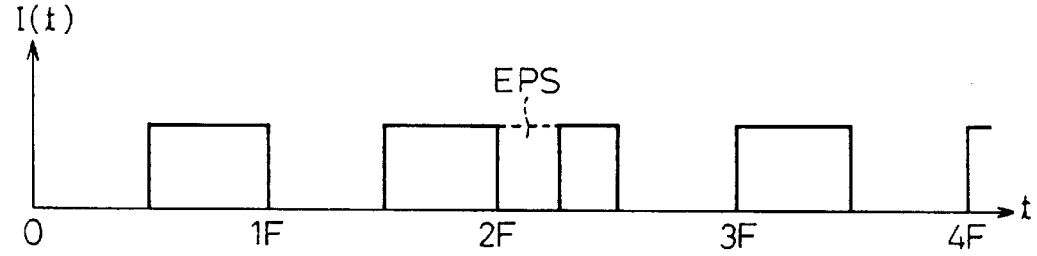
Figure 42D:
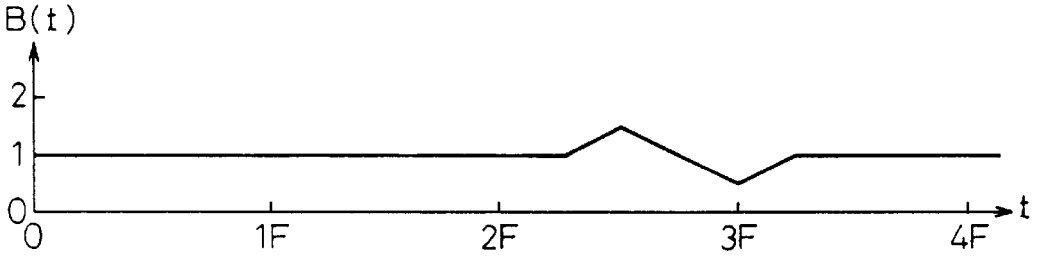
Figure 43A:
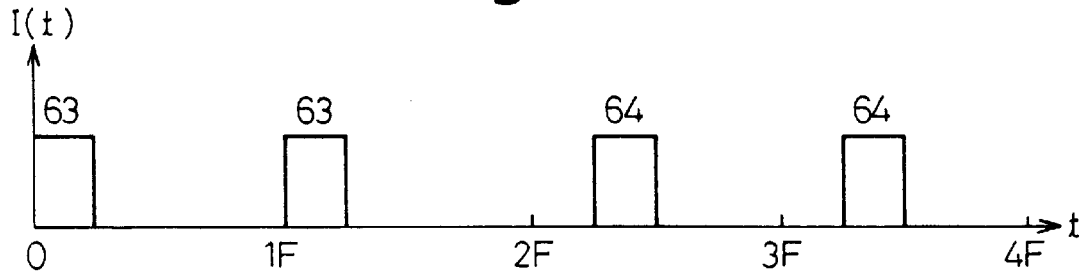
FIGS. 43A to 43D show still another effect of the present invention on a static image.
Figure 43B:
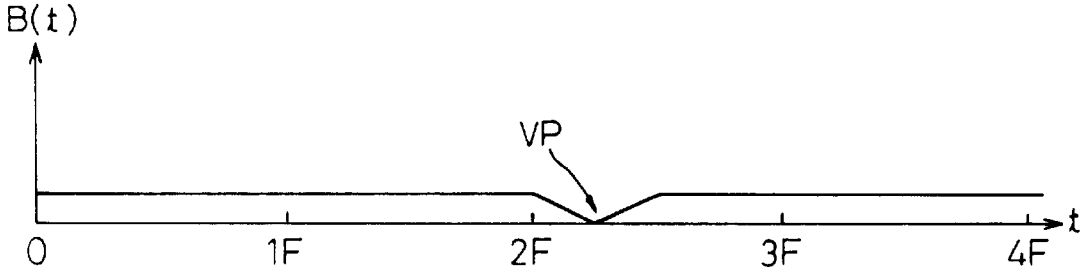
Figure 43C:
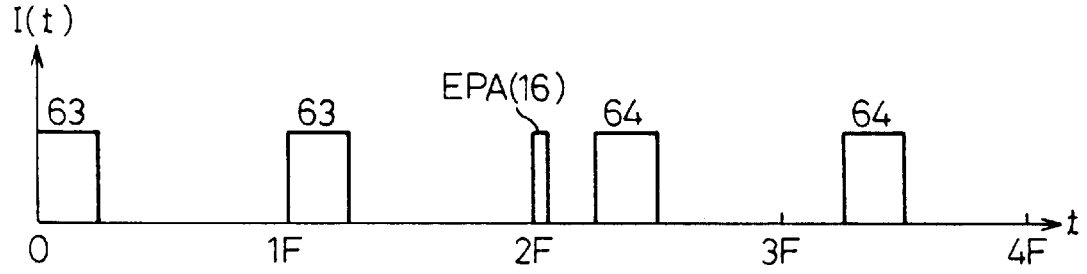
Figure 43D:
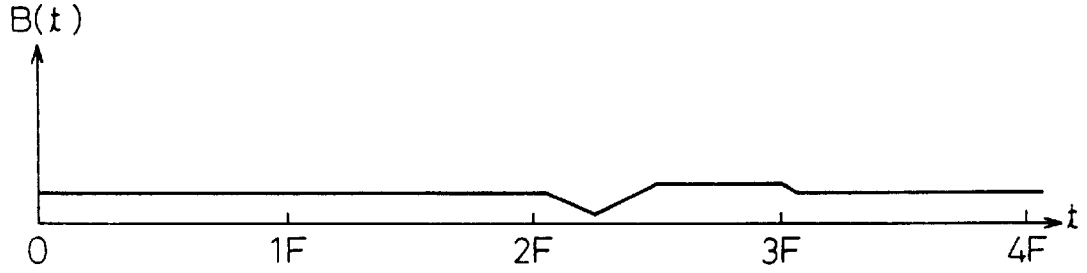
Figure 44A:
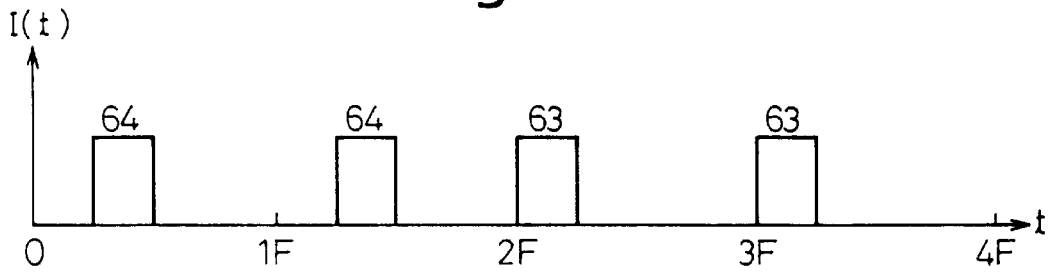
FIGS. 44A to 44D show still another effect of the present invention on a static image.
Figure 44B:
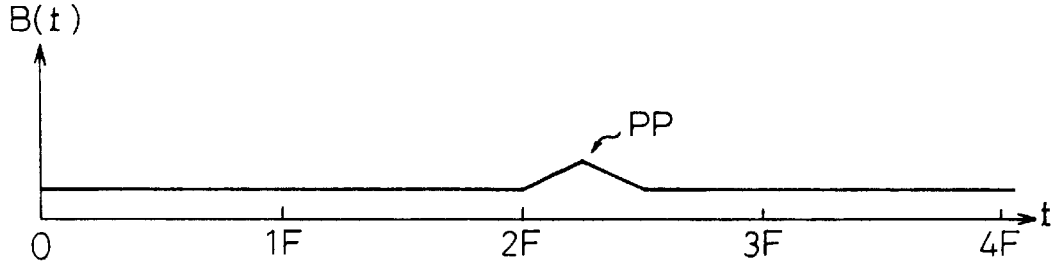
Figure 44C:
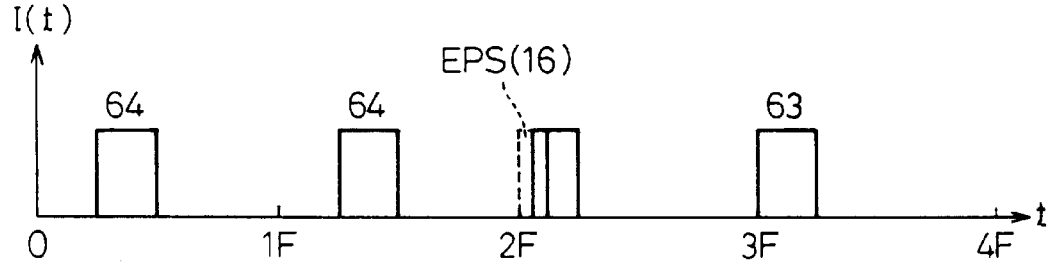
Figure 44D:
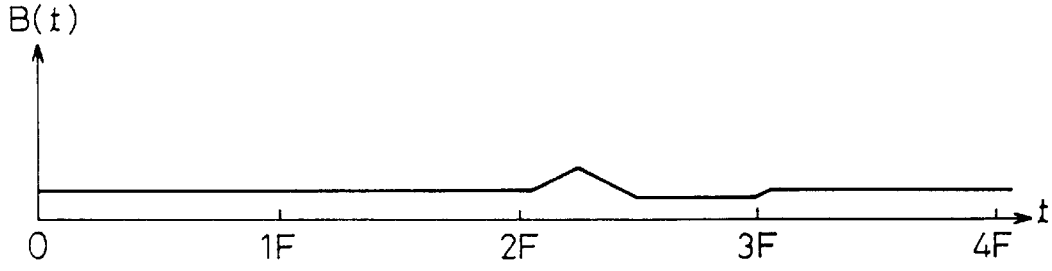

Even in a still image, there will be a peak PP in stimuli on the retina as shown in FIG. 42B when display intensity level changes from 128 to 127 as shown in FIG. 42A. In this case, an equivalent pulse EPA for disabling, for example, the subframe for intensity level 64 is applied when the intensity level changes from 128 to 127 as shown in FIG. 42C, thereby reducing a change in the stimuli on the retina as shown in FIG. 42D.

FIGS. 43A to 43D apply an equivalent pulse EPA for enabling the subframe for intensity level 16 when the intensity level of a static image changes from 63 to 64. FIGS. 44A to 44D apply an equivalent pulse EPS for disabling the subframe for intensity level 16 when the intensity level of a static image changes from 64 to 63.

In this way, the second aspect of the present invention prevents intensity level disturbance and false color contours on images, in particular, dynamic images.

Display units that achieves the method of the second aspect of the present invention will be explained.

Figure 45:
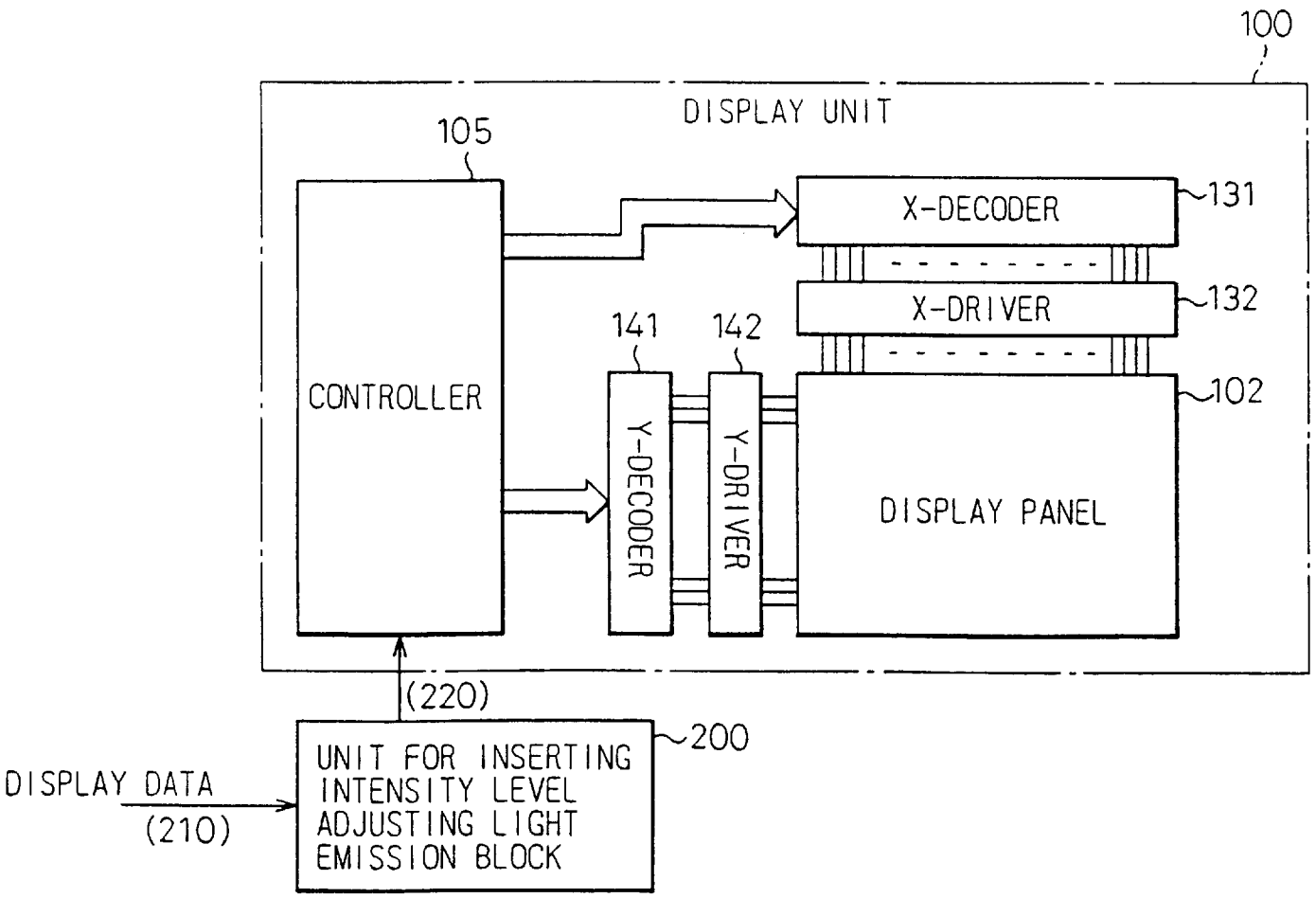
FIG. 45 is a block diagram showing a display unit according to the present invention.

FIG. 45 is a block diagram showing a display unit according to the present invention. The display unit 100 is connected to a unit 200 for enabling/disabling intensity level adjusting subframes (light emission blocks). The unit 200 receives display data 210 and provides adjusted display data 220.

The display unit 100 has a display panel 102, an X-decoder 131, an X-driver 132, a Y-decoder 141, a Y-driver 142, and a controller 5. The controller 5 controls the decoders and drivers, which drive the display panel 102.

Each frame of an image is divided into subframes (light emission blocks) that display individual intensity levels on the display panel 102. Each subframe consists of an addressing period and a sustain discharge period. The display panel 102 may be a gas discharge panel such as a plasma display panel, a panel employing DMDs (digital micromieror devices), an EL panel, etc., that employ the frame division technique to display intensity levels.

The display unit 100 of FIG. 45 may employ any kind of display panel that realizes intensity levels with the use of subframes. The unit 200 according to the present invention enables or disables intensity level adjusting subframes (equivalent pulses, or light emission blocks) according to the display data 210 and provides the adjusted display data 220.

Figure 46:
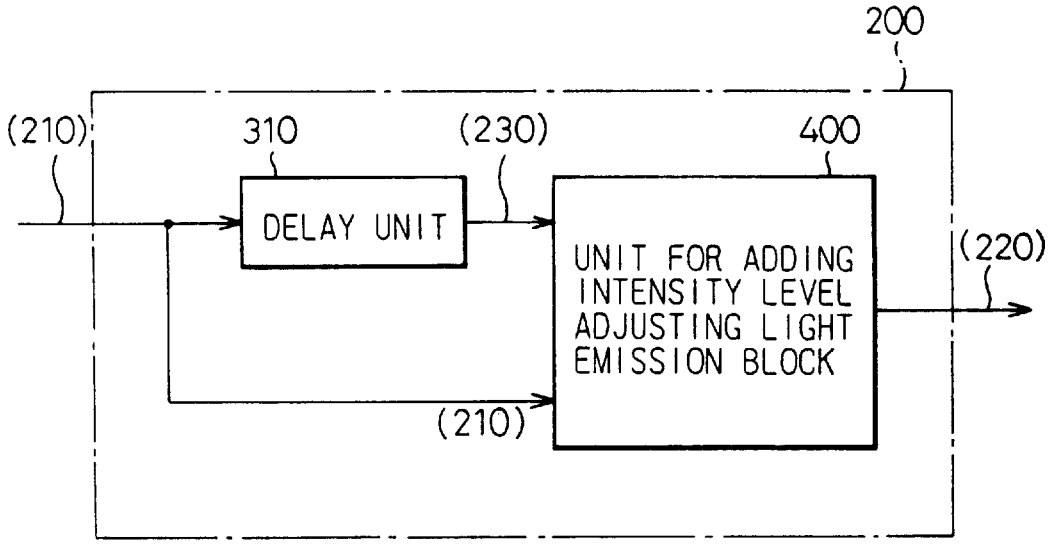
FIG. 46 is a block diagram showing a unit for inserting a light emission block to adjust an intensity level according to the present invention.

FIG. 46 is a block diagram showing an example of the unit 200.

The unit 200 has a delay unit 310 for delaying the display data 210 by a frame and a unit 400 for enabling or disabling intensity level adjusting subframes. The unit 400 receives the display data 210 for a given frame and display data 230 for the preceding frame. The unit 400 enables or disables the intensity level adjusting subframes in the display data 210 and provides adjusted display data 220.

Figure 47:
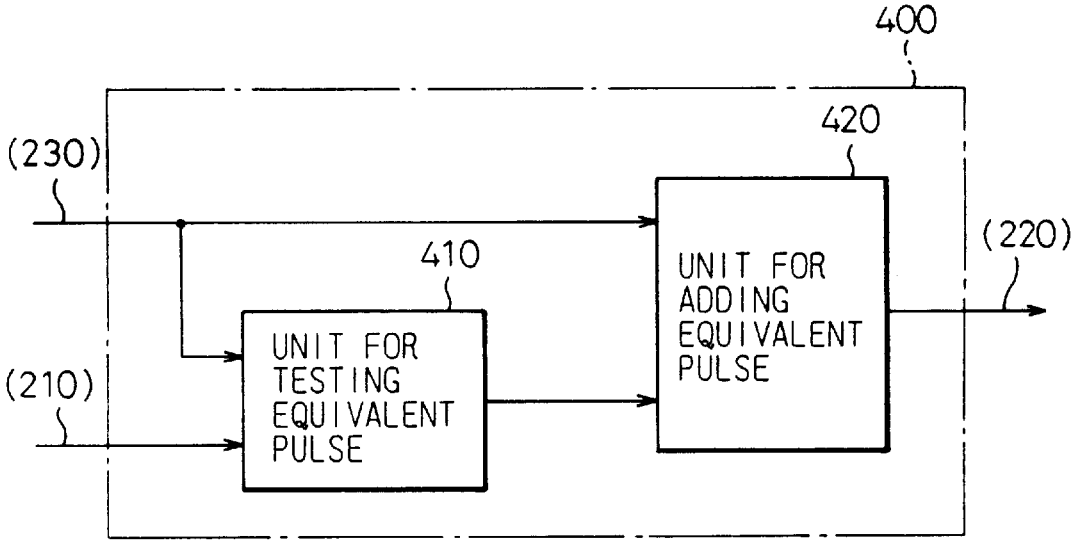
FIG. 47 is a block diagram showing a unit for adding a light emission block to adjust an intensity level according to a first embodiment of the present invention.

FIG. 47 is a block diagram showing an example of the unit 400 of FIG. 46, according to a first embodiment of the second aspect of the present invention.

The unit 400 has a unit 410 that receives display data 210 for a present frame and display data 230 for the preceding frame, to check equivalent pulses, and a unit 420 for enabling or disabling equivalent pulses, which enable or disable the intensity level adjusting subframes, according to the preceding display data 230 and the output of the unit 410.

Figure 48:
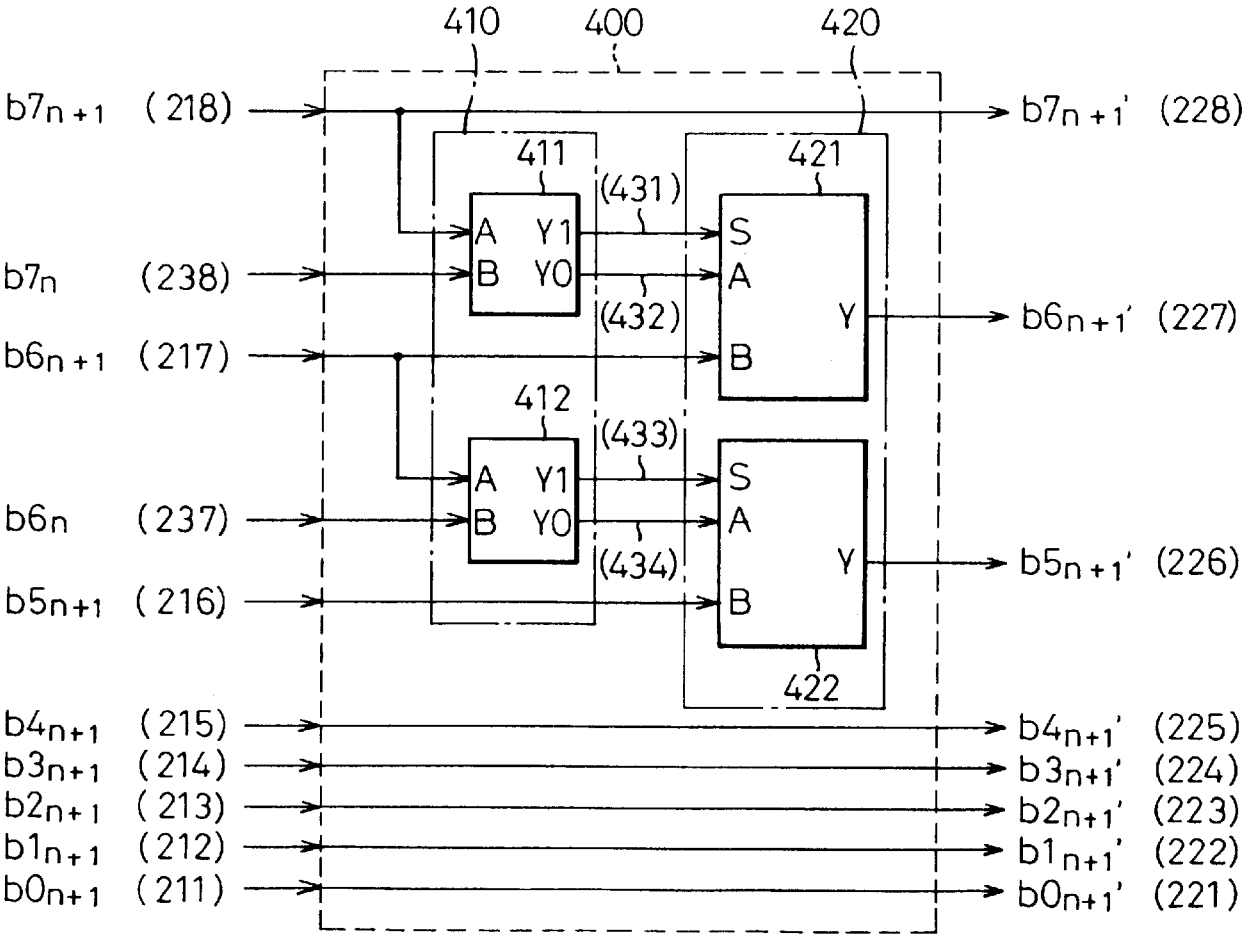
FIG. 48 is a block diagram showing a concrete example of the unit of FIG. 47.

FIG. 48 is a block diagram showing an example of the unit 400 of FIG. 47. Display data 210 shown in FIG. 47 for a frame "n+1" consists of bits $b0_{n+1}$ to $b7_{n+1}$ indicated with reference numerals 211 to 218. Adjusted display data 220 shown in FIG. 47 for the frame n+1 consists of bits $b0_{n+1}'$ to $b7_{n+1}'$ indicated with reference numerals 221 to 228. Display data 230 shown in FIG. 47 for a frame "n" includes second and first highest bits $b6_n$ and $b7_n$ indicated with reference numerals 237 and 238, respectively.

In FIG. 48, the unit 410 for checking equivalent pulses consists of two equivalent pulse testers 411 and 412. The unit 420 for enabling or disabling the equivalent pulses has units 421 and 422 for receiving output signals 431 and 433 and polarity signals 432 and 434 from the testers 411 and 412. The unit 400 provides the adjusted display data 220 according to the display data 210 for the frame n+1 and display data 230 for the frame n.

The tester 411 determines whether or not the most significant bits $b7_n$ and $b7_{n+1}$ of the frames n and n+1 are enabled. The tester 412 determines whether or not the second most significant bits $b6_n$ and $b6_{n+1}$ of the frames n and n+1 are enabled. The testers 411 and 412 determine the polarity of equivalent pulses, i.e., whether the equivalent pulses must be enabled or disabled to turn ON or OFF the intensity level adjusting subframes (light emission blocks).

The output Y1 of the tester 411 indicates whether or not the $b7_n$ and $b7_{n+1}$ differ from each other. If the output Y1 is at high level, the bits $b7_n$ and $b7_{n+1}$ differ from each other, and if it is at low level, the bits are equal to each other. The output Y0 of the tester 411 indicates the polarity of the equivalent pulse. If the output Y0 is at high level, the polarity is positive to enable the equivalent pulse to turn ON the intensity level adjusting subframe. If the output Y0 is at low level, the polarity is negative to disable the equivalent pulse to turn OFF the intensity level adjusting subframe.

Figure 49:
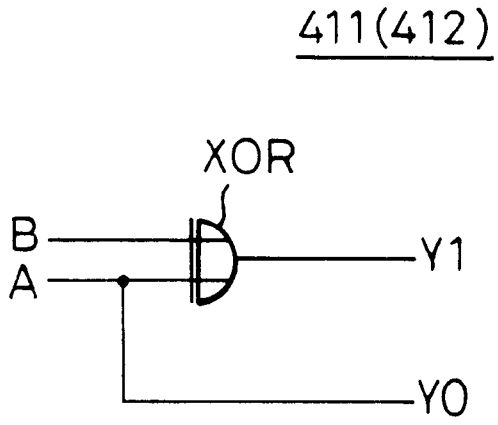
FIG. 49 is a logic circuit diagram showing a unit for determining an equivalent pulse.

FIG. 49 is a logic circuit diagram showing an example of the tester 411 (412) for testing an equivalent pulse.

The tester 411 (412) consists of an exclusive OR gate, which provides the outputs Y0 and Y1 according to inputs A and B. Each of the testers 411, 412, 511, and 512 has the same arrangement as the tester 411 of FIG. 49. Table 1 shows truth values of the tester.

TABLE 1

| Input | | Output | | |
|---|---|---|---|---|
| B | A | Y1 | Y0 | Conditions |
| L | L | L | X | No change |
| L | H | H | H | Apply positive equivalent pulse |
| H | L | H | L | Apply negative equivalent pulse |
| H | H | L | X | No change |

Figure 50:
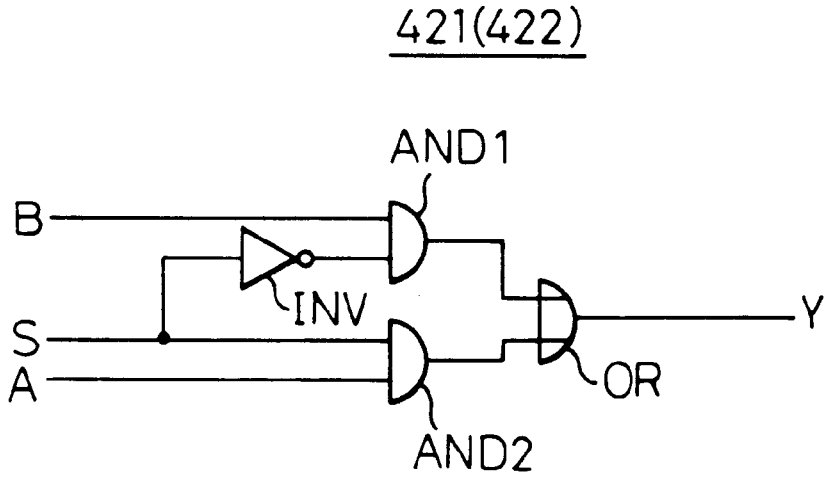
FIG. 50 is a logic circuit diagram showing a unit for determining an equivalent pulse.

FIG. 50 is a logic circuit diagram showing the unit 421 (422) for enabling or disabling the equivalent pulse. The unit 421 consists of two AND gates AND1 and AND2, an OR gate OR, and an inverter INV. The unit 421 provides an output Y according to inputs A, B, and S. Each of the units 421, 422, 521, and 522 has the same structure as the unit 421 of FIG. 50. Table 2 shows truth values of the unit 421.

TABLE 2

| Input | | | Output | |
|---|---|---|---|---|
| A | B | S | Y | Conditions |
| X | L | L | L | No change |
| X | H | L | H | No change |
| L | X | H | L | Negative equivalent pulse |
| H | X | H | H | Positive equivalent pulse |

As shown in Table 1 and FIGS. 48 and 49, for example, in the tester (equivalent pulse tester) 411, the most significant bit (first highest bit) $b7_{n+1}$ of the frame "n+1" (next frame of the frame "n") is supplied to the input A, and the most significant bit $b7_n$ of the frame "n" (optional frame) is supplied to the input B. When the signal levels of the inputs A and B are not changed, the equivalent pulse is not added or subtracted by bringing the output Y1 at low level "L", on the other hand, when the signal levels of the inputs A and B are changed, the equivalent pulse is added or subtracted by bringing the output Y1 at high level "H". As clearly shown in FIG. 49, the signal level of the output Y0 is the same as that of the input A.

As shown in Table 2 and FIGS. 48 and 50, for example, in the unit (equivalent pulse enabling or disabling unit) 421, the output Y1 (output signal of the XOR gate) of the tester 411 is supplied to the input S, the output Y0 ($b7_{n+1}$) of the tester 411 is supplied to the input A of the unit 421, and the second highest bit ($b6_{n+1}$) of the frame "n+1" is supplied to the input B of the unit 421.

Therefore, when the most significant bits $b7_n$ and $b7_{n+1}$ of the frames n and n+1 are different from each other, the input S of the unit 421 is at high level "H", and the output of the AND gate (AND2) is appeared as the output Y of the unit 421 through the OR gate. Concretely, when the most significant bit b7 of the frame n is disabled (low level "L": for example, intensity level 127) and the most significant bit $b7_{n+1}$ of the frame n+1 is enabled (high level "H": for example, intensity level 128), both of the inputs S and A of the unit 421 are at high level "H", so that a positive equivalent pulse (for example, intensity level 64) is added to the original signal (display data 210), or an equivalent pulse is enabled. On the other hand, when the most significant bit b7 of the frame n is enabled ("H") and the most significant bit $b7_{n+1}$ of the frame n+1 is disabled ("L"), the input S of the unit 421 is at high level "H" and the input A of the unit 421 is at low level "L", so that a negative equivalent pulse is added to (equivalent pulse is subtracted from) the original signal, or an equivalent pulse is disabled.

In FIG. 48, the equivalent pulse tester 412 and equivalent pulse enabling or disabling unit 422 receive the bit signals $b6_{n+1}$, $b6_n$, and $b5_{n+1}$ which are lower by one bit rank than the bit signals ($b7_{n+1}$, $b7_n$, and $b6_{n+1}$) for the tester 411 and unit 421, and carry out the same processes of tester 411 and unit 421 for the one bit lower signals. Note that the operations (output levels against input levels) of each equivalent pulse tester and each equivalent pulse enabling or disabling unit shown in FIGS. 51, 53, 54, and 57 to 69 are the same as the above embodiments.

Figure 51:
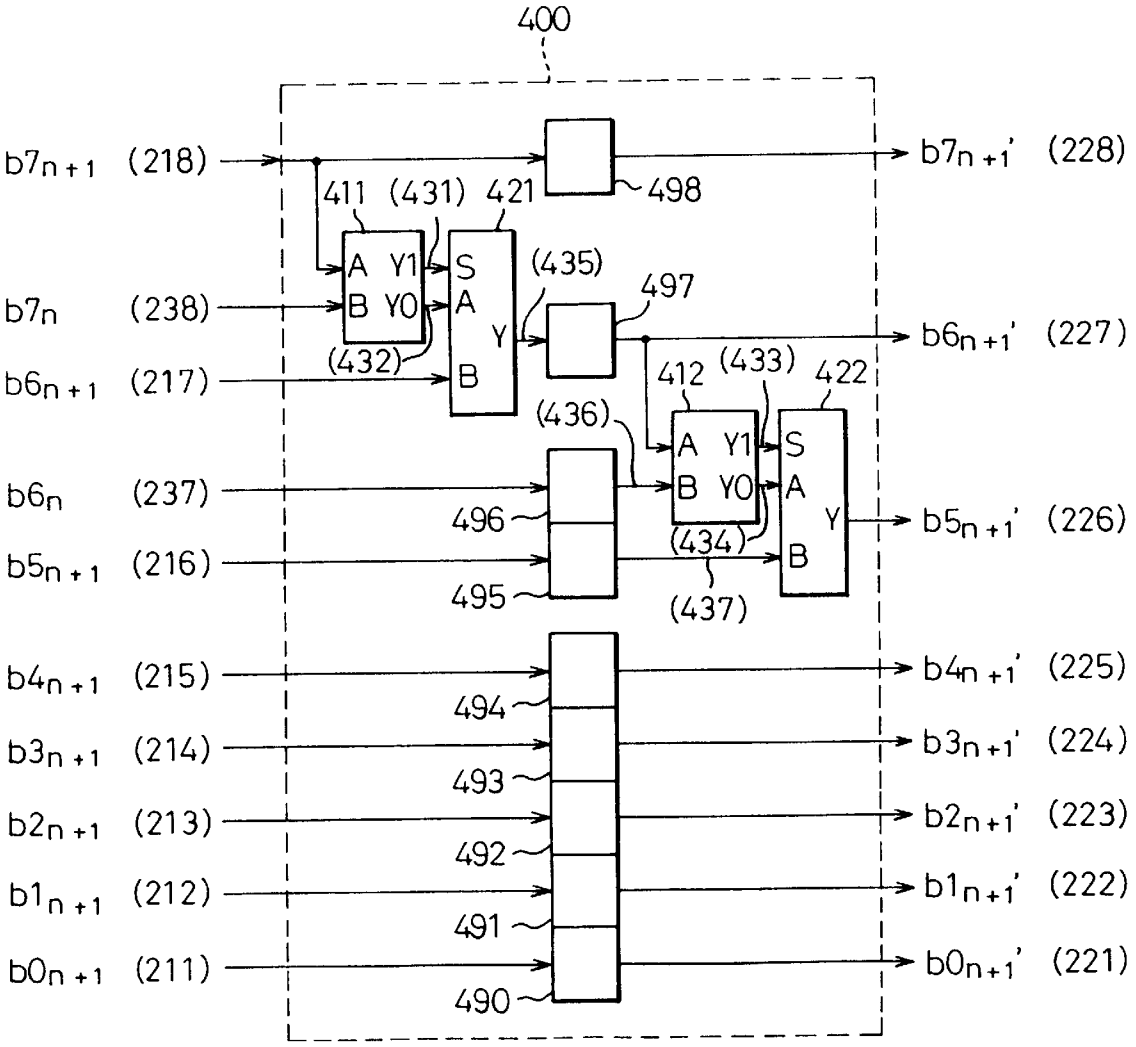
FIG. 51 is a block diagram showing another concrete example of the unit of FIG. 47.

FIG. 51 is a block diagram showing another example of the unit 400 of FIG. 47. The unit 400 consists of two equivalent pulse testers 411 and 412, units 421 and 422 each for enabling or disabling an equivalent pulse, and nine delay units 490 to 498. The unit 421 provides an output signal 435 that is formed by enabling or disabling a signal 217, i.e., bit $b6_{n+1}$. The delay units 496 and 495 provide output signals 436 and 437 by delaying signals 237 ($b6_n$) and 216 ($b5_{n+1}$) by one pixel.

The unit 400 of FIG. 51 relates the status of the higher equivalent pulse to the status of the lower equivalent pulse.

If the equivalent pulse for the second highest bit for the subframe SF6 is enabled or disabled, the equivalent pulse for the third highest bit for the subframe SF5 is determined accordingly. Namely, signals 218 and 238 to the unit 411 correspond to signals 227 and 436 to the unit 412. Signals 431, 432, and 217 to the unit 421 correspond to signals 433, 434, and 437 to the unit 422. The unit 421 determines whether the equivalent pulse for the second highest bit must be enabled or disabled, and the unit 422 determines whether the equivalent pulse for the third highest bit must be enabled or disabled.

Figure 52:
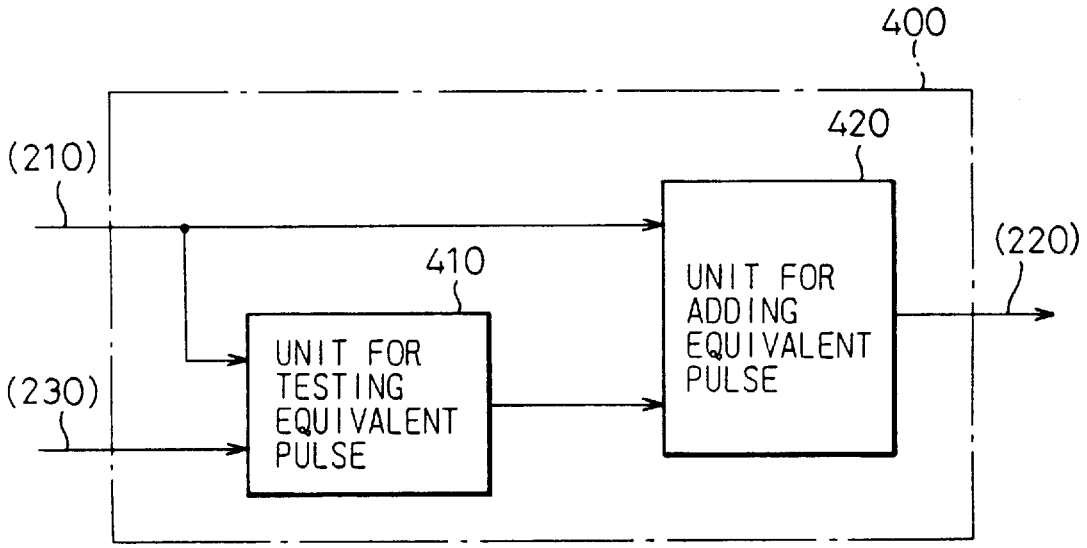
FIG. 52 is a block diagram showing a unit for adding a light emission block to adjust an intensity level according to a second embodiment of the present invention.

FIG. 52 is a block diagram showing another example of the unit 400 of FIG. 46, according to a second embodiment of the second aspect of the present invention.

In FIGS. 52 and 47, the display data 210 and 230 are supplied oppositely.

The unit 400 of FIG. 52 has an equivalent pulse tester 410 for receiving display data 210 for a given frame and display data 230 for the preceding frame, and an equivalent pulse disabling/enabling unit 420 for receiving the display data 210 and the output of the unit 410.

The unit 400 of FIG. 47 handles frames each having subframes (light emission blocks) that are arranged in ascending order of the intensity levels thereof. The unit 400 of FIG. 52 handles frames each having subframes (light emission blocks) that are arranged in descending order of the intensity levels thereof.

Figure 53:
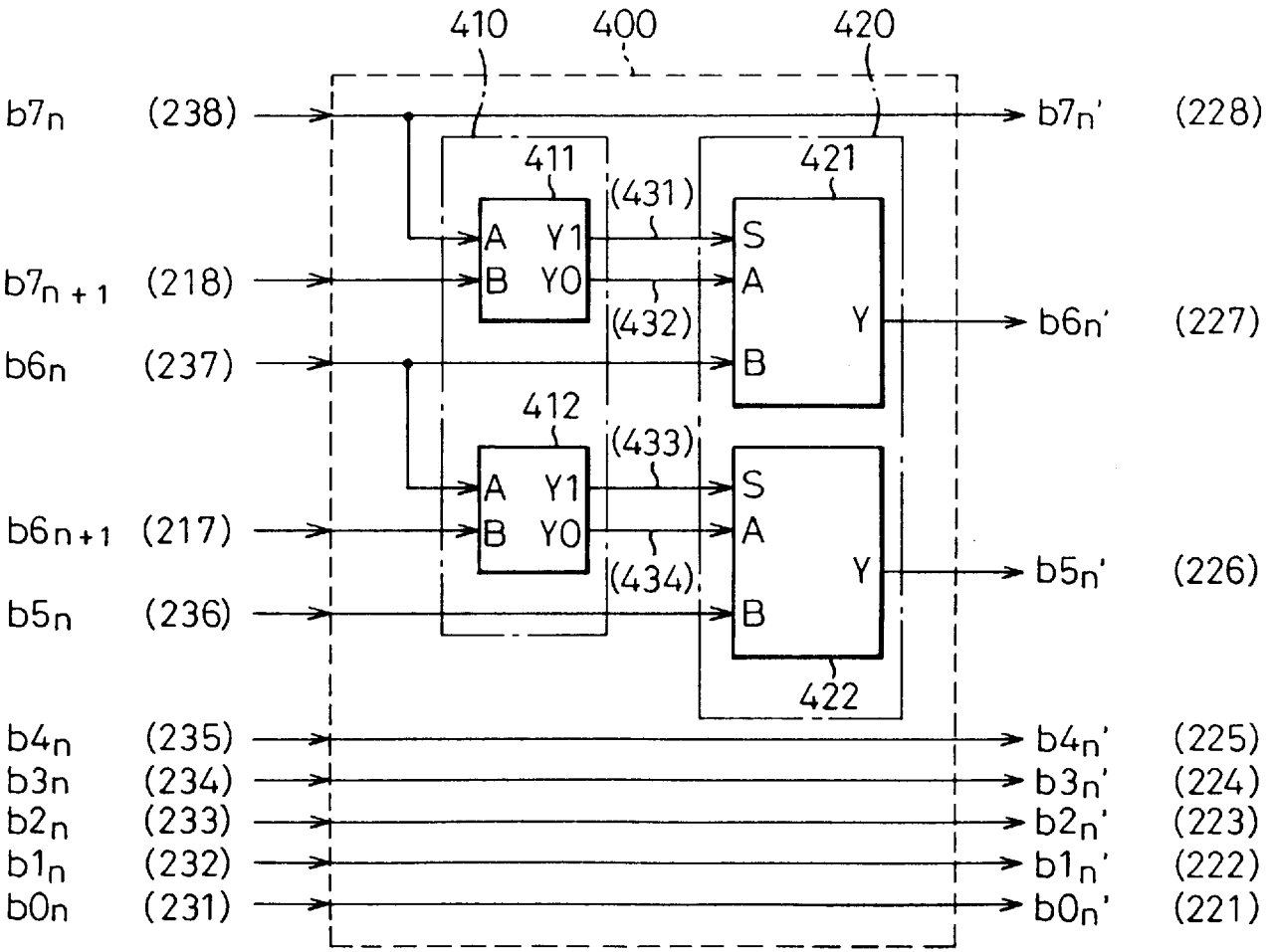
FIG. 53 is a block diagram showing a concrete example of the unit of FIG. 52.
Figure 54:
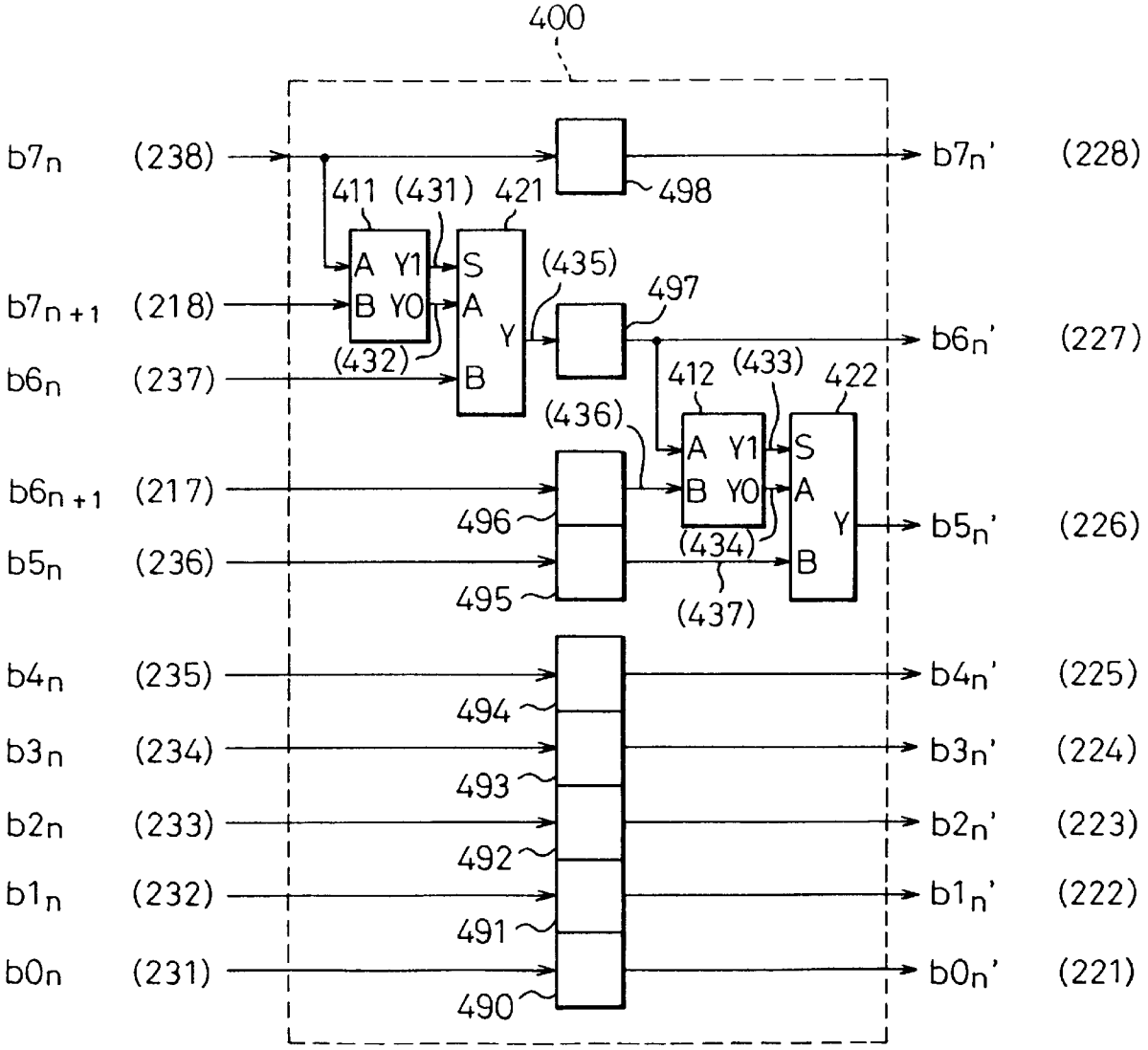
FIG. 54 is a block diagram showing another concrete example of the unit of FIG. 52.

FIG. 53 is a block diagram showing an example of the unit 400 of FIG. 52, and FIG. 54 is a block diagram showing another example of the unit 400 of FIG. 52.

The units of FIGS. 53 and 54 handle signals 231 to 238 ($b0_n$ to $b7_n$) instead of the signals 211 to 218 ($b0_{n+1}$ to $b7_{n+1}$) of FIGS. 47 and 51, as well as signals 217 and 218 ($b6_{n+1}$ and $b7_{n+1}$) instead of the signals 237 and 238 ($b6_n$ and $b7_n$) of FIGS. 47 and 51. The other parts of the circuits of FIGS. 53 and 54 are the same as those of FIGS. 47 and 51.

Figure 55:
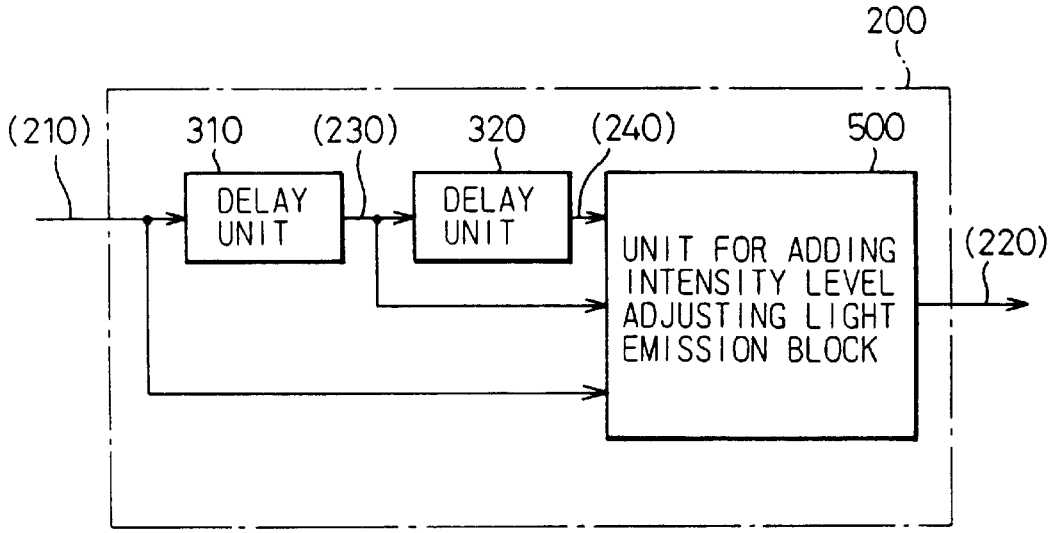
FIG. 55 is a block diagram showing a unit for inserting a light emission block to adjust an intensity level according to the present invention.

FIG. 55 is a block diagram showing another example of the unit 200 of FIG. 45 according to the second aspect of the present invention.

The unit 200 has delay units 310 and 320 each for providing a delay of a frame and a unit 500 for enabling or disabling intensity level adjusting subframes (light emission blocks). The unit 500 receives display data 210 for a given frame, display data 230 for the preceding frame, and display data 240 for two frames back, and provides display data 220 with enabled or disabled intensity level adjusting subframes.

Figure 56:
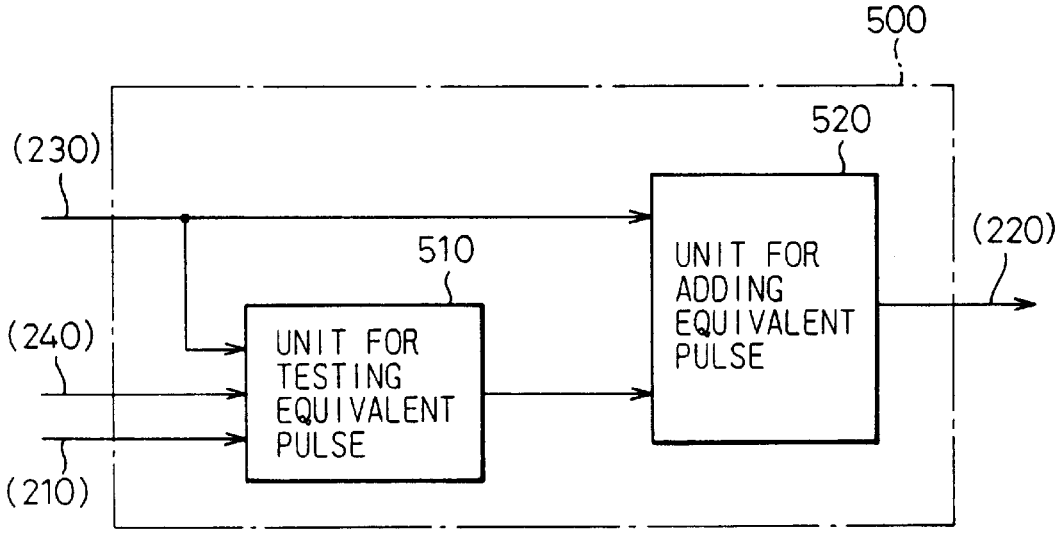
FIG. 56 is a block diagram showing a unit for adding a light emission block to adjust an intensity level according to third and fourth embodiments of the present invention.

FIG. 56 is a block diagram showing an example of the unit 500 of FIG. 55, according to third and fourth embodiments of the second aspect of the present invention.

The unit 500 has an equivalent pulse tester 510 for receiving display data 210 for a given frame, display data 230 for the preceding frame, and display data 240 for two frames back, and a unit 520 for enabling or disabling equivalent pulses. The unit 520 receives the display data 230 and the output of the tester 510.

Figure 57:
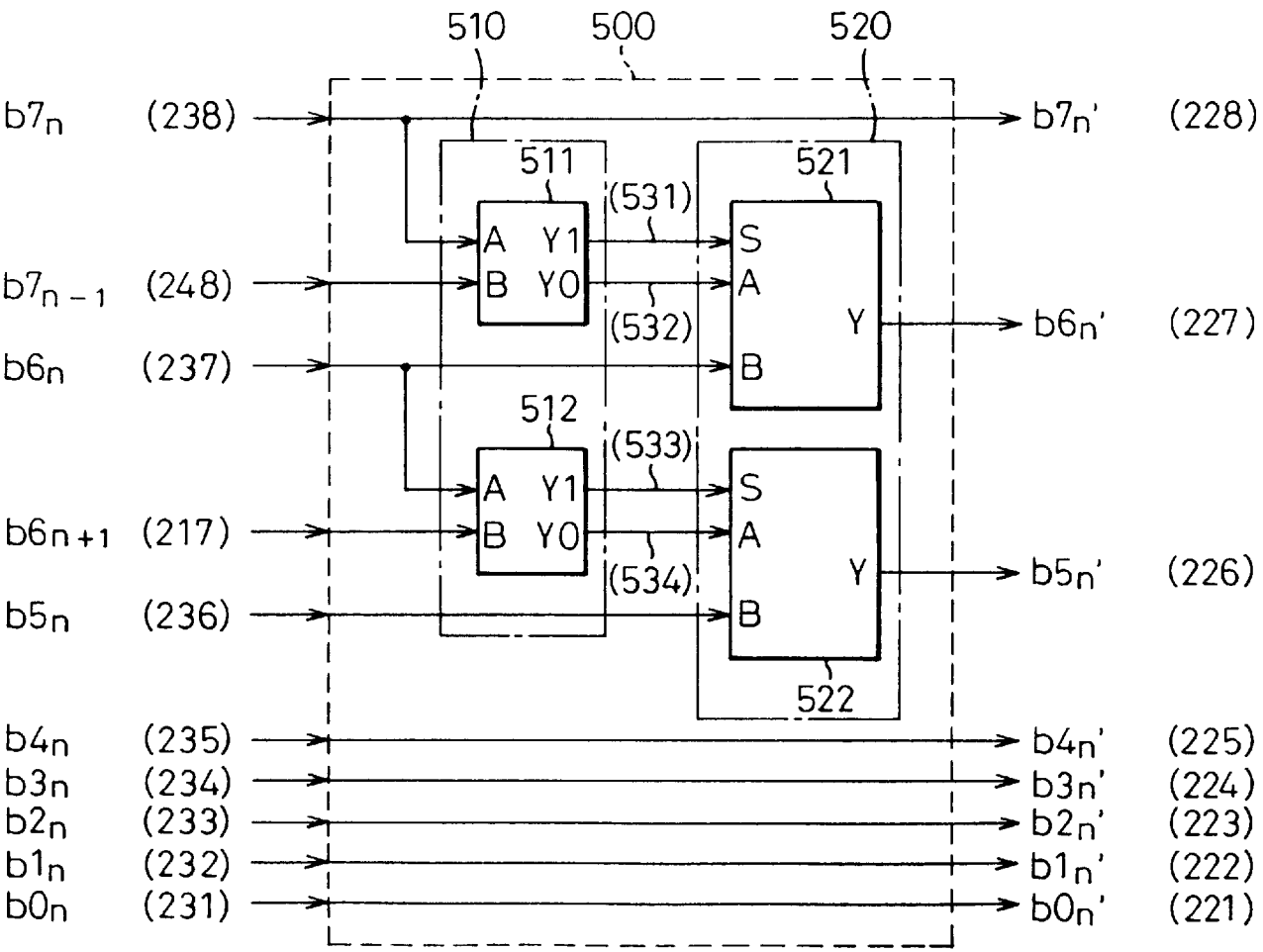
FIG. 57 is a block diagram showing a concrete example of the unit of FIG. 56 according to the third embodiment.

FIG. 57 is a block diagram showing an example of the unit 500 of FIG. 56 according to the third embodiment. A signal 217 represents the second highest bit $b6_{n+1}$ of the display data 210. Signals 221 to 228 represent bits $b0_{n+1}$ to $b7_{n+1}$ that are formed by enabling or disabling the bits of the display data 210. Signals 231 to 238 represent the bits $b0_n$ to $b7_n$ of the display data 230. A signal 248 represents the most significant bit $b7_{n-1}$ of the display data 240.

The unit 510 has two equivalent pulse testers 511 and 512. The unit 520 consists of two units 521 and 522 for receiving output signals 531 and 533 and polarity signals 532 and 534 from the testers 511 and 512. The unit 500 receives the display data 230 (signals 231 to 238) and display data 240 (signal 248) and provides display data 220 (signals 221 to 228) in which intensity level adjusting subframes are enabled or disabled.

The tester 511 determines whether or not the most significant bits $b7_n$ and $b7_{n-1}$ differ from each other. The tester 512 determines whether or not the second highest bits $b6_n$ and $b6_{n+1}$ differ from each other. The testers 511 and 512 also determine the polarities of equivalent pulses to enable or disable bits corresponding to the intensity level adjusting subframes (light emission blocks).

If the output Y1 of the tester 511 is at high level, the bits $b7_n$ and $b7_{n-1}$ differ from each other, and if it is at low level, they are equal to each other. If the output Y0 of the tester 511 is at high level, the polarity of the equivalent pulse is positive to enable the intensity level adjusting subframe, and if it is at low level, the same is negative to disable the subframe.

Figure 58:
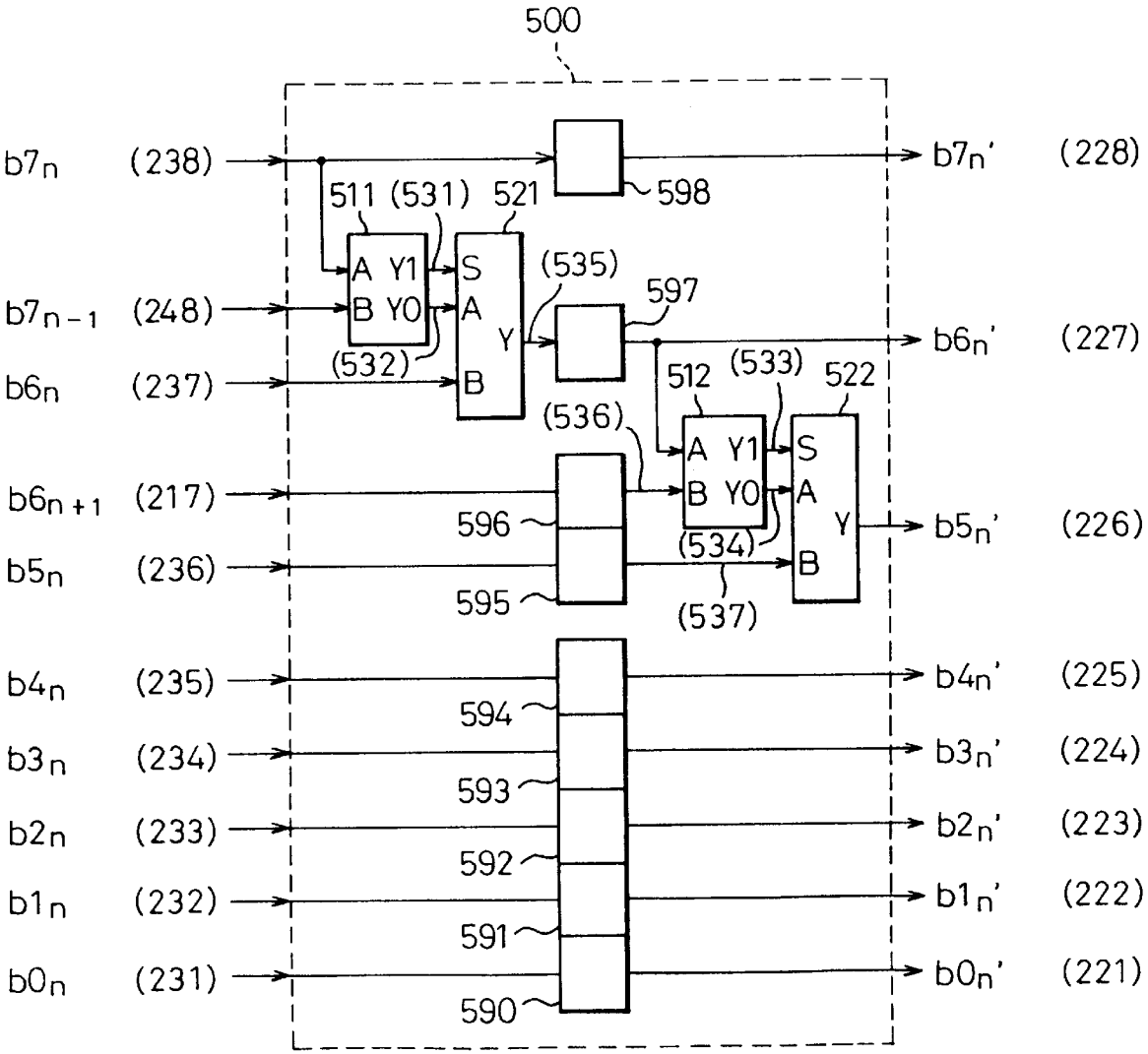
FIG. 58 is a block diagram showing another concrete example of the unit of FIG. 56 according to the third embodiment.

FIG. 58 is a block diagram showing another example of the unit 500 of FIG. 56 according to the third embodiment. The unit 500 has delay units 590 to 598 each providing a delay of a pixel.

The unit 500 of FIG. 58 relates the status of a higher equivalent pulse to the status of a lower equivalent pulse.

The third embodiment arranges, in each frame, subframes in order of SF5, SF4, SF0, SF1, SF2, SF3, and SF7. The fourth embodiment mentioned below arranges, in each frame, subframes in order of SF7, SF4, SF3, SF2, SF1, SF0, and SF5. Namely, the arrangement of subframes of the fourth embodiment of FIGS. 59 and 60 is opposite to that of the third embodiment of FIGS. 57 and 58.

Figure 59:
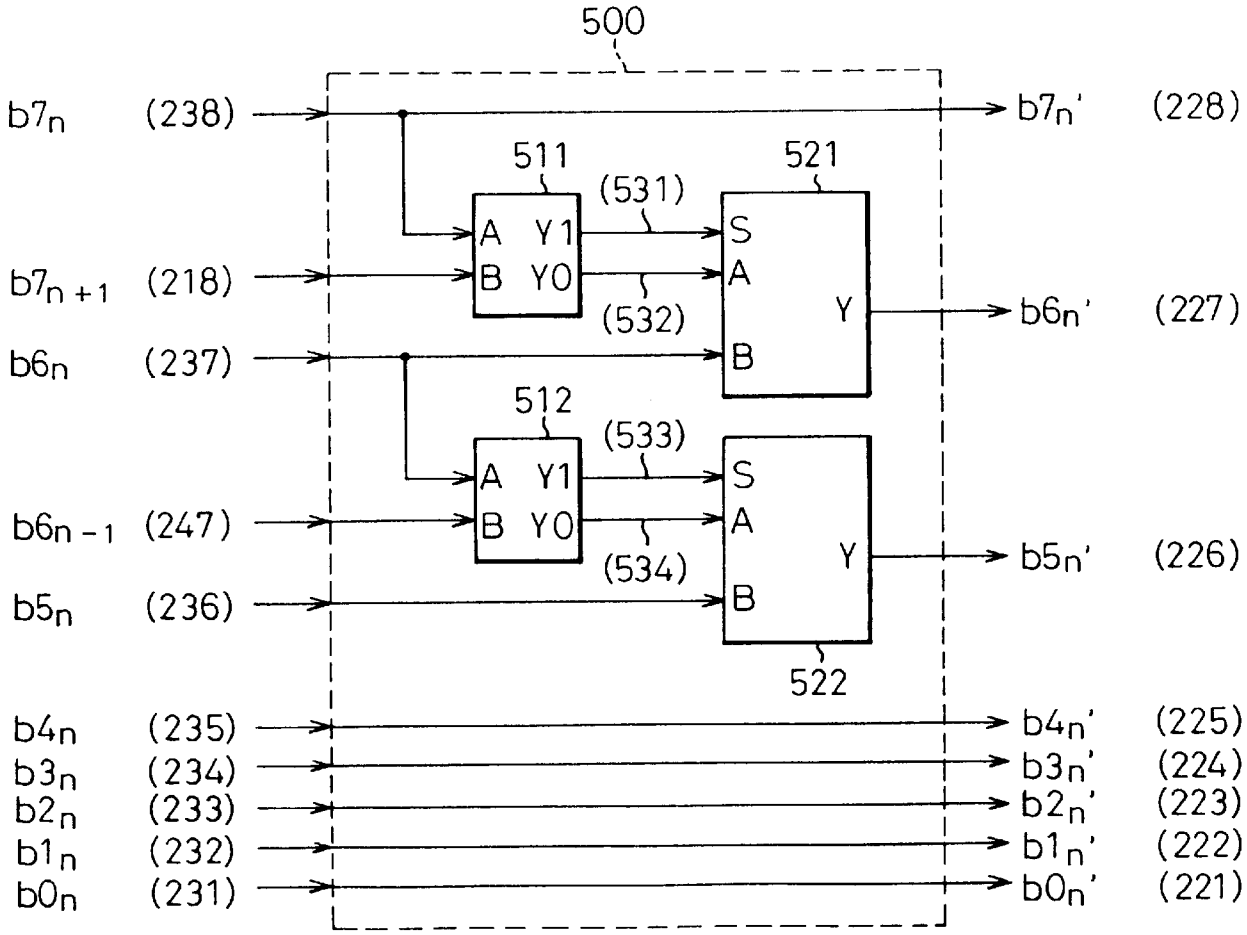
FIG. 59 is a block diagram showing a concrete example of the unit of FIG. 56 according to the fourth embodiment.
Figure 60:
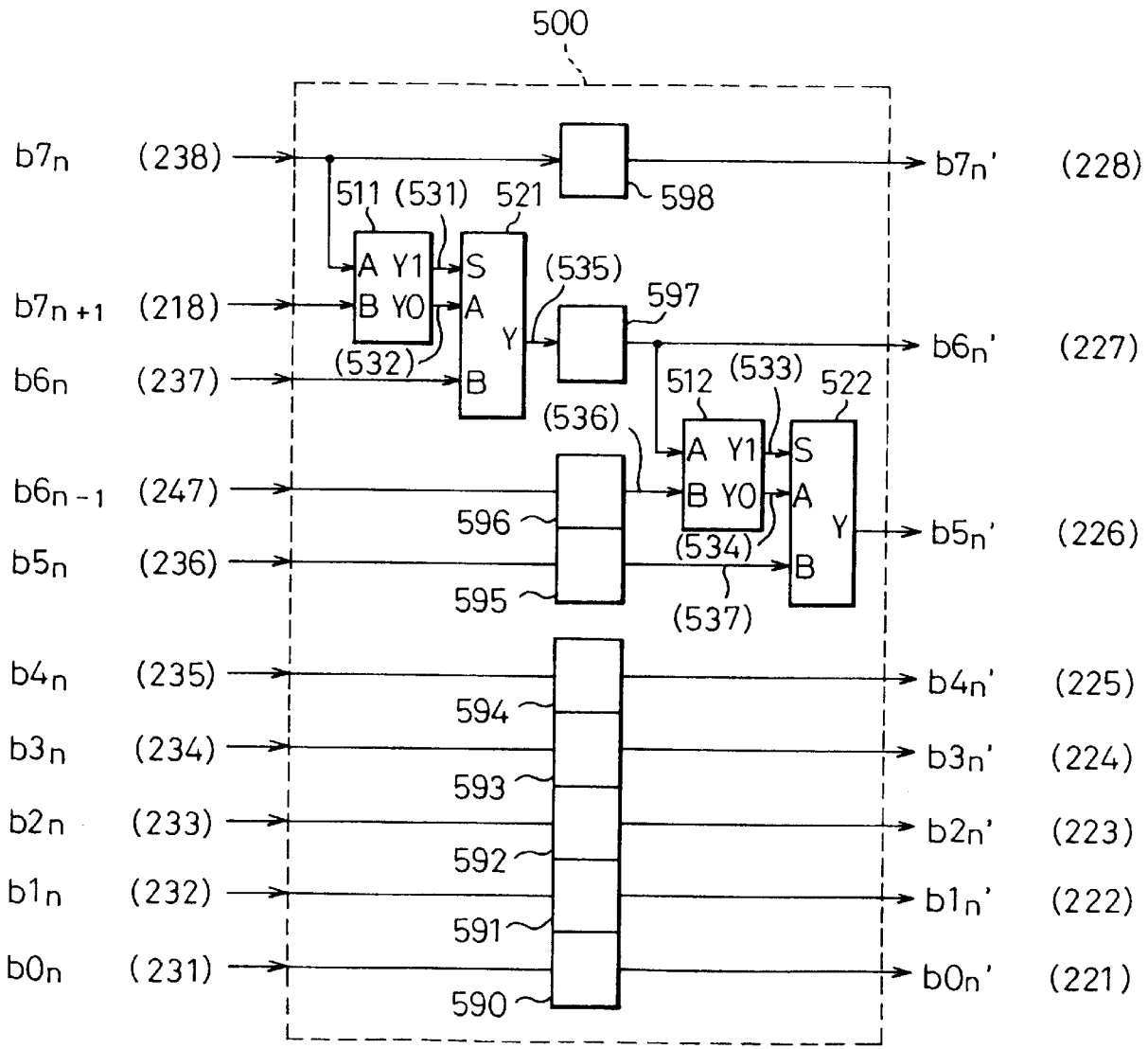
FIG. 60 is a block diagram showing another concrete example of the unit of FIG. 56 according to the fourth embodiment.

FIG. 59 is a block diagram showing an example of the unit 500 of FIG. 56, according to the fourth embodiment, and FIG. 60 is a block diagram showing another example of the unit 500 of FIG. 56, according to the fourth embodiment.

The units of FIGS. 59 and 60 handle signals 247 ($b6_{n-1}$) and 218 ($b7_{n+1}$) instead of the signals 217 ($b6_{n+1}$) and 248 ($b7_{n-1}$) of FIGS. 57 and 58. The other parts thereof are the same as those of FIGS. 57 and 58.

The units 400 and 500 for enabling/disabling intensity level adjusting subframes (light emission blocks) may be lookup tables stored in a RAM or ROM.

Figure 61:
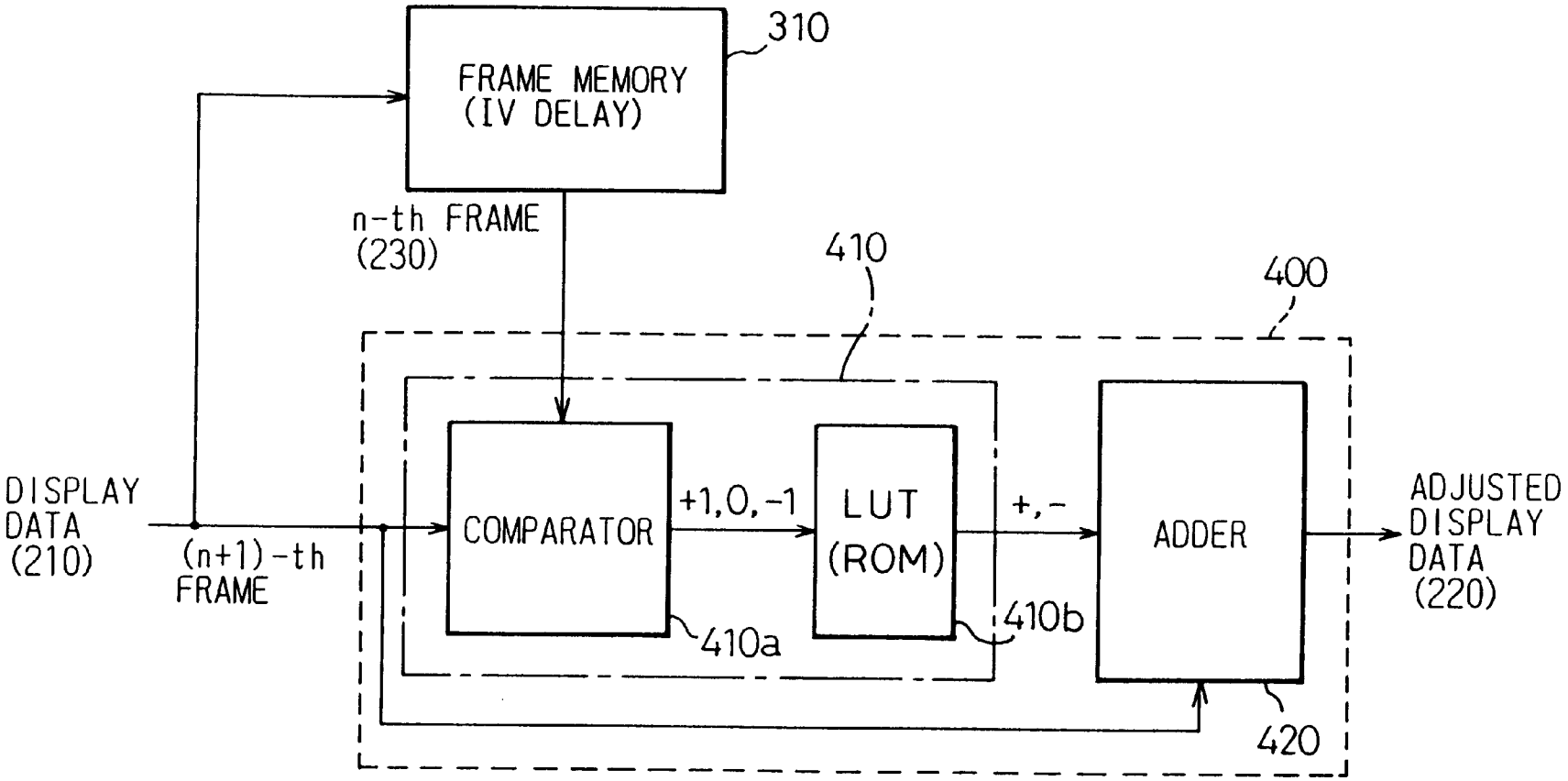
FIG. 61 is a block diagram showing a modification of the unit for inserting the light emission block of FIG. 46.

FIG. 61 shows a modification of the unit for inserting the light emission block of FIG. 46. In FIG. 46, reference numeral 310 denotes a frame memory (delay unit) for delaying original signal (display data) by one vertical synchronizing period (1V), 400 denotes a unit for adding intensity level adjusting light emission block, 410 denotes a unit for testing equivalent pulse, and 420 denotes a unit for adding equivalent pulse.

As shown in FIG. 61, in the present modification, the unit for testing equivalent pulse 410 comprises a comparator 410*a* and LUT (look up table: ROM) 410*b*, and the unit for adding equivalent pulse 420 is constituted as an adder. The comparator 410*a* compares the bit data of the frames n and n+1, when specific bit data is changed from an enabling state (ON) to a disabling state (OFF), then the LUT 410*b* outputs "+1"; when specific bit data is changed from the disabling state to the enabling state, then the LUT 410*b* outputs "−1";

and when specific bit data is not changed between both frames n and n+1, then the LUT 410*b* outputs "0".

The LUT 410*b* is, for example, constituted as a ROM where predetermined data are written, and a predetermined equivalent pulse is output from the LUT 410*b* in accordance with the output of the comparator 410*a*. Note that the equivalent pulse output from the LUT 410*b* has a positive or negative symbol. The adder 420 adds (adds or subtracts) the equivalent pulse to the display data 210, and output an adjusted display data 220.

Figure 62:
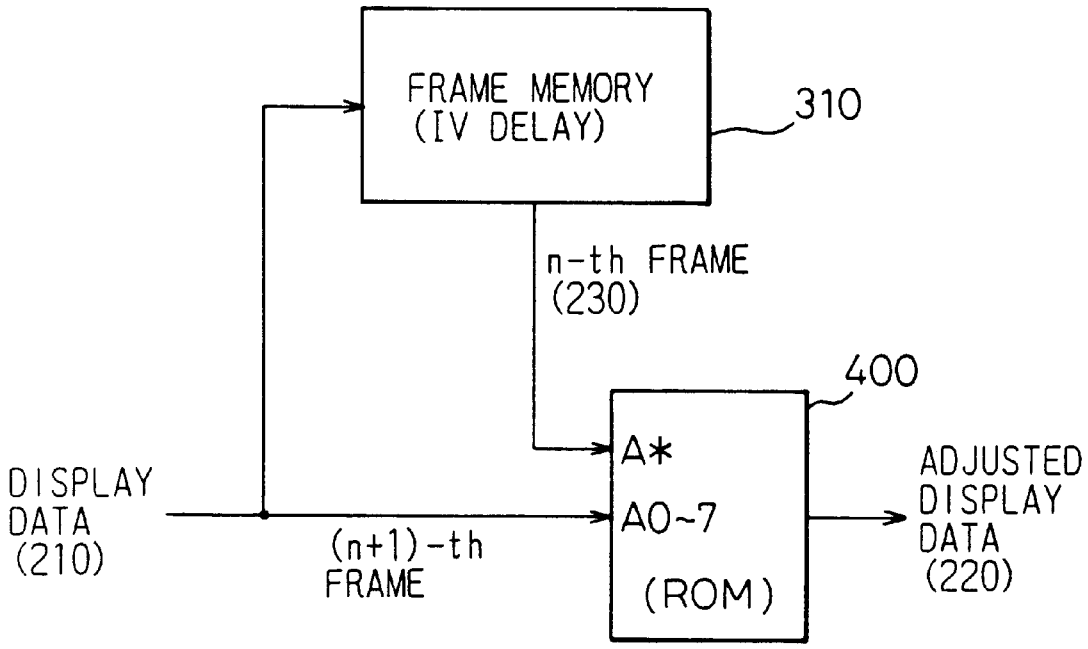
FIG. 62 is a block diagram showing another modification of the unit for inserting the light emission block of FIG. 46.

FIG. 62 shows another modification of the unit for inserting the light emission block of FIG. 46.

In the unit for inserting the light emission block of FIG. 62, the unit for adding intensity level adjusting light emission block 400 is constituted as a ROM, the bit data of the frame n (delayed signal 230 by 1V) output from the frame memory 310 and the bit data of the frame n+1 display data 210) are input to the ROM 400, and adjusted display data 220 corresponding to the bit data of the frames n and n+1 is directly output. The signals supplied to the input A* of the unit 400 are changed in accordance with the number of compared bit signals. For example, when the number of compared bit signals is two (b7 and b6), the input A* of the unit 400 receives two bit signals.

FIG. 63 is a flowchart showing an operation of the display unit according to the second aspect of the present invention. This operation employs a frame having separate addressing periods and sustain discharge periods (light emission periods).

Step S31 produces red (R), green (G), and blue (B) signals. Step S32 stores signals of a frame "n" in a frame memory. Step S33 stores signals of a frame "n+1" in a frame memory.

Step S34 checks the most significant bit b7 of each pixel in the signals of frames n and n+1. Step S35 carries out a process according to the most significant bits b7 of the frames n and n+1.

More precisely, step S35 carries out nothing if the bits b7 of the frames n and n+1 are both enabled or disabled. If the bit b7 of the frame n is disabled and the bit b7 of the frame n+1 is enabled, step S35 enables a positive equivalent pulse EPA for enabling, for example, the bit b6 for intensity level 64 in the frame n+1. If the bit b7 of the frame n is enabled and the bit b7 of the frame n+1 is disabled, step S35 enables a negative equivalent pulse EPS for disabling the bit b6 for intensity level 64 in the frame n+1.

Step S36 checks the second highest bit b6 of each pixel in the frames n and n+1. Step S37 carries out a process according to the bits b6 of the frames n and n+1.

More precisely, step S35 carries out nothing if the bits b6 of the frames n and n+1 are both enabled or disabled. If the bit b6 of the frame n is disabled and that of the frame n+1 is enabled, step S37 enables a negative equivalent pulse EPS for disabling, for example, the bit b4 for intensity level 16 in the frame n. If the bit b6 of the frame n is enabled and that of the frame n+1 is disabled, step S37 enables a positive equivalent pulse EPA for enabling the bit b4 for intensity level 16 in the frame n. Step S38 displays an image on the display panel such as a plasma display panel according to the display data thus prepared.

FIG. 64 is a flowchart showing another operation of the display unit according to the second aspect of the present invention. This operation employs a frame that distributes an addressing period into sustain discharge periods as shown in FIG. 28B. Alternatively, each frame may consists of subframes (light emission blocks) that provide individual intensity levels. Steps S41 to S46 of FIG. 64 are equal to steps S31 to S36 of FIG. 63.

Step S46 checks the second highest bit b6 of each pixel in the frames n and n+1. Step S47 carries out a process according to the bits b6 of the frames n and n+1.

More precisely, step S47 carries out nothing if the bits b6 of the frames n and n+1 are both enabled or disabled. If the bit b6 of the frame n is disabled and that of the frame n+1 is enabled, step S47 enables a positive equivalent pulse EPA for enabling, for example, the bit b4 for intensity level 16 in the frame n+1. If the bit b6 of the frame n is enabled and that of the frame n+1 is disabled, step S47 enables a negative equivalent pulse EPS for disabling the bit b4 for intensity level 16 in the frame n+1. Step S48 displays an image on the display panel such as a plasma display panel according to the display data thus prepared.

The present invention is applicable not only to gas discharge panels such as plasma display panels but also to other frame-division display panels such as panels employing DMDs (digital micromirror devices) and EL panels.

As explained above, the second aspect of the present invention enables or disables intensity level adjusting subframes among the subframes of consecutive frames that display different intensity levels, thereby preventing intensity level disturbance, smears, and false color contours in displayed images, in particular, dynamic images.

Many different embodiments of the present invention may be constructed without departing from the spirit and scope of the present invention, and it should be understood that the present invention is not limited to the specific embodiments described in this specification, except as defined in the appended claims.

What is claimed is:

1. A method of displaying a halftone image on a display unit by using a frame division technique that divides each frame of the halftone image into subframes each having a specific sustain discharge period to provide a specific intensity level, comprising the step of:

differing a displayed position of the halftone image on said display unit from subframe to subframe in each frame, the displayed position in each subframe being successively advanced between a first position determined by display data provided for a first frame and a second position determined by display data provided for a second frame next to said first frame, and the displayed position in each subframe being determined according to a motion vector set between the first position and the second position.

2. A method of displaying a halftone image as claimed in claim 1, wherein the displayed position in each subframe is determined according to control data determined by a function that is set according to characteristic values of the subframes constituting the frame and the position of the halftone image in a specific subframe.

3. A method of displaying a halftone image as claimed in claim 2, wherein said method further comprises the steps of:

displaying the halftone image at the first position in one of the subframes having a highest intensity level;

finding a delay or advance time between the highest intensity subframe and each of the other subframes;

dividing each of the delay or advance times by a frame period;

multiplying each of the quotients by the motion vector, to provide each subframe vector; calculating positions according to the subframe vectors; and displaying the halftone image at the calculated positions in the corresponding subframes.

4. A method of displaying a halftone image as claimed in claim 3, wherein an origin of the motion vector is determined at a start position of a sustain discharge period of the subframes, and the delay or advance time of each subframe is determined at a start position of a sustain discharge period of a corresponding subframe.

5. A method of displaying a halftone image as claimed in claim 3, wherein an origin of the motion vector is determined at a center position of a sustain discharge period of the subframes, and the delay or advance time of each subframe is determined at a center position of a sustain discharge period of a corresponding subframe.

6. A method of displaying a halftone image as claimed in claim 2, wherein said method further comprises the steps of:

selecting one of the subframes as a vector origin;

displaying the halftone image in the selected subframe;

finding a delay or advance time between the selected subframe and each of the other subframes;

dividing each of the delay or advance times by a frame period;

multiplying each of the quotients by the motion vector, to provide each subframe vector;

calculating positions according to the subframe vectors; and displaying the halftone image at the calculated positions in the corresponding subframes.

7. A method of displaying a halftone image as claimed in claim 6, wherein an origin of the motion vector is determined at a start position of a sustain discharge period of the subframes, and the delay or advance time of each subframe is determined at a start position of a 0 sustain discharge period of a corresponding subframe.

8. A method of displaying a halftone image as claimed in claim 6, wherein an origin of the motion vector is determined at a center position of a sustain discharge period of the subframes, and the delay or advance time of each subframe is determined at a center position of a sustain discharge period of a corresponding subframe.

9. A method of displaying a halftone image as claimed in claim 2, wherein, when the number of subframes to be turned ON in the frame is smaller than a predetermined number, said method further comprises the steps of:

forming at least one subframe groups;

selecting one of the subframe groups as a vector origin;

displaying the halftone image in the selected subframe group;

finding a delay or advance time between the intensity level center of the selected subframe group and the intensity level center of each of the other subframe groups;

dividing each of the delay or advance times by a frame period;

multiplying each of the quotients by the motion vector, to provide each subframe group vector;

calculating positions according to the subframe group vectors; and displaying the halftone image at the calculated positions in the corresponding subframe groups.

10. A method of displaying a halftone image on a display unit by using a frame division technique that divides each frame of the halftone image into subframes each having a specific sustain discharge period to provide a specific intensity level, comprising the step of:

turning OFF at least one of subframes that are coupled together when displaying the halftone image with different intensity levels, thereby suppressing a bright part to be produced by the coupled specific subframes, a displayed position in each subframe being successively advanced between a first position determined by display data provided for a first frame and a second position determined by display data provided for a second frame next to said first frame, and the displayed position in each subframe being determined according to a motion vector set between the first position and the second position.

11. A method of displaying a halftone image as claimed in claim 10, wherein the number of subframes to be additionally turned OFF or ON is determined according to a scroll speed of the halftone image or the intensity levels.

12. A method of displaying a halftone image as claimed in claim 10, wherein the subframes adjacent to the specific subframes are turned OFF or ON, when the scroll speed of the halftone image is high.

13. A method of displaying a halftone image on a display unit by using a frame division technique that divides each frame of the halftone image into subframes each having a specific sustain discharge period to provide a specific intensity level, comprising the step of:

turning ON at least one of subframes that are OFF when displaying the halftone image with different intensity levels, thereby suppressing a dark part that is produced by the specific subframes, a displayed position in each subframe being successively advanced between a first position determined by display data provided for a first frame and a second position determined by display data provided for a second frame next to said first frame, and the displayed position in each subframe being determined according to a motion vector set between the first position and the second position.

14. A method of displaying a halftone image as claimed in claim 13, wherein the number of subframes to be additionally turned OFF or ON is determined according to a scroll speed of the halftone image or the intensity levels.

15. A method of displaying a halftone image as claimed in claim 13, wherein the subframes adjacent to the specific subframes are turned OFF or ON, when the scroll speed of the halftone image is high.

16. An apparatus for displaying a halftone image on a display unit by using a frame division technique that divides each frame of the halftone image into subframes each having a specific sustain discharge period to provide a specific intensity level, comprising: a motion vector detection unit for detecting a motion vector that indicates a moving direction of the halftone image, by comparing display data for a first frame of the halftone image with display data for a second frame next to the first frame; and a differing unit for differing the display position of the halftone image from subframe to subframe in the first frame according to the motion vector, the displayed position in each subframe being successively advanced between a first position determined by display data provided for the first frame and a second position determined by display data provided for the second frame next to said first frame.

17. An apparatus for displaying a halftone image as claimed in claim 16, wherein said apparatus further comprises:

a dividing unit for dividing each delay or advance time, which is found between the first subframe and each of the other subframes in the given frame, by a frame period and providing each correction value; and a frame interpolator for multiplying the display data for the given frame by each of the correction values, to generate display data for each of the subframes of the given frame, so that the halftone image is displayed according to the display data of the subframes.

18. A method of displaying a halftone image on a display unit by using a frame division technique that divides each frame of the halftone image into subframes each having a specific sustain discharge period to provide a specific intensity level, comprising the steps of:

comparing an intensity level of a given pixel between consecutive frames when the intensity level of the pixel changes between the consecutive frames; and enabling or disabling at least one intensity level adjusting subframe in the subframes of the frame of the pixel in accordance with the result of the comparing step, wherein the step of enabling or disabling the intensity level adjusting subframe comprises the step of:

enabling an intensity level adjusting subframe in the subframes of one of consecutive frames that cause a change in intensity level between them, to substantially satisfy the following expressions:

$$S1 \leqq S2+S \leqq S3$$

or $$S1 \geqq S2+5 \geqq S3$$

where S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

19. A method of displaying a halftone image on a display unit by using a frame division technique that divides each frame of the halftone image into subframes each having a specific sustain discharge period to provide a specific intensity level, comprising the steps of:

comparing an intensity level of a given pixel between consecutive frames when the intensity level of the pixel changes between the consecutive frames; and enabling or disabling at least one intensity level adjusting subframe in the subframes of the frame of the pixel in accordance with the result of the comparing step, wherein the step of enabling or disabling the intensity level adjusting subframe comprises the step of:

enabling an intensity level adjusting subframe to substantially satisfy the following expressions:

$$0 \leqq S \leqq 2(S1\ S2)$$

or $$0 \leqq S \leqq 2(S3\ S2)$$

where S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

20. A method of displaying a halftone image on a display unit by using a frame division technique that divides each frame of the halftone image into subframes each having a specific sustain discharge period to provide a specific intensity level, comprising the steps of:

comparing an intensity level of a given pixel between consecutive frames when the intensity level of the pixel changes between the consecutive frames; and enabling or disabling at least one intensity level adjusting subframe in the subframes of the frame of the pixel in accordance with the result of the comparing step, wherein the step of enabling or disabling the intensity level adjusting subframe comprises the step of:

disabling an intensity level adjusting subframe in the subframes of one of consecutive frames that cause a change in intensity level between them, to substantially satisfy the following expressions:

$$S1 \leqq S2-S \leqq S3$$

or $$S1 \geqq S2-S \geqq S3$$

where S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

21. A method of displaying a halftone image on a display unit by using a frame division technique that divides each frame of the halftone image into subframes each having a specific sustain discharge period to provide a specific intensity level, comprising the steps of: comparing an intensity level of a given pixel between consecutive frames when the intensity level of the pixel changes-between the consecutive frames; and enabling or disabling at least one intensity level adjusting subframe in the subframes of the frame of the pixel in accordance with the result of the comparing step, wherein the step of enabling or disabling the intensity level adjusting subframe comprises the step of:

enabling an intensity level adjusting subframe to substantially satisfy the following expressions:

$$0 \leqq S \leqq 2(S2-S1)$$

or $$0 \leqq S \leqq 2(S2-S3)$$

where S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

22. A method of displaying a halftone image on a display unit by using a frame division technique that divides each frame of the halftone image into subframes each having a specific sustain discharge period to provide a specific intensity level, comprising the steps of:

comparing an intensity level of a given pixel between consecutive frames when the intensity level of the pixel changes-between the consecutive frames; and enabling or disabling at least one intensity level adjusting subframe in the subframes of the frame of the pixel in accordance with the result of the comparing step, wherein the intensity level adjusting subframe is enabled or disabled at or around the center of original subframes that are enabled to provide different intensity levels between consecutive frames.

23. A method of displaying a halftone image on a display unit by using a frame division technique that divides each frame of the halftone image into subframes each having a specific sustain discharge period to provide a specific intensity level, comprising the steps of:

comparing an intensity level of a given pixel between consecutive frames when the intensity level of the pixel changes between the consecutive frames; and enabling or disabling at least one intensity level adjusting subframe in the subframes of the frame of the pixel in accordance with the result of the comparing step, wherein the subframes are arranged in order to enable or disable the intensity level adjusting subframe at or around the center of original subframes that are enabled to provide different intensity levels between consecutive frames.

24. A method of displaying a halftone image as claimed in claim 23, wherein the subframes of each frame are arranged such that one having the highest intensity level and one having the second highest intensity level are not adjacent to each other.

25. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the step of enabling or disabling the predetermined bit of the display signals comprises the steps of:

comparing display signals provided for consecutive frames with each other; and enabling or disabling a predetermined intensity level adjusting subframe in at least one of the frames when enabled bits of the display signals change between the frames.

26. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the step of enabling or disabling the predetermined bit of the display signals comprises the step of:

enabling or disabling a predetermined intensity level adjusting subframe in one of consecutive frames "n" and "n+1" when the state of the most significant bit of each display signal provided for the frames changes between the frames.

27. A method of displaying a halftone image on a display unit by using a frame division technique that divides each frame of the halftone image into subframes each having a specific sustain discharge, period to provide a specific intensity level, comprising the steps of:

comparing display signals provided for consecutive frames with each other; and enabling or disabling a predetermined bit of the display signals according to a result of the comparison, wherein the step of enabling or disabling the predetermined bit of the display signals comprises the step of:

enabling or disabling a predetermined intensity level adjusting subframe in one of consecutive frames "n" and "n+1" when the state of a highest bit of each display signal provided for the frames changes between the frames.

28. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the subframes in each frame are arranged in ascending order of the intensity levels thereof, and the step of enabling or disabling the predetermined bit of the display signals comprises the step of:

enabling a predetermined intensity level adjusting bit of a display signal provided for a frame "n+1" when the highest intensity subframe of a frame "n" is disabled and when the highest intensity subframe of the frame "n+1" is enabled.

29. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the subframes in each frame are arranged in ascending order of the intensity levels thereof, and the step of enabling or disabling the predetermined bit of the display signals comprises the step of:

disabling a predetermined intensity level adjusting bit of a display signal provided for a frame "n+1" when the highest intensity subframe of a frame "n" is enabled and when the highest intensity subframe of the frame "n+1" is disabled.

30. A method of displaying a halftone image on a display unit by using a frame division technique that divides each frame of the halftone image into subframes each having a specific sustain discharge period to provide a specific intensity level, comprising the steps of:

comparing display sign is provided for consecutive frames with each other; and enabling or disabling a predetermined bit of the display signals according to a result of the comparison, wherein the subframes in each frame are arranged in descending order of the intensity levels thereof, and the step of enabling or disabling the predetermined bit of the display signals comprises the step of:

disabling a predetermined intensity level adjusting bit of a display signal provided for a frame "n" when the highest intensity subframe of the frame "n" is disabled and when the highest intensity subframe of a frame "n+1" is enabled.

31. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the subframes in each frame are arranged in ascending order of the intensity levels thereof, and the step of enabling or disabling the predetermined bit of the display signals comprises the step of:

enabling a predetermined intensity level adjusting bit of a display signal provided for a frame "n" when the highest intensity subframe of the frame "n" is enabled and when the highest intensity subframe of a frame "n+1" is disabled.

32. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the subframes in each frame are arranged with one having the second highest intensity level at the top and one having the highest intensity level at the end, and the step of enabling or disabling the predetermined bit of the display signals comprises the step of:

enabling a predetermined intensity level adjusting bit of a display signal provided for a frame "n+1" when the highest intensity subframe of a frame "n" is disabled and when the highest intensity subframe of the frame "n+1" is enabled.

33. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the subframes in each frame are arranged with one having the second highest intensity level at the top and one having the highest intensity level at the end, and the step of enabling or disabling the predetermined bit of the display signals comprises the step of:

disabling a predetermined intensity level adjusting bit of a display signal provided for a frame "n+1" when the highest intensity subframe of a frame "n" is enabled and when the highest intensity subframe of the frame "n+1" is disabled.

34. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the subframes in each frame are arranged with one having the highest intensity level at the top and one having the second highest intensity level at the end, and the step of enabling or disabling the predetermined bit of the display signals comprises the step of:

disabling a predetermined intensity level adjusting bit of a display signal provided for a frame "n+1" when the highest intensity subframe of a frame "n" is disabled and when the highest intensity subframe of the frame "n+1" is enabled.

35. A method of displaying a halftone image on a display unit by using a frame division technique that divides each frame of the halftone image into subframes each having a specific sustain discharge period to provide a specific intensity level, comprising the steps of:

comparing display signals provided for consecutive frames with each other; and enabling or disabling a predetermined bit of the display signals according to a result of the comparison, wherein the subframes in each frame are arranged with one having the highest intensity level at the top and one having the second highest intensity level at the end, and the step of enabling or disabling the predetermined bit of the display signals comprises the step of:

enabling a predetermined intensity level adjusting bit of a display signal provided for a frame "n+1" when the highest intensity subframe of a frame "n" is enabled and when the highest intensity subframe of the frame "n+1" is disabled.

36. An apparatus for displaying a halftone image on a display unit by using a frame division technique that divides each frame of the halftone image into subframes each having a specific sustain discharge period to provide a specific intensity level, comprising:

a subframe turning control unit for turning OFF at least one of subframes that are coupled together when displaying the halftone image with different intensity levels, thereby suppressing a bright part to be produced by the coupled specific subframes, and for turning OFF or ON the subframes adjacent to the specific subframes, when the scroll speed of the halftone image is high, the number of subframes to be additionally turned OFF or ON being determined according to a scroll speed of the halftone image or the intensity levels.

37. An apparatus for displaying a halftone image on a display unit by using a frame division technique that divides each frame of the halftone image into subframes each having a specific sustain discharge period to provide a specific intensity level, comprising:

a subframe turning control unit for turning ON at least one of subframes that are OFF when displaying the halftone image with different intensity levels, thereby suppressing a dark part that is produced by the specific subframes, and for turning OFF or ON the subframes adjacent to the specific subframes, when the scroll speed of the halftone image is high, the number of subframes to be additionally turned OFF or ON being determined according to a scroll speed of the halftone image or the intensity levels.

38. An apparatus for displaying a halftone image on a display unit by using a frame division technique that divides each frame of the halftone image into subframes each having a specific sustain discharge period to provide a specific intensity level, comprising:

a comparing unit for comparing an intensity level of a given pixel between consecutive frames when the intensity level of the pixel changes between the consecutive frames; and an enabling or disabling unit for enabling or disabling at least one intensity level adjusting subframe in the subframes of the frame of the pixel in accordance with the result of the comparing unit, wherein the enabling or disabling unit comprises an intensity level enabling unit for enabling an intensity level adjusting subframe in the subframes of one of consecutive frames that cause a change in intensity level between them, to substantially satisfy the following expressions:

$$S1 \leqq S2+S \leqq S3$$

or $$S1 \geqq S2+S \geqq S3$$

where S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

39. An apparatus for displaying a halftone image on a display unit by using a frame division technique that divides each frame of the halftone image into subframes each having a specific sustain discharge period to provide a specific intensity level, comprising:

a comparing unit for comparing an intensity level of a given pixel between consecutive frames when the intensity level of the pixel changes between the consecutive frames, and an enabling or disabling unit for enabling or disabling at least one intensity level adjusting subframe in the subframes of the frame of the pixel in accordance with the result of the comparing unit, wherein the enabling or disabling unit comprises an intensity level enabling unit for enabling an intensity level adjusting subframe to substantially satisfy the following expressions:

$$0 \leqq S \leqq 2(S1-S2)$$

or $$0 \leqq S \leqq 2(S3-S2)$$

wherein S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

40. An apparatus for displaying a halftone image on a display unit by using a frame division technique that divides each frame of the halftone image into subframes each having a specific sustain discharge period to provide a specific intensity level, comprising:

a comparing unit for comparing an intensity level of a given pixel between consecutive frames when the intensity level of the pixel changes between the consecutive frames; and an enabling or disabling unit for enabling or disabling at least one intensity level adjusting subframe in the subframes of the frame of the pixel in accordance with the result of the comparing unit, wherein the enabling or disabling unit comprises an intensity level disabling unit for disabling an intensity level adjusting subframe in the subframes of one of consecutive frames that cause a change in intensity level between them, to substantially satisfy the following expressions:

$$S1 \leqq S2-S \leqq S3$$

or $$S1 \geqq S2-S \geqq S3$$

where S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

41. An apparatus for displaying a halftone image on a display unit by using a frame division technique that divides each frame of the halftone image into subframes each having a specific sustain discharge period to provide a specific intensity level, comprising:

a comparing unit for comparing an intensity level of a given pixel between consecutive frames when the intensity level of the pixel changes between the consecutive frames; and an enabling or disabling unit for enabling or disabling at least one intensity level adjusting subframe in the subframes of the frame of the pixel in accordance with the result of the comparing unit, wherein the enabling or disabling unit comprises an intensity level enabling unit for enabling an intensity level adjusting subframe to substantially satisfy the following expressions:

$$0 \leqq S \leqq 2(S2\ S1)$$

or $$0 \leqq S \leqq 2(S2\ S3)$$

where S1 is an average of B(t), which is a temporal change in a stimulus on a human eye, before the change of intensity level, S2 is an average of B(t) during the change of intensity level, S3 is an average of B(t) after the change of intensity level, and S is an average of a temporal change in a stimulus on a human eye due to the intensity level adjusting subframe.

* * * * *

UNITED STATES PATENT AND TRADEMARK OFFICE

CERTIFICATE OF CORRECTION

PATENT : 5.907,316

DATED : May 25, 1999

INVENTOR(S) : Shigeo Mikoshiba, et al

It is certified that error appears in the above-identified patent and that said Letters Patent is hereby corrected as shown below:

Title page, item [73] Assignee: add --Mikoshiba, Shigeo, Tokyo, Japan--.

Signed and Sealed this

Eleventh Day of July, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,907,316
DATED : May 25, 1999
INVENTOR(S) : Shigeo Mikoshiba et al.

It is certified that error appears in the above-identified patent and that said Letters Patent is hereby corrected as shown below:

Column 31,
Line 25, change "S1≥S2+5≥S3" to -- S1≥S2+S≥S3 --.
Line 50, change "0≤S≤2(S1 S2)" to -- 0≤S≤2(S1-S2) --.
Line 54, change "0≤S≤2(S3 S2)" to -- 0≤S≤2(S3-S2) --.

Column 38,
Line 42, change "0≤S≤2(S2 S1)" to -- 0≤S≤2(S2-S1) --.
Line 46, change "0≤S≤2(S2 S3)" to -- 0≤S≤2(S2-S3) --.

Signed and Sealed this

Seventeenth Day of June, 2003

JAMES E. ROGAN
*Director of the United States Patent and Trademark Office*